US006512721B1

(12) United States Patent
Amano et al.

(10) Patent No.: US 6,512,721 B1
(45) Date of Patent: Jan. 28, 2003

(54) LUMINOUS DIAL FOR TIMEPIECE

(75) Inventors: Masao Amano, Yamanashi-ken (JP); Shunji Minami, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 61 days.

(21) Appl. No.: 09/702,259

(22) Filed: Oct. 30, 2000

(30) Foreign Application Priority Data

Nov. 12, 1999 (JP) ..... 11-321860
Dec. 27, 1999 (JP) ..... 11-370891
Sep. 28, 2000 (JP) ..... 11-295499

(51) Int. Cl.[7] ..... G04B 19/30; G04B 19/32; H01J 1/62; H05B 33/02

(52) U.S. Cl. ..... 368/67; 368/226; 368/227; 368/232; 313/510; 362/23

(58) Field of Search ..... 368/67, 226–228, 368/232; 313/506–510, 110; 362/23

(56) References Cited

U.S. PATENT DOCUMENTS 5,426,621 A * 6/1995 Akasaka ..... 368/232
5,838,640 A 11/1998 Sonoda et al.
5,838,644 A * 11/1998 Yoneda et al. ..... 368/323
5,880,796 A 3/1999 Sonoda et al.
5,930,204 A 7/1999 Sonoda et al.
5,966,344 A * 10/1999 Umemoto et al. ..... 368/232
6,020,943 A 2/2000 Sonoda et al.
6,208,591 B1 * 3/2001 Sakurazawa et al. ..... 368/67
6,266,297 B1 * 7/2001 Sonoda et al. ..... 368/67

* cited by examiner

*Primary Examiner*—David Martin
*Assistant Examiner*—Jeanne-Marguerite Goodwin
(74) *Attorney, Agent, or Firm*—Frishauf, Holtz, Goodman & Chick, P.C.

(57) ABSTRACT

A dial for timepiece is provided which includes a decoration member having a through hole, and a luminescent member disposed under the decoration member. A first surface processed layer is provided on an upper surface of the decoration member, and a second surface processed layer having a light-transmissive property is provided on an upper surface of the luminescent member. When the luminescent member is turned on, light emitted from the luminescent member is transmitted through the second surface processed layer and passes through the through hole of the decoration member. Because the transmitted light illuminates the upper surface side of the decoration member partially in accordance with the through hole, the dial is visible even in a dark place. In addition, decoration effects can be achieved by both the first surface processed layer and the second surface processed layer in accordance with the through hole.

23 Claims, 41 Drawing Sheets

LUMINOUS DIAL FOR TIMEPIECE

BACKGROUND OF THE INVENTION

1. Field of the Invention

The present invention relates to a dial for a timepiece, such as a wrist watch, and which has a luminescent function, and a timepiece have such a luminescent dial.

2. Description of Related Art

According to an earlier development, there is a dial for timepiece, such as a dial for wrist watch, which comprises a luminescent member made of an EL element (Electro Luminescence element) and which enables a user to recognize time even in a dark place by emitting the luminescent member.

As a dial for timepiece, there are ones disclosed in, for example, U.S. Pat. Nos. 5,838,640, 5,930,204, 5,880,796 and 6,020,943.

As this type of dial for timepiece, for example, there is one having a structure in which a light-transmissive member is provided in an upper position of the luminescent member, or one having a structure in which a decoration member having a through hole for decoration is provided in an upper position of the luminescent member.

However, in the former dial for timepiece, a light emitted from the luminescent member is transmitted through the light-transmissive member and the transmitted light only illuminates the upper whole surface side of the light-transmissive member. In the latter dial for timepiece, a light emitted from the luminescent member is transmitted through the through hole for decoration, which is provided in the decoration member, and the transmitted light only illuminates the upper surface side of the decoration member partially in accordance with the through hole. In any one of the dials for timepiece, there is a troublesome problem that a sufficient decoration effect cannot be obtained.

SUMMARY OF THE INVENTION

The present invention was developed in view of these problems. An object of the present invention is to recognize time even in a dark place and to obtain various decoration effects.

In order to solve the above-described problems, the present invention comprises the following elements.

Reference numerals attached to each element which will be explained in each embodiment described below, and the like are attached to each element with parentheses.

In accordance with the first aspect of the present invention, as shown in FIGS. 1 to 4, a dial (4) for timepiece, comprises:

a decoration member (10) having a through hole (13) for decoration, and a luminescent member (11) disposed under the decoration member;

wherein a surface processed layer (second surface processed layer 16) is provided on an upper surface of the luminescent member.

According to the present invention, because a light transmitted through the through hole of the decoration member during the emission of the luminescent member, illuminates the upper surface side of the decoration member partially in accordance with the through hole, it is possible to recognize time even in a dark place. Further, because the decoration effect caused by the decoration member and the decoration effect caused by the surface processed layer of the luminescent member in accordance with the through hole of the decoration member are obtained, various decoration effects can be obtained by both two decoration effects.

In accordance with the second aspect of the present invention, as shown in FIGS. 5 and 6, a dial (20) for timepiece, comprises:

a decoration member (10) having a through hole (13) for decoration, a light-transmissive member (21) disposed under the decoration member, and a luminescent member (11) disposed under the light-transmissive member;

wherein a surface processed layer (third surface processed layer 22, fourth surface processed layer 23 or second surface processed layer 16) is provided on at least one surface of an upper surface of the light-transmissive member, a lower surface of the light-transmissive member and an upper surface of the luminescent member.

According to the present invention, because a light transmitted through the through hole of the decoration member during the emission of the luminescent member, illuminates the upper surface side of the decoration member partially in accordance with the through hole, it is possible to recognize time even in a dark place. Further, a three-dimensional decoration effect can be obtained by the decoration effect caused by the decoration member and by the decoration effect caused by the surface processed layer provided on at least one surface of an upper surface of the light-transmissive member, a lower surface of the light-transmissive member and an upper surface of the luminescent member in accordance with the through hole of the decoration member. Therefore, more various decoration effects can be obtained.

As shown in FIGS. 1 to 6, the surface processed layer (second surface processed layer 16, third surface processed layer 22 or fourth surface processed layer 23) is a decoration layer formed by application, printing, deposition or the like. When the color of the surface processed layer is similar to that of the decoration member (10), the through holes (13) of the decoration member can be blind during the non-emission of the luminescent member (11).

As shown in FIGS. 12 and 17, because the surface processed layer (third surface processed layer 39) is an irregular layer made by forming a surface of the irregular layer into a finely irregular shape, it is possible that a light emitted from the luminescent member (11) is diffused from the through holes (13) of the decoration member (10) to the outside of the dial for timepiece during the emission of the luminescent member. Thereby, the diffused light can brightly illuminate the outer peripheral side of the through holes.

As shown in FIGS. 11 to 15, the surface processed layer (third surface processed layer 39) which is an irregular layer made by forming a surface of the surface processed layer into a finely irregular shape, is provided on the upper surface of the light-transmissive member (37), the surface processed layer (fourth surface processed layer 40) which is an irregular layer made by forming a surface of the surface processed layer into a finely irregular shape, or the surface processed layer which is a decoration layer formed by application, printing, deposition or the like, and having light-transmissive property, is provided on the lower surface of the light-transmissive member, and the surface processed layer (second surface processed layer 41) which is a decoration layer formed by application, printing, deposition or the like, and having light-transmissive property, is provided on the upper surface of the luminescent member (11).

Thereby, the decoration effect shown during the emission of the luminescent member and the decoration effect shown during the non-emission thereof, which are different from each other can be obtained.

As shown in FIGS. 16 to 20, the surface processed layer (third surface processed layer 39) which is an irregular layer made by forming a surface of the surface processed layer into a finely irregular shape, is provided on the upper surface of the light-transmissive member (37), the surface processed layer (fourth surface processed layer 46) which is an irregular layer made by forming a surface of the surface processed layer into a finely irregular shape, or the surface processed layer which is a decoration layer formed by application, printing, deposition or the like, and having no light-transmissive property, is provided on the lower surface of the light-transmissive member, and the surface processed layer (second surface processed layer 47) which is a decoration layer formed by application, printing, deposition or the like, and having no light-transmissive property, is provided on the upper surface of the luminescent member (11).

When the surface processed layer which is a decoration layer having no light-transmissive property, is formed into the shape of a pattern, a figure, a design or the like, the decoration effect shown during the emission of the luminescent member and the decoration effect shown during the non-emission thereof, which are different from each other can be obtained.

As shown in FIGS. 1 to 8, because the surface processed layer (first surface processed layer 14) which is a decoration layer formed by application, printing, deposition or the like, is provided on an upper surface of the decoration member (10), the decoration effect can be obtained by the surface processed layer. Therefore, more various decoration effects can be obtained.

In accordance with the third aspect of the present invention, as shown in FIGS. 9 and 10, a dial (30) for timepiece, comprises:

a decoration member (10) having a through hole (13) for decoration, a light-transmissive member (31) provided in the through hole of the decoration member, and a luminescent member (11) disposed under the light-transmissive member and the decoration member;

wherein a surface processed layer (first surface processed layer 32) which is a decoration layer formed by application, printing, deposition or the like, and having light-transmissive property, is provided on an upper surface of the decoration member and on an upper surface of the light-transmissive member.

According to the present invention, because a light emitted from the luminescent member is transmitted through the light-transmissive member provided in the through hole of the surface processed layer and through the light-transmissive surface processed layer disposed on the upper surface of the light-transmissive member during the emission of the luminescent member and the transmitted light illuminates the upper surface side of the decoration member partially in accordance with the through hole, it is possible to recognize time even in a dark place. Further, because of the surface processed layer which is provided on the upper surface of the decoration member and on the upper surface of the light-transmissive member, the decoration effect shown during the emission of the luminescent member and the decoration effect shown during the non-emission thereof, which are different from each other can be obtained. Therefore, various decoration effects can be obtained.

In accordance with the fourth aspect of the present invention, as shown in FIGS. 7 and 8, a dial (25) for timepiece, comprises:

a decoration member (10) having a through hole (13) for decoration, a color light-transmissive member (26) disposed under the decoration member, and a luminescent member (11) disposed under the light-transmissive member.

According to the present invention, a light emitted from the luminescent member is transmitted through the color light-transmissive member during the emission of the luminescent member. The colored light transmitted through the light-transmissive member passes through the through hole of the decoration member. The light illuminates the upper surface side of the decoration member partially in accordance with the through hole. Thereby, it is possible to recognize time even in a dark place. Further, the decoration effect caused by the decoration member and the decoration effect caused by the color light-transmissive member in accordance with the through hole of the decoration member can be obtained. Therefore, various decoration effects can be obtained by both the decoration effects.

In accordance with the fifth aspect of the present invention, as shown in FIGS. 21 to 23, a dial (50) for timepiece, comprises:

a luminescent member (11), and a light-transmissive member (51) disposed on an upper layer of the luminescent member;

wherein a surface processed layer (53) having light-transmissive property is provided on an upper surface of the light-transmissive member by an electric casting process.

According to the present invention, because a light emitted from the luminescent member is transmitted through the light-transmissive member and through the surface processed layer disposed on the upper surface of the light-transmissive member and outgoes upwardly, the light can illuminate the upper surface side of the light-transmissive member. Thereby, it is possible to recognize time even in a dark place. Because the surface processed layer formed by the electric casting process is provided on the upper surface of the light-transmissive member, the representation made by the irregular pattern of the surface processed layer is varied. As a result, various diffusing states for the light or various reflecting states for the light can be obtained in accordance with the irregular pattern thereof. Therefore, the number of variations of decorative style can increase. Further, various decoration effects can be obtained.

In this case, as shown in FIGS. 24 to 34, the light-transmissive layer (56, 61, 66, 71 and 76) and a metallic member (58, 63, 67, 73, 78 and 82) are disposed on the upper layer of the luminescent member so as to expose both an upper surface of the light-transmissive member and an upper surface of the metallic member. Because a light emitted from the luminescent member is transmitted through the light-transmissive member and through the surface processed layer disposed on the upper surface of the light-transmissive member and outgoes upwardly, it is possible to recognize time even in a dark place. The decorative representation is varied by the surface processed layer disposed on the upper surface of the light-transmissive member. Further, because a feeling of metallic gloss is obtained by the metallic member, a user can be filled with a feeling of high quality. Because the decoration effects caused by both the surface processed layer of the light-transmissive member and the metallic member can be obtained, the number of variations of decorative style can increase. Therefore, various decoration effects can be obtained.

Because the light-transmissive layer which is not shown in the figure, is made of colorless transparent material, color translucent material or material including powder and having light-transmissive property, the decoration effect can be obtained by the above light-transmissive member. Therefore, the number of variations of decorative style can increase. Further, various decoration effects can be obtained.

As shown in FIGS. 35 and 36, because the dial for timepiece has a structure in which a plurality of different electric casting design portions (first electric casting design portion 87 and 92 and second electric casting design portion 88 and 93) or mirror-surface portions (94) are mixed on the surface processed layer, the representation made by the irregular pattern of the surface processed layer is more varied. Therefore, the number of variations of decorative style can increase. Further, various decoration effects can be obtained.

As shown in FIGS. 37 and 38, because a metallic layer (96 and 101) having light-transmissive property is at least partially provided on an upper surface of the light-transmissive member (51) or a lower surface of the light-transmissive member, a feeling of metallic gloss can be obtained by the metallic layer. Further, a user can be filled with a feeling of high quality. Therefore, the number of variations of decorative style can increase. Further, various decoration effects can be obtained.

As shown in FIGS. 39 to 45, because a decoration layer (106, 121 and 126) is at least partially provided above the metallic layer (96, 101 and 127) or under the metallic layer, the decoration effect can be obtained by the decoration layer. Therefore, the number of variations of decorative style can increase and various decoration effects can be obtained. In this case, as shown in FIGS. 39 to 41, when the decoration layer (106) is provided under the metallic layer (96), the decoration layer is hidden by the metallic layer during the non-emission of the luminescent member. On the other hand, during the emission of the luminescent member, the decoration layer appears on the dial for timepiece. The decoration effect shown during the emission of the luminescent member and the decoration effect shown during the non-emission thereof, which are different from each other can be obtained. Therefore, the number of variations of decorative style can increase. Further, more various decoration effects can be obtained.

As shown in FIGS. 46 and 47, because a metallic layer (131) having light-transmissive property and a decoration layer (132) are partially arranged on an upper surface of the light-transmissive member (51), the decoration effect caused by both the metallic layer and the decoration layer as well as the decoration effect caused by the surface processed layer can be obtained. Therefore, the number of variations of decorative style can increase. Further, various decoration effects can be obtained.

Because the decoration layer which is not shown in the figure, has a structure in which one part of the decoration layer has a different light-transmissive property from another, the decoration effect shown during the emission of the luminescent member and the decoration effect shown during the non-emission thereof, which are different from each other can be obtained. Therefore, the number of variations of decorative style can increase. Further, more various decoration effects can be obtained.

Because the luminescent member which is not shown in the figure, has a structure in which an intensity of a light emitted from the luminescent member is adjustable, the decorative representation made by the decoration layer can be more varied by adjusting the light intensity during the emission of the luminescent member. Thereby, the number of variations of decorative style can increase more. Further, more various decoration effects can be obtained.

In accordance with the sixth aspect of the present invention, as shown in FIGS. 48 and 49, a dial (140) for timepiece, comprises:

- a luminescent member (142),
- a light-transmissive member (144) disposed above the luminescent member,
- a color layer (145) provided on an upper surface of the light-transmissive member and having light-transmissive property, and
- a thin film metallic layer (146) having light-transmissive property and provided on a lower surface of the light-transmissive member facing to the luminescent member.

According to the present invention, because a light emitted from the luminescent member is transmitted through the thin film metallic layer having light-transmissive property, the light-transmissive member and the color layer, and the colored light transmitted through the color layer illuminates the upper surface side of the color layer, it is possible to recognize time even in a dark place. Further, the decoration effect caused by the colored light transmitted through the color layer and the metallic decoration effect caused by the thin film metallic layer can be obtained. Therefore, various decoration effects can be obtained by both the above decoration effects.

As shown in FIGS. 50 to 53, because an irregular portion (151) is wholly or partially formed on at least one surface of an upper surface of the light-transmissive member (144) and a lower surface of the light-transmissive member in the dial (150) for timepiece, the light emitted from the luminescent member can be diffused by the irregular portion. Therefore, various decoration effects can be obtained by the irregular portion.

As shown in FIGS. 56 to 59, because the irregular portion is a printing layer (161) in the dial (160) for timepiece, the irregular portion can be simply and easily formed. Thereby, the dial for timepiece, which is manufactured at a low cost, can be obtained.

As shown in FIG. 55, because a decoration portion (156) is partially provided on the color layer (145) in the dial (155) for timepiece, the decoration effect can be caused by the above decoration portion.

As shown in FIG. 54, because a decoration portion (156) is partially provided on the lower surface of the light-transmissive member (144), and the thin film metallic layer (146) is provided so as to cover the decoration portion in the dial (155) for timepiece, the decoration effect can be caused by the decoration portion provided on the thin film metallic layer.

As shown in FIGS. 49 to 59, because a transparent protect film (147) is provided on a lower surface of the thin film metallic layer (146) in the dial (140, 150, 155 and 160) for timepiece, the thin film metallic layer can be protected by the protect film excellently even though the thin film metallic layer is formed thinly.

In accordance with the seventh aspect of the present invention, as shown in FIGS. 1 to 49, a timepiece (wrist watch) comprises: a dial (4, 50, 140, 150, 155 and 160) for timepiece;

wherein the dial for timepiece is disposed in a watch case (wrist watch case 1) and a watch glass (2) is mounted in an upper position of the dial for timepiece, which is disposed in the watch case.

According to the present invention, because the dial for timepiece can be seen through the watch glass mounted in an upper position of the dial for timepiece even though the dial for timepiece is disposed in the watch case, it is possible to recognize time by the dial for timepiece even in a dark place. Further, various decoration effects can be obtained by the dial for timepiece.

BRIEF DESCRIPTION OF THE DRAWINGS

FIG. 15 is a plan view showing a state that the dial for timepiece of FIG. 11 is turned on;

FIG. 20 is a plan view showing a state that the dial for timepiece of FIG. 16 is turned on;

PREFERRED EMBODIMENT OF THE INVENTION

Embodiments of the present invention will be explained with reference to figures, as follows.

First Embodiment

Hereinafter, the first embodiment in which a dial for timepiece according to the present invention is applied to a wrist watch will be explained with reference to FIGS. 1 to 4.

Figure 1:
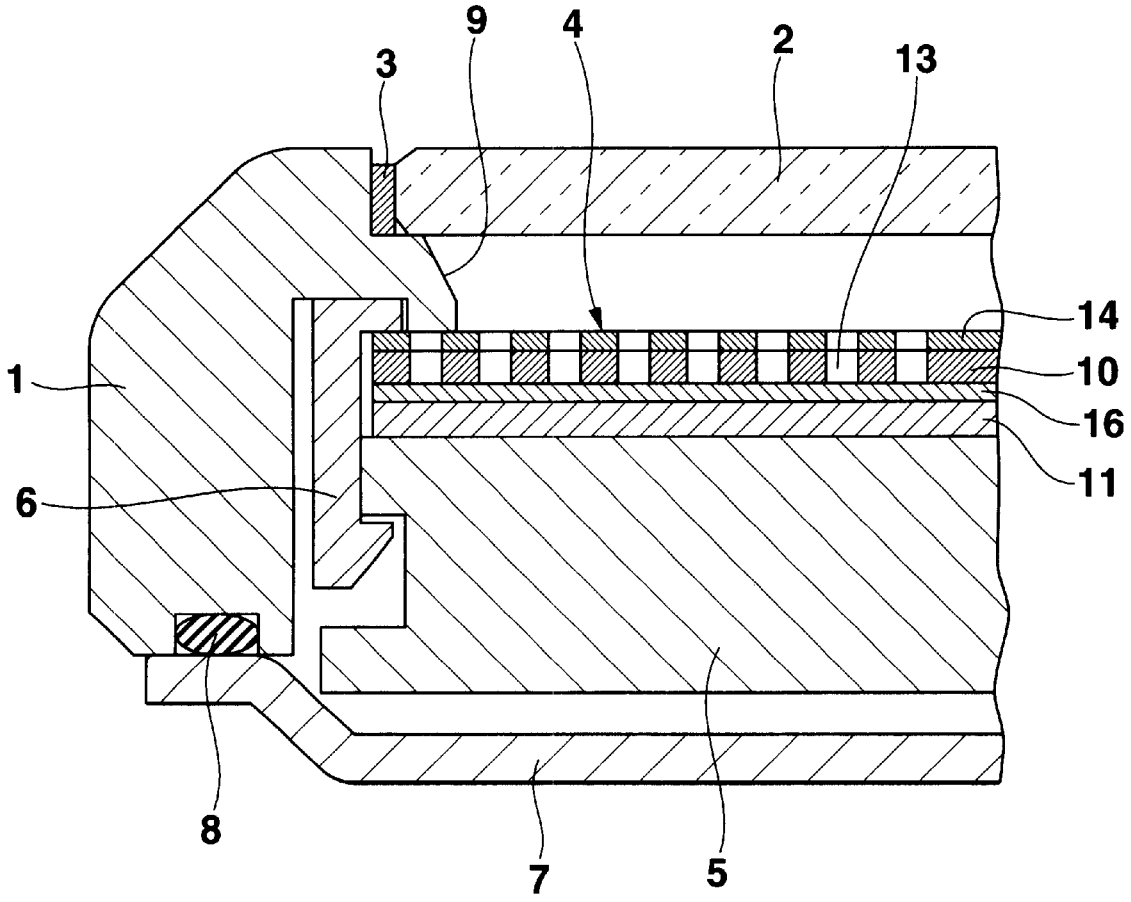
FIG. 1 is an enlarged cross-sectional view showing a principal portion of the first embodiment in which a dial for timepiece according to the present invention, is applied to a wrist watch.

FIG. 1 is a principal enlarged sectional view showing an inner structure of a wrist watch. The wrist watch comprises a wrist watch case 1. A watch glass 2 is mounted on an upper portion of the wrist watch case 1 via a packing 3. A dial 4 for timepiece and a watch module 5 are contained in the wrist watch case 1 so as to be attached to an inner frame 6. A rear cover 7 is attached to a lower surface of the wrist watch case 1 via a waterproof ring 8.

The watch module 5 has at least an analog function between an analog function and a digital function. The watch module 5 has a structure so that hands (not shown in the figure) are moved above the dial 4 for timepiece. On an inner peripheral surface of the wrist watch case 1, a blind portion 9 for hiding the inner frame 6, which is in contact with an outer peripheral portion of an upper surface of the dial 4 for timepiece is formed so as to project into the inside of the wrist watch case 1.

Figure 2:
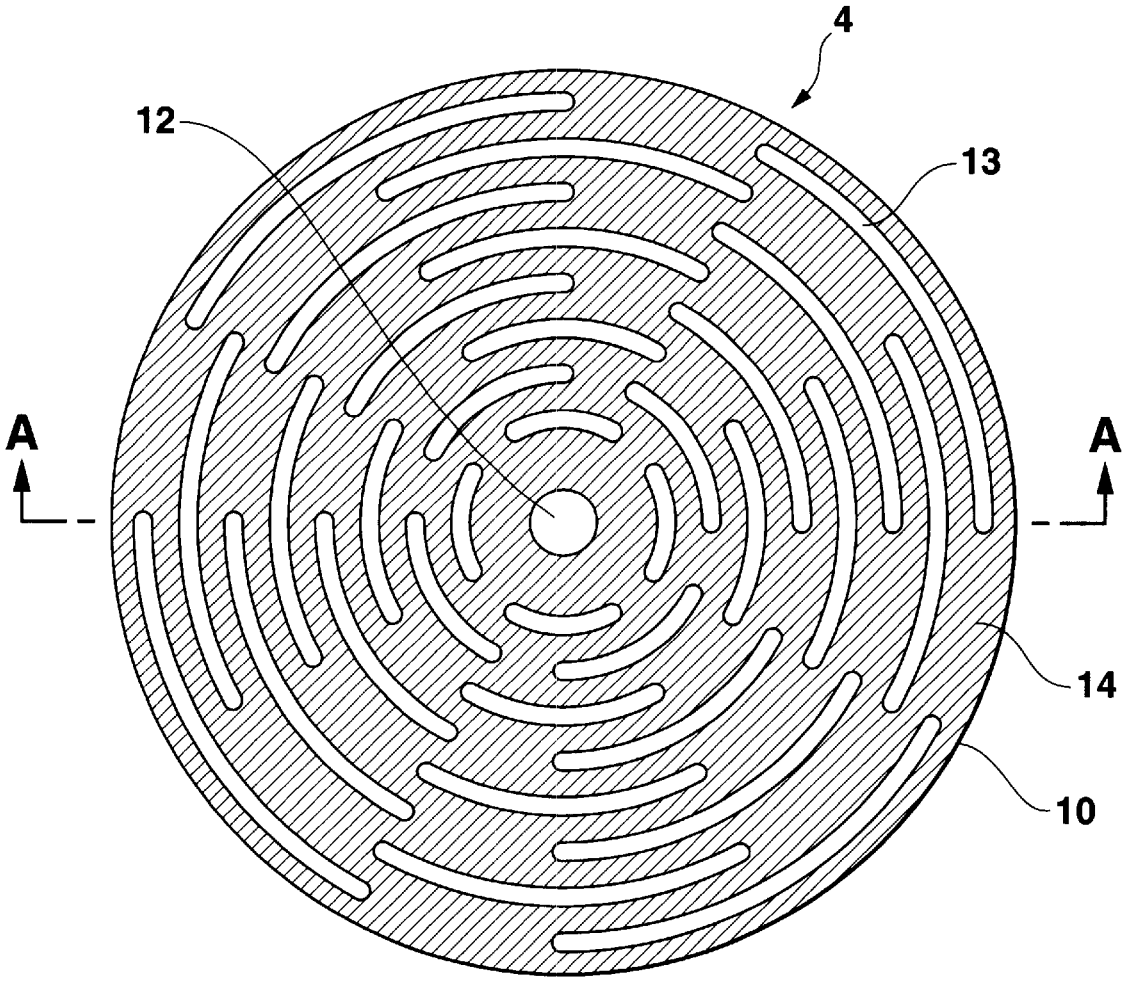
FIG. 2 is a plan view showing the dial for timepiece of FIG. 1.
Figure 3:
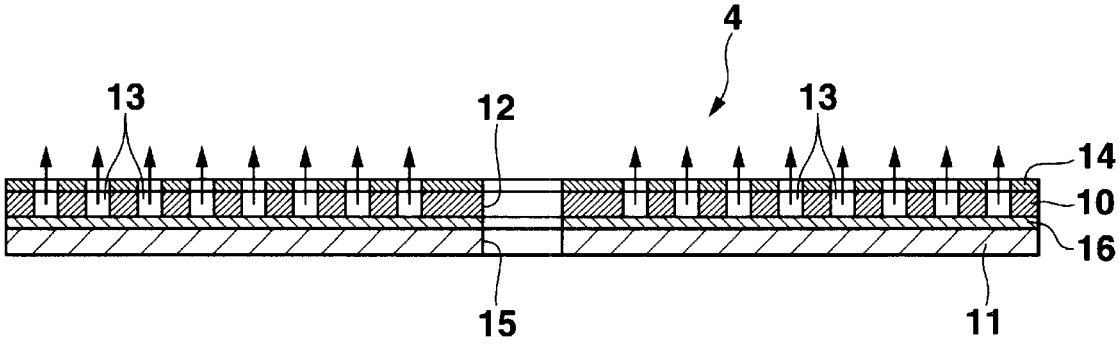
FIG. 3 is an enlarged cross-sectional view taken on line A—A of FIG. 2.
Figure 4:
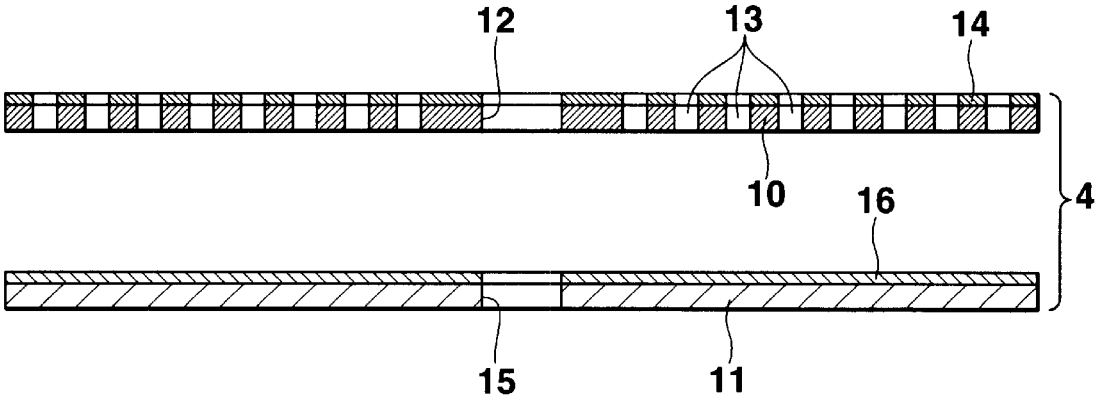
FIG. 4 is an exploded cross-sectional view showing the dial for timepiece of FIG. 3.

The dial 4 for timepiece is formed in a circular shape as shown in FIG. 2. As shown in FIGS. 3 and 4, the dial 4 for timepiece has a two-layer structure having a decoration member 10 disposed on an upper side of the two-layer structure and a luminescent member 11 disposed under the decoration member 10. The dial 4 for timepiece is arranged on an upper surface of the watch module 5 as shown in FIG. 1.

The decoration member 10 is a circular plate made of metal or synthetic resin. On a central portion thereof, a hand shaft hole 12 for inserting a hand shaft (not shown in the figure) of the watch module 5 is provided. On the decoration member 10, a plurality of through holes 13 for a plurality of decorations are formed along a plurality of concentric circles of which a center is the hand shaft hole 12. The through holes 13 are formed in slits which become longer in proportion as the slits are apart from the central portion toward the outer peripheral portion. Thereby, a design can be represented. On the upper surface of the decoration member 10, a first surface processed layer 14 which is a decoration layer formed by application, printing, deposition or the like, is provided.

The luminescent member 11 is a plate-like emitting member having an emitting element, such as an EL element. The luminescent member 11 is electrically connected with electrodes (not shown in the figure) of the watch module 5. On a central portion of the luminescent member 11, a hand shaft hole 15 is provided so as to correspond to the hand shaft hole 12 of the decoration member 10 as shown in FIGS. 3 and 4. On an upper surface of the luminescent member 11, a second surface processed layer 16 which is a decoration layer formed by application, printing, deposition or the like, is provided. The second surface processed layer 16 is a decoration layer having light-transmissive property. Although a color of the second surface processed layer 16 maybe dissimilar to that of the first surface processed layer 14 provided on the upper surface of the decoration member 10, it is preferable that the color of the second surface processed layer 16 is similar to that of the first surface processed layer 14.

In such a dial 4 for timepiece, which is used for a wrist watch, when the luminescent member 11 disposed under the decoration member 10 emits light, the light emitted from the luminescent member 11 is transmitted through the second surface processed layer 16 provided on the upper surface of the luminescent member 11 and passes through the through holes 13 of the decoration member 10. The light partially illuminates the upper surface side of the decoration member 10 in accordance with the through holes 13. Thereby, it is possible to recognize time through the watch glass 2 even in a dark place.

In the dial 4 for timepiece, both during the emission of the luminescent member 11 and during the non-emission thereof, the decoration effect caused by the first surface processed layer 14 provided on the upper surface of the decoration member 10 and the decoration effect caused by the second surface processed layer 16 provided on the upper surface of the luminescent member 11, in accordance with the through holes 13 of the decoration member 10 are obtained. As a result, the number of variations of decorative style can increase by both surface processed layers. Therefore, various decoration effects can be obtained. In this case, when the color of the first surface processed layer 14 of the decoration member 10 is similar to that of the second surface processed layer 16 of the luminescent member 11, the through holes 13 of the decoration member 10 can be blind during the non-emission of the luminescent member 11.

In this wrist watch, because the dial 4 for timepiece can be seen through the watch glass 2 even though the dial 4 for timepiece is disposed in the watch case 1 and the watch glass 2 is mounted in the upper position of the dial 4 for timepiece, which is disposed in the watch case 1, it is possible to recognize time by the dial 4 for timepiece even in a dark place. Further, various decoration effects can be obtained by the dial 4 for timepiece.

Second Embodiment

Figure 5:
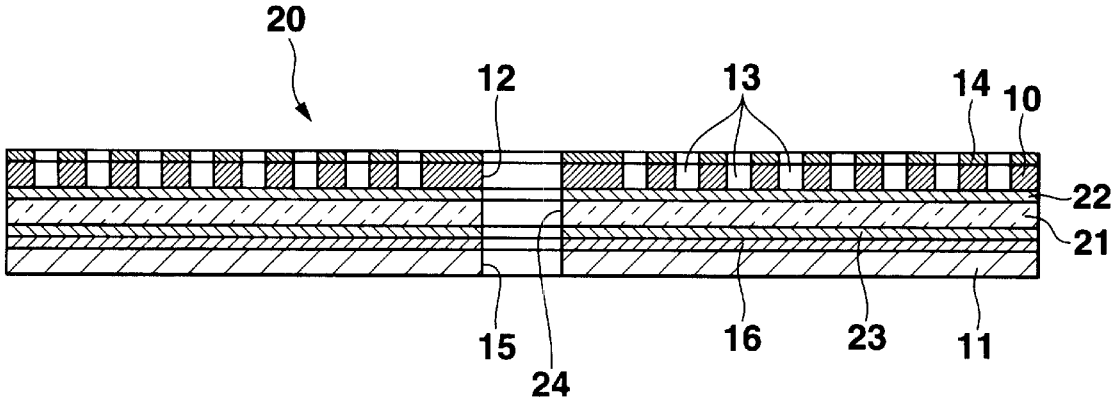
FIG. 5 is an enlarged cross-sectional view showing the second embodiment of the dial for timepiece according to the present invention.
Figure 6:
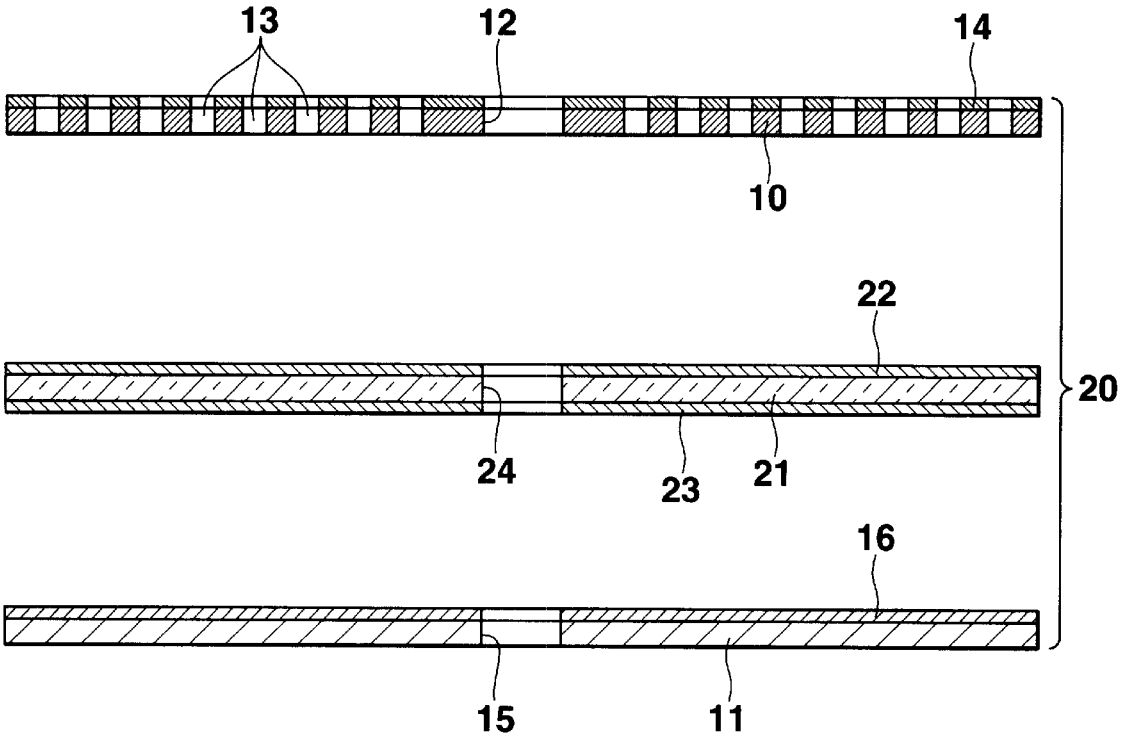
FIG. 6 is an exploded cross-sectional view showing the dial for timepiece of FIG. 5.

Next, with reference to FIGS. 5 and 6, a second embodiment of the dial for timepiece according to the present invention will be explained. The same reference numerals are attached to the same elements as the first embodiment shown in FIGS. 1 to 4 in order to explain the second embodiment.

The dial 20 for timepiece has a three-layer structure in which a light-transmissive member 21 is provided between the decoration member 10 and the luminescent member 11. The other structures of the dial 20 for timepiece are approximately the same as those of the first embodiment.

That is, the light-transmissive member 21 is made of transparent material. On the upper surface thereof, a third surface processed layer 22 which is a decoration layer formed by application, printing, deposition or the like, is provided. On the lower surface of the light-transmissive member 21, a fourth surface processed layer 23 which is a decoration layer formed by application, printing, deposition or the like, is provided. The third and fourth surface processed layers 22 and 23 are decoration layers having light-transmissive property. Although colors of the third and fourth surface processed layers 22 and 23 maybe dissimilar to that of the first surface processed layer 14 of the decoration member 10 and that of the second surface processed layer 16 of the luminescent member 11, it is preferable that the colors of the third and the fourth surface processed layers 22 and 23 is similar to that of the first and the second surface processed layers 14 and 16. On a central portion of the light-transmissive member 21, a hand shaft hole 24 is provided so as to correspond to the hand shaft hole 12 of the decoration member 10 and the hand shaft hole 15 of the luminescent member 11.

In such a dial 20 for timepiece, when the luminescent member 11 which is disposed on the lowest layer emits light, the light emitted from the luminescent member 11 is transmitted through the second surface processed layer 16 provided on the upper surface of the luminescent member 11 and the fourth surface processed layer 23 provided on the lower surface of the light-transmissive member 21, to be incident to the light-transmissive member 21. The incident light is transmitted through the third surface processed layer 22 provided on the upper surface of the light-transmissive member 21. The transmitted light passes through the through holes 13 of the decoration member 10. The light partially illuminates the upper surface side of the decoration member 10 in accordance with the through holes 13. Thereby, it is possible to recognize time even in a dark place like the first embodiment.

In the dial 20 for timepiece, a three-dimensional decoration effect can be obtained by the decoration effect caused by the first surface processed layer 14 of the decoration member 10, and by the decoration effect caused by the third and fourth surface processed layers 22 and 23 of the light-transmissive member 21 in accordance with to the through holes 13 of the decoration member 10, and the second surface processed layer 16 of the luminescent member 11. As a result, the number of variations of decorative style can increase more than the first embodiment. Therefore, more various decoration effects can be obtained. In this case, when the colors of the third and fourth surface processed layers 22 and 23 of the light-transmissive member 21 and that of the first surface processed layer 14 of the decoration member 10 are similar to that of the second surface processed layer 16 of the luminescent member 11, the through holes 13 of the decoration member 10 can be blind during the non-emission of the luminescent member 11 like the first embodiment.

In the second embodiment, the dial for timepiece has a structure in which the third surface processed layer 22 is provided on the upper surface of the light-transmissive member 21, the fourth surface processed layer 23 is provided on the lower surface of the light-transmissive member 21 and the second surface processed layer 16 is provided on the upper surface of the luminescent member 11. The present invention is not limited to this. The dial for timepiece may have a structure in which a surface processed layer which is a decoration layer formed by application, printing, deposition or the like, and having light-transmissive property, is provided on at least only one surface of the upper and the lower surfaces of the light-transmissive member 21 and the upper surface of the luminescent member 11. In such a structure, approximately the same function and effect as the second-embodiment can be also obtained.

Third Embodiment

Figure 7:
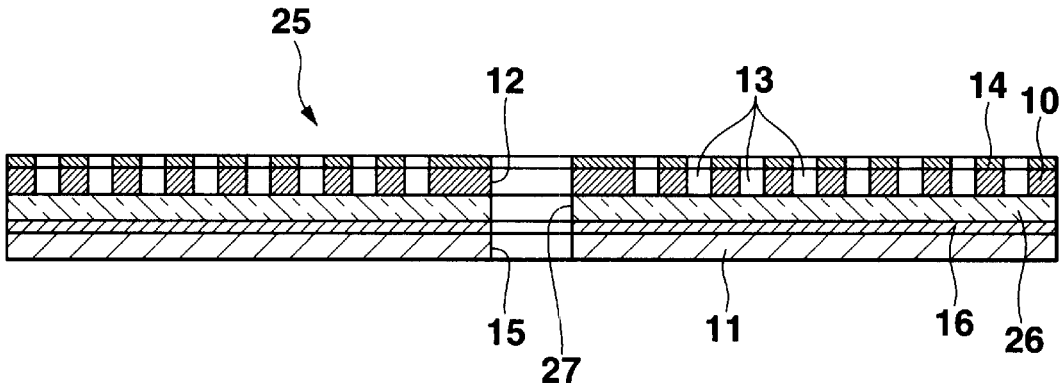
FIG. 7 is an enlarged cross-sectional view showing the third embodiment of the dial for timepiece according to the present invention.
Figure 8:
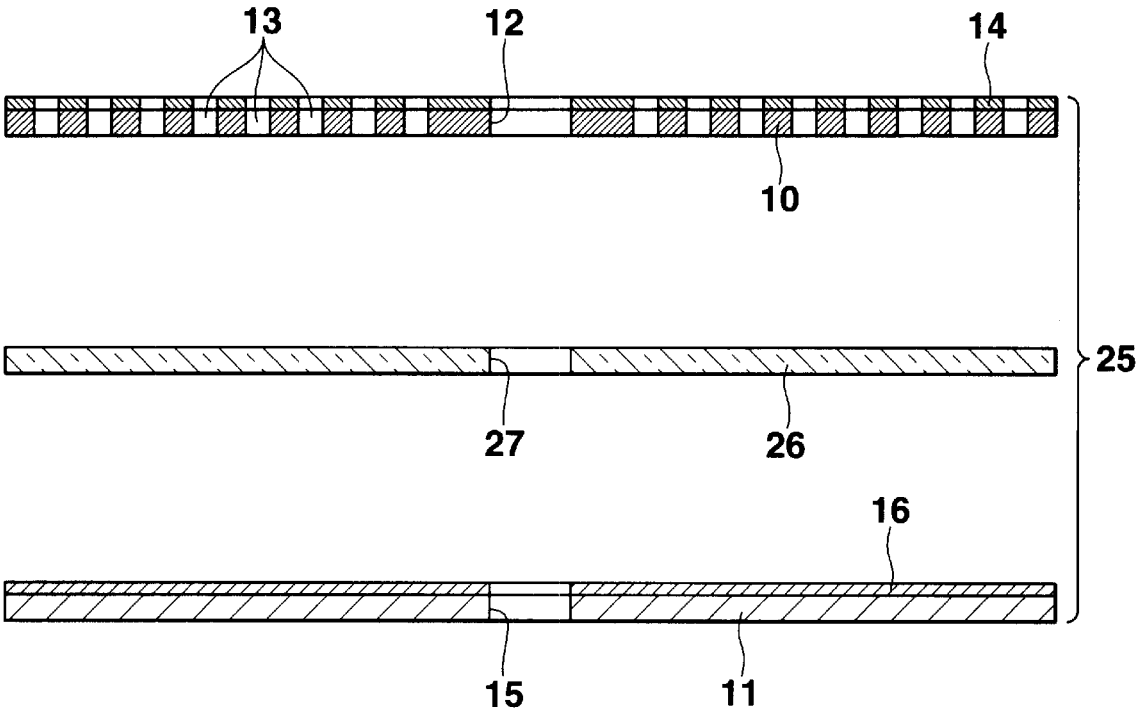
FIG. 8 is an exploded cross-sectional view showing the dial for timepiece of FIG. 7.

Next, with reference to FIGS. 7 and 8, a third embodiment of the dial for timepiece according to the present invention will be explained. The same reference numerals are attached to the same elements as the second embodiment shown in FIGS. 5 and 6 in order to explain the third embodiment.

The dial 25 for timepiece has a three-layer structure in which a color light-transmissive member 26 is provided between the luminescent member 11 and the decoration member 10 without disposing the second surface processed layer 16 on the upper surface of the luminescent member 11. The other structures of the dial 25 for timepiece are approximately the same as those of the second embodiment.

That is, the light-transmissive member 26 is a plate made of color transparent material. On the upper and the lower surfaces thereof, the surface processed layer is not provided. In this case, although the color of the transparent material of the light-transmissive member 26 may be dissimilar to that of the first surface processed layer 14 provided on the upper surface of the decoration member 10, it is preferable that the color of the light-transmissive member 26 is similar to that of the first surface processed layers 14. On a central portion of the light-transmissive member 26, a hand shaft hole 27 is provided so as to correspond to the hand shaft hole 12 of the decoration member 10 and the hand shaft hole 15 of the luminescent member 11.

In such a dial 25 for timepiece, when the luminescent member 11 which is disposed on the lowest layer emits light, the light emitted from the luminescent member 11 is incident to the color light-transmissive member 26. The light having a predetermined color (that is, a light having a predetermined wavelength) is transmitted through the color light-transmissive member 26. The transmitted light illuminates the upper surface side of the decoration member 10 in accordance with the through holes 13 of the decoration member 10. Thereby, it is possible to recognize time even in a dark place like the first embodiment. Because the decoration effect obtained by the first surface processed layer 14 of the decoration member 10 and the decoration effect obtained by the color light-transmissive member 26 can be obtained, the number of variations of decorative style can increase like the first embodiment. Therefore, various decoration effects can be obtained. In this case, because a surface processed layer is not provided on either the upper surface or the lower surface of the color light-transmissive member 26 and it is not necessary that a surface processed layer is not provided on the upper surface of the luminescent member 11, the whole dial 25 for timepiece can be thin. When the color of the color light-transmissive member 26 is similar to that of the first surface processed layer 14 of the decoration member 10, the through holes 13 of the decoration member 10 can be blind during the non-emission of the luminescent member 11 like the first and the second embodiments.

Although the first surface processed layer 14 is provided on the upper surface of the decoration member 10 in the first to the third embodiments, it is not necessary that the second surface processed layer 16 is provided. If the color light-transmissive member 26 is used, the dial for timepiece may have a structure in which a surface processed layer is not provided at all.

Fourth Embodiment

Figure 9:
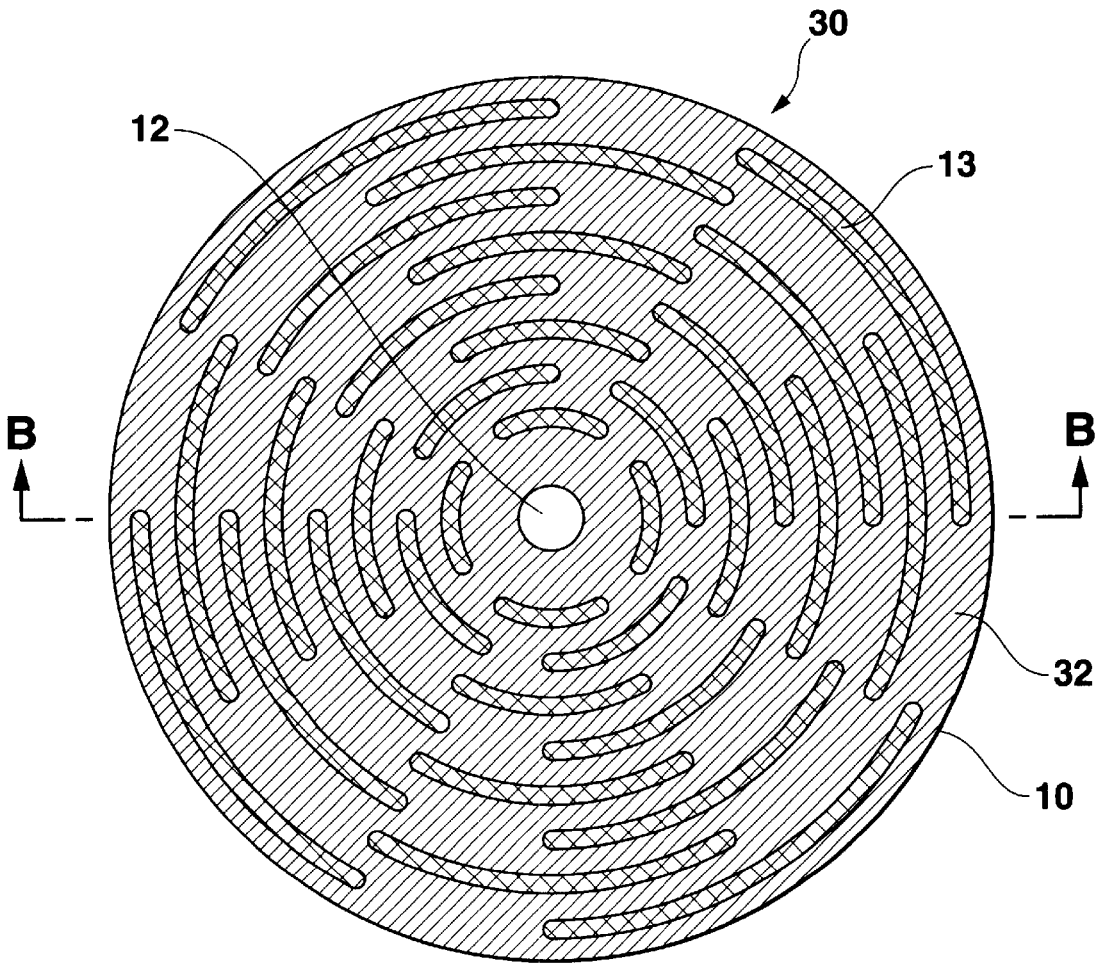
FIG. 9 is a plan view showing an emission state of a luminescent member in the fourth embodiment of the dial for timepiece according to the present invention.
Figure 10:
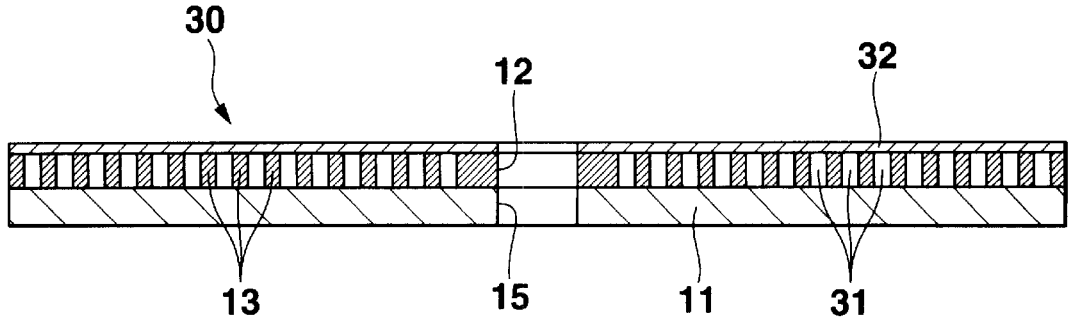
FIG. 10 is an enlarged cross-sectional view taken on line B—B of FIG. 9.

Next, with reference to FIGS. 9 and 10, a fourth embodiment of the dial for timepiece according to the present invention will be explained. The same reference numerals are attached to the same elements as the first embodiment shown in FIGS. 1 to 4 in order to explain the fourth embodiment.

The dial 30 for timepiece has a two-layer structure in which a light-transmissive members 31 are provided in the through holes 13 of the decoration member 10. The other structures of the dial 30 for timepiece are approximately the same as those of the first embodiment.

That is, the decoration member 10 is a circular plate made of metal or synthetic resin like the first embodiment. On the decoration member 10, a plurality of through holes 13 for a plurality of decorations are formed along a plurality of concentric circles of which a center is the hand shaft hole 12. The through holes 13 are formed in slits which become longer in proportion as the slits are apart from the central portion toward the outer peripheral portion. In the through holes 13 for decorations, the light-transmissive member 31 are provided so that the upper surface thereof and that of the decoration member 10 are on the same plane and the lower surface thereof and that of the decoration member 10 are on the same plane. On the upper surface of the decoration member 10 and that of the light-transmissive member 31, a first surface processed layer 32 which is a decoration layer formed by application, printing, deposition or the like, and having light-transmissive property, is provided. On the upper surface of the luminescent member 11 disposed under the decoration member 10, a surface processed layer is not provided.

In such a dial 30 for timepiece, when the luminescent member 11 emits light, the light emitted from the luminescent member 11 is transmitted through the light-transmissive member 31 provided in the through holes 13 of the decoration member 10 and the first surface processed layer 32 provided on the upper surface of the light-transmissive member 31. The transmitted light brightly illuminates the upper surface side of the decoration member 10 in accordance with the through holes 13 as shown in FIG. 9. Thereby, it is possible to recognize time even in a dark place.

In the dial 30 for timepiece, by the first surface processed layer 32 provided on the upper surface of the decoration member 10 and on the upper surface of the light-transmissive member 31, the through holes 13 of the decoration member 10 can be hidden during the non-emission of the luminescent member 11, and the light emitted from the luminescent member 11 is transmitted through the first surface processed layer 32 during the emission of the luminescent member 11. As a result, the decoration effect shown during the emission of the luminescent member 11 and the decoration effect shown during the non-emission thereof, which are different from each other can be obtained. Thereby, the number of variations of decorative style can increase. Further, various decoration effects can be obtained.

Although the surface processed layer is not provided on the upper surface of the luminescent member 11 in the fourth embodiment, the present invention is not limited to this. A surface processed layer which is a decoration layer formed by application, printing, deposition or the like, and having light-transmissive property, may be provided on the upper surface of the luminescent member 11. In this case, it is preferable that the color of the above surface processed layer is similar to that of the first surface processed layer 32. In such a structure, the same function and effect as the fourth embodiment can be obtained.

Fifth Embodiment

Next, with reference to FIGS. 11 to 15, a fifth embodiment of the dial for timepiece according to the present invention will be explained. The same reference numerals are attached to the same elements as the first embodiment shown in FIGS. 1 to 4 in order to explain the fifth embodiment.

The dial 35 for timepiece has a three-layer structure in which a large number of through holes 36 are formed in the decoration member 10 and a light-transmissive member 37 is provided between the decoration member 10 and the luminescent member 11. The other structures of the dial 35 for timepiece are approximately the same as those of the first embodiment.

Figure 11:
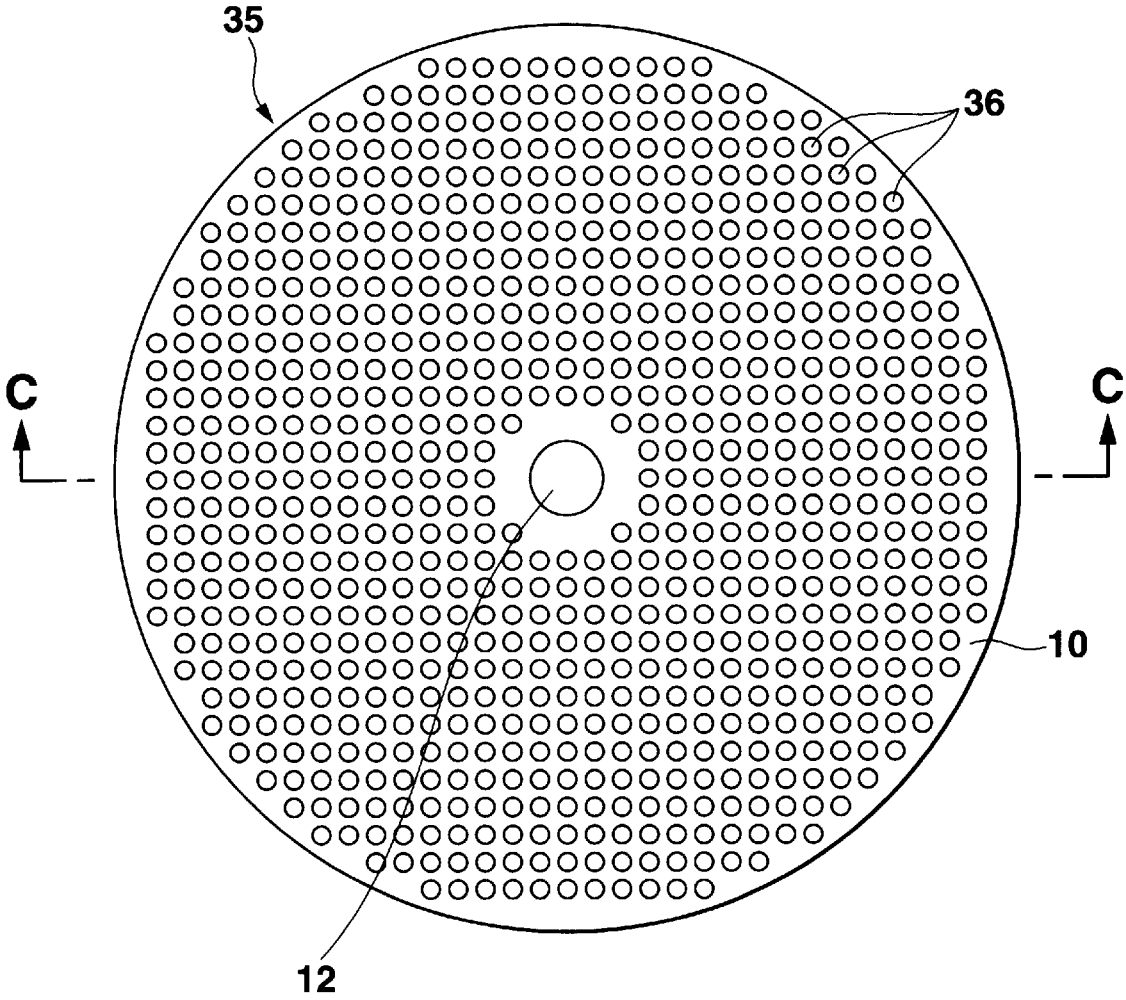
FIG. 11 is a plan view showing a non-emission state of a luminescent member in the fifth embodiment of the dial for timepiece according to the present invention.
Figure 12:
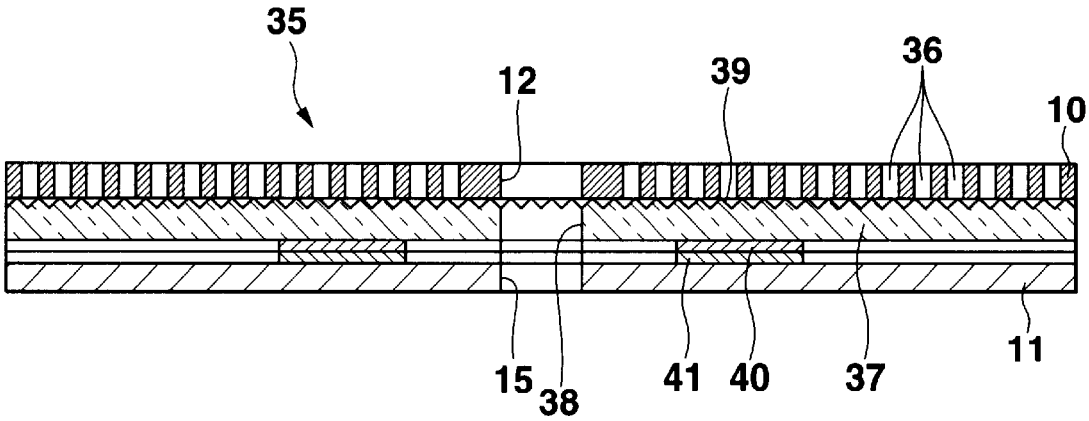
FIG. 12 is an enlarged cross-sectional view taken on line C—C of FIG. 11.
Figure 13:
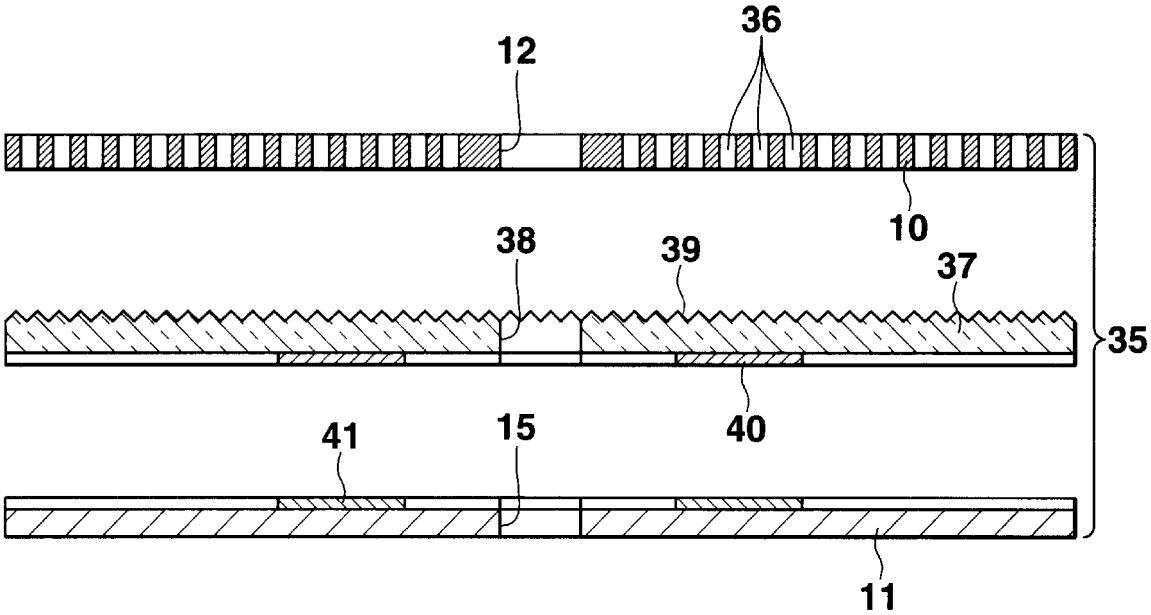
FIG. 13 is an exploded cross-sectional view showing the dial for timepiece of FIG. 12.

That is, the decoration member 10 is a circular plate shown in FIG. 11. The hand shaft hole 12 is provided at the central portion thereof. On the portions except the hand shaft hole 12, a large number of through holes 36 having a small diameter are provided so as to be arranged vertically and horizontally. A surface processed layer is not provided on the upper surface of the decoration member 10.

Figure 14:
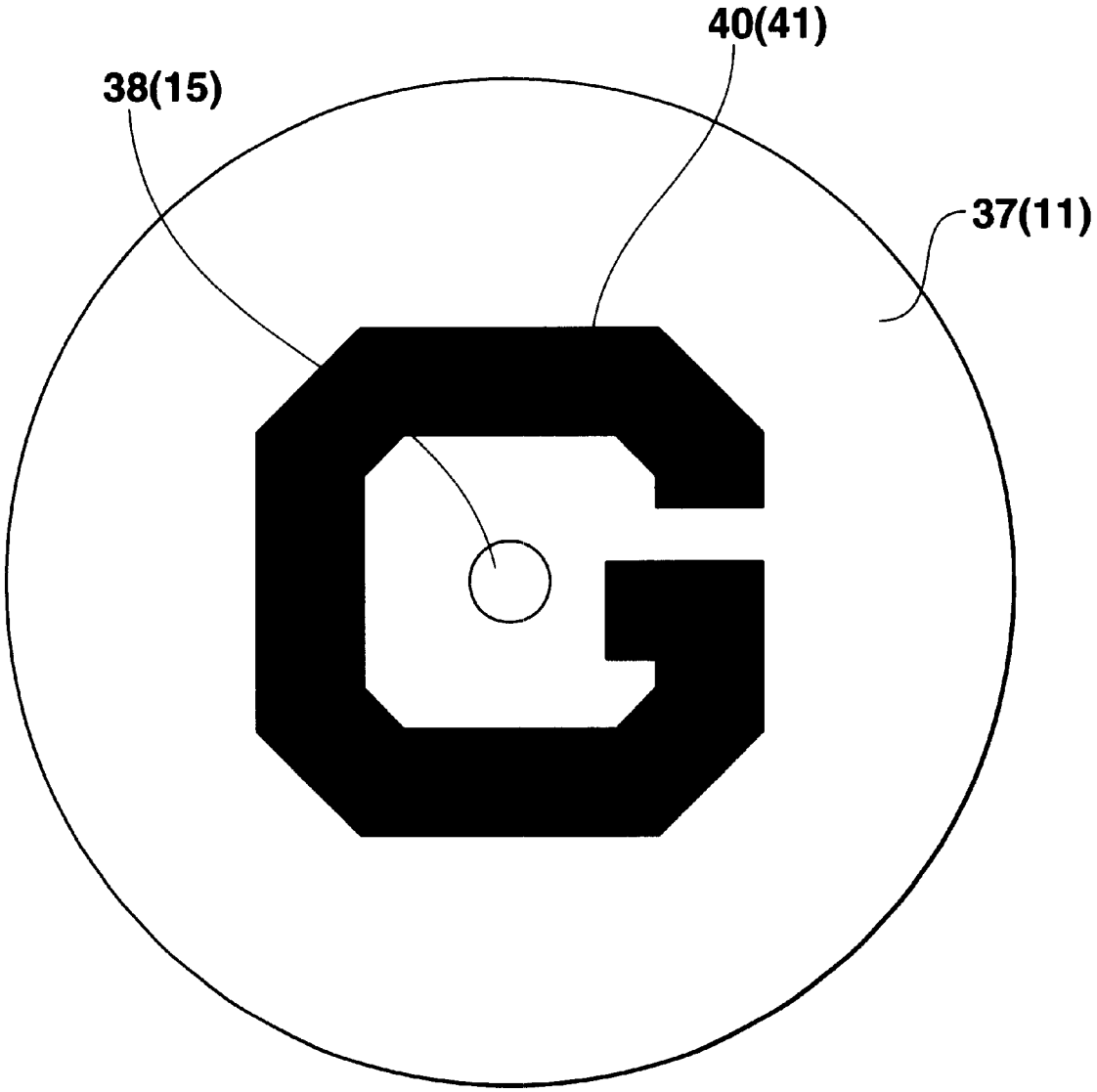
FIG. 14 is a plan view showing a shape of a fourth surface processed layer provided on the lower surface of the light-transmissive member of FIG. 13 and that of a second surface processed layer provided on the upper surface of the luminescent member.

The light-transmissive member 37 is made of transparent material. On the central portion thereof, a hand shaft hole 38 is provided so as to correspond to the hand shaft hole 12 of the decoration member 10 and the hand shaft hole 15 of the luminescent member 11. On the upper surface of the light-transmissive member 37, a third surface processed layer 39 which is an irregular layer made by forming the surface thereof into a finely irregular shape like a surface of a ground glass, is provided. On the lower surface of the light-transmissive member 37, a fourth surface processed layer 40 which is a decoration layer formed by application, printing, deposition or the like, and having light-transmissive property, is provided. The fourth surface processed layer 40 is formed into the shape of a pattern, a figure, a design or the like. For example, as shown in FIG. 14, the fourth surface processed layer 40 is formed into a G-shape.

On the upper surface of the luminescent member 11, a second surface processed layer 41 which is a decoration layer formed by application, printing, deposition or the like, and having light-transmissive property, is provided. The second surface processed layer 41 is formed into the G-shape corresponding to the fourth surface processed layer 40 of the light-transmissive member 37. The color of the second surface processed layer 41 is similar to that of the fourth surface processed layer 40. The color of the second surface processed layer may be dissimilar to that of the decoration member 10 or may be similar to that of the decoration member 10.

In such a dial 35 for timepiece, when the luminescent member 11 which is disposed on the lowest layer emits light, the light emitted from the luminescent member 11 is incident to the light-transmissive member 37 directly or by transmitting the light through the second surface processed layer 41 of the luminescent member 11 and the fourth surface processed layer 40 of the light-transmissive member 37. When the incident light is transmitted through the third surface processed layer 39 which is an irregular layer like a surface of a ground glass, which is provided on the upper surface of the light-transmissive member 37, the light is diffused by the third surface processed layer 39. The diffused light is further diffused from the through holes 36 of the decoration member 10 to the outside of the dial 35 for timepiece. The diffused light brightly illuminates the upper surface side of the decoration member 10 around the outer peripheral side of the through holes 36. Thereby, it is possible to recognize time even in a dark place.

Figure 15:
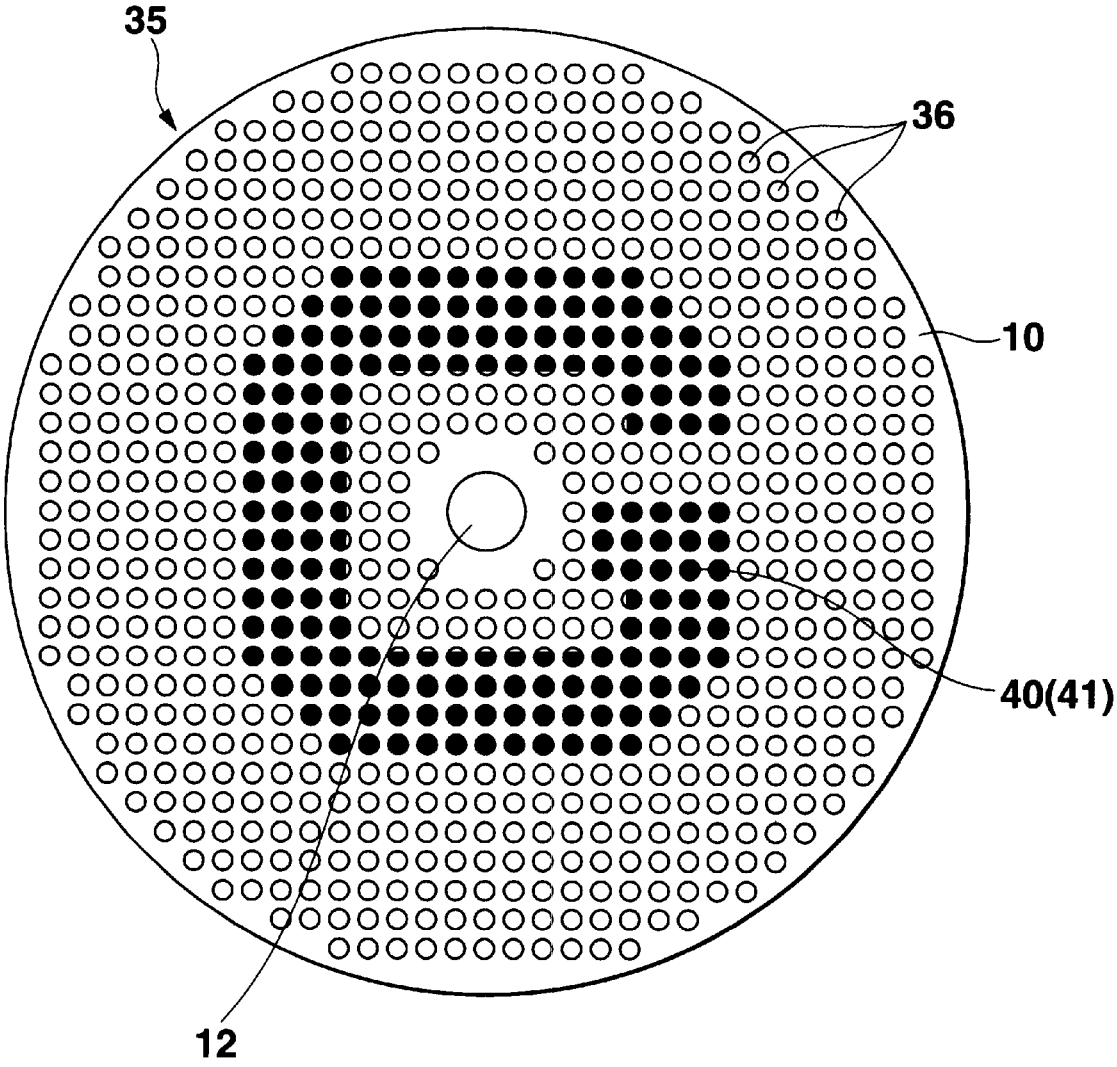

In this case, during the non-emission of the luminescent member 11, as shown in FIG. 11, it is possible that the G-shape of the fourth surface processed layer 40 of the light-transmissive member 37 and that of the second surface processed layer 41 of the luminescent member 11 do not appear by the third surface processed layer 39 which is an irregular layer like a surface of a ground glass, which is provided on the upper surface of the light-transmissive member 37. During the emission of the luminescent member 11, because the light emitted from the luminescent member 11 is transmitted through the second surface processed layer 41 and the fourth surface processed layer 40 of the light-transmissive member 37, as shown in FIG. 15, it is possible that the G-shape appears with dots made of the through holes 36 in a state that the G-shaped portion is slightly darker than the peripheral portion thereof. As a result, the decoration effect shown during the emission of the luminescent member 11 and the decoration effect shown during the non-emission thereof, which are different from each other can be obtained. Thereby, the number of variations of decorative style can increase. Further, various decoration effects can be obtained.

Although the dial 35 for timepiece has a structure in which the third surface processed layer 39 which is an irregular layer like a surface of a ground glass, is provided on the upper surface of the light-transmissive member 37 and the fourth surface processed layer 40 which is a decoration member having light-transmissive property, is provided on the lower surface of the light-transmissive member 37 in the fifth embodiment, the present invention is not limited to this. The dial for timepiece may have a structure in which the fourth surface processed layer which is an irregular layer like a surface of a ground glass, is provided on the lower surface of the light-transmissive member 37 and the third surface processed layer 39 is not provided on the upper surface of the light-transmissive member 37. In such a structure, the same function and effect as the fifth embodiment can be obtained by the fourth surface processed layer which is an irregular layer like a surface of a ground glass and which is provided on the lower surface of the light-transmissive member 37 and by the second surface processed layer 41 having light-transmissive property, which is provided on the upper surface of the luminescent member 11.

Sixth Embodiment

Next, with reference to FIGS. 16 to 20, a sixth embodiment of the dial for timepiece according to the present invention will be explained. The same reference numerals are attached to the same elements as the fifth embodiment shown in FIGS. 11 to 15 in order to explain the sixth embodiment.

The dial 45 for timepiece has a structure in which a fourth surface processed layer 46 which is a decoration layer having no light-transmissive property, is provided on the lower surface of the light-transmissive member 37 and a second surface processed layer 47 which is a decoration layer having no light-transmissive property, is provided on the upper surface of the luminescent member 11. The other structures of the dial 45 for timepiece are approximately the same as those of the fifth embodiment.

Figure 19:
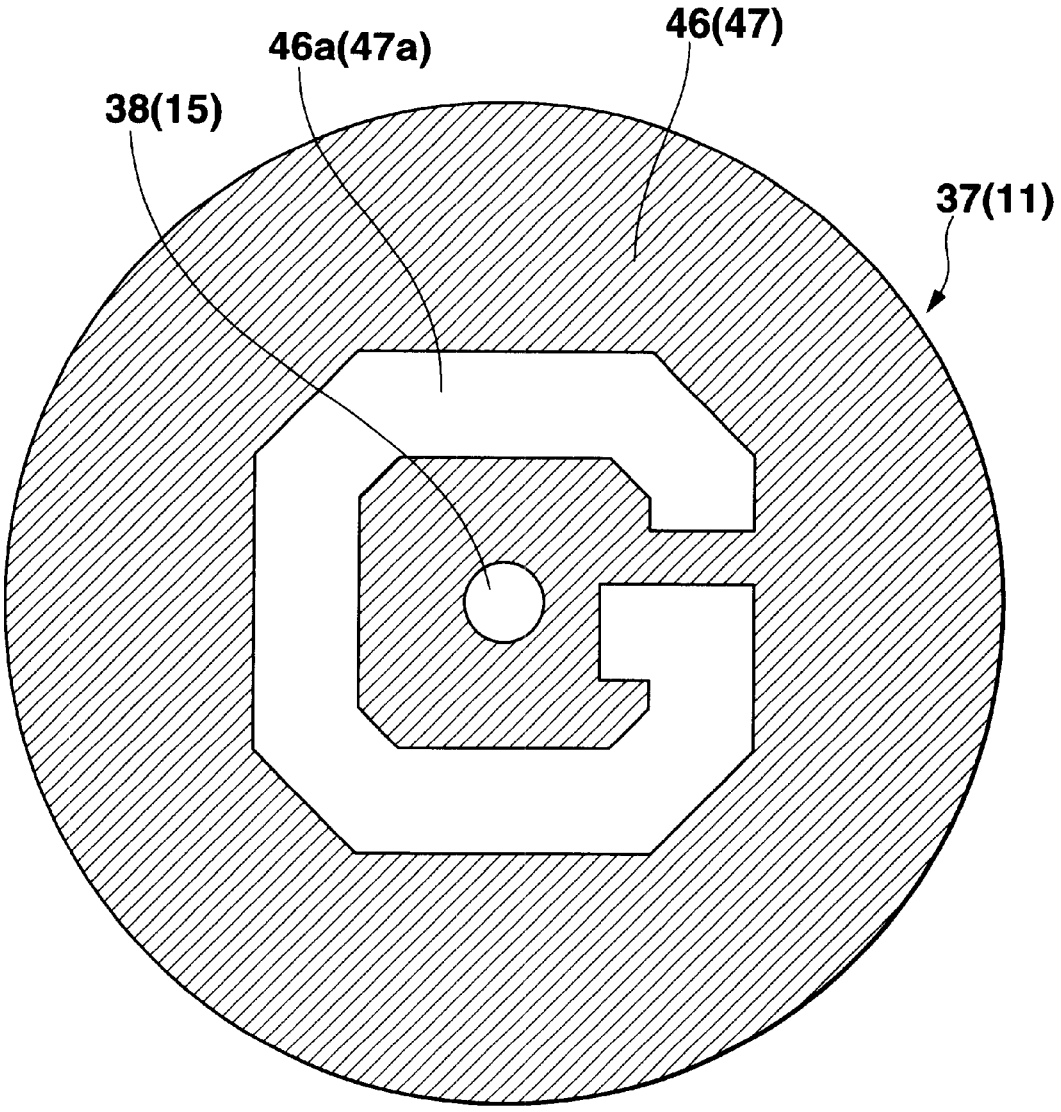
FIG. 19 is a plan view showing a shape of a fourth surface processed layer provided on the lower surface of the light-transmissive member of FIG. 17 and that of a second surface processed layer provided on the upper surface of the luminescent member.

That is, on the upper surface of the light-transmissive member 37, the third surface processed layer 39 which is an irregular layer made by forming the surface thereof into a finely irregular shape like a surface of a ground glass, is provided. On the lower surface of the light-transmissive member 37, a fourth surface processed layer 46 which is a decoration layer formed by application, printing, deposition or the like, which has no light-transmissive property is provided. The fourth surface processed layer 46 is formed into the shape of a pattern, a figure, a design or the like. For example, as shown in FIG. 19, the fourth surface processed layer 46 is formed on a portion except a G-shaped portion. Thereby, the G-shaped portion is formed on a blank portion 46*a*. On the upper surface of the luminescent member 11, the second surface processed layer 47 which is a decoration layer formed by application, printing, deposition or the like, which has no light-transmissive property, is provided. The second surface processed layer 47 is formed on a portion except a G-shaped portion, which corresponds to the fourth surface processed layer 46 of the light-transmissive member 37. Thereby, the G-shaped portion is formed on a blank portion 47*a*. On the decoration member 10, as shown in FIG. 16, the through holes 36 having a small diameter are provided in a slightly wider region than a portion corresponding to the G-shaped portion of the fourth surface processed layer 46 of the light-transmissive member 37 so as to be arranged vertically and horizontally.

In such a dial 45 for timepiece, when the luminescent member 11 which is disposed on the lowest layer emits light, the light emitted from the emitting light 11 is incident to the light-transmissive member 37 by transmitting the light through the blank portion 47*a* of the second surface processed layer 47 of the upper surface of the luminescent member 11 and the blank portion 46*a* of the fourth surface processed layer 46 of the lower surface of the light-transmissive member 37. When the incident light is transmitted through the third surface processed layer 39 which is an irregular layer like a surface of a ground glass, which is provided on the upper surface of the light-transmissive member 37, the light is diffused by the third surface processed layer 39. The diffused light is further diffused from the through holes 36 of the decoration member 10 to the outside of the dial 45 for timepiece. The diffused light brightly illuminates the upper surface side of the decoration member 10 around the outer peripheral side of the through holes 36. Thereby, it is possible to recognize time even in a dark place.

Figure 16:
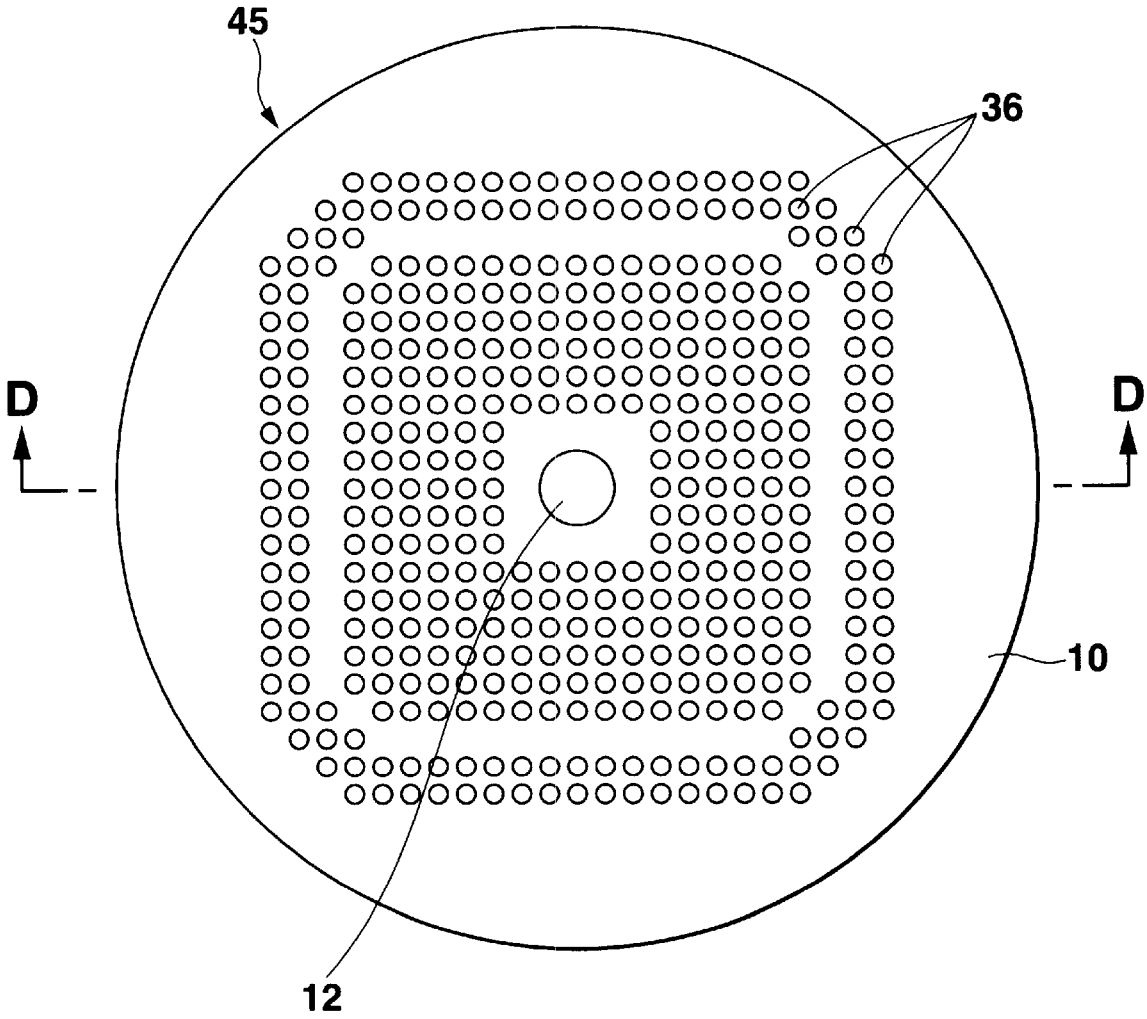
FIG. 16 is a plan view showing a non-emission state of a luminescent member in the sixth embodiment of the dial for timepiece according to the present invention.
Figure 17:
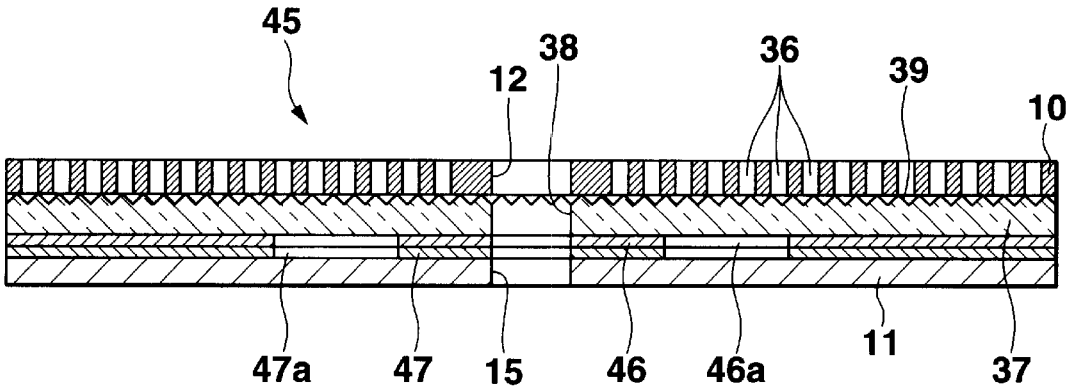
FIG. 17 is an enlarged cross-sectional view taken on line D—D of FIG. 16.
Figure 18:
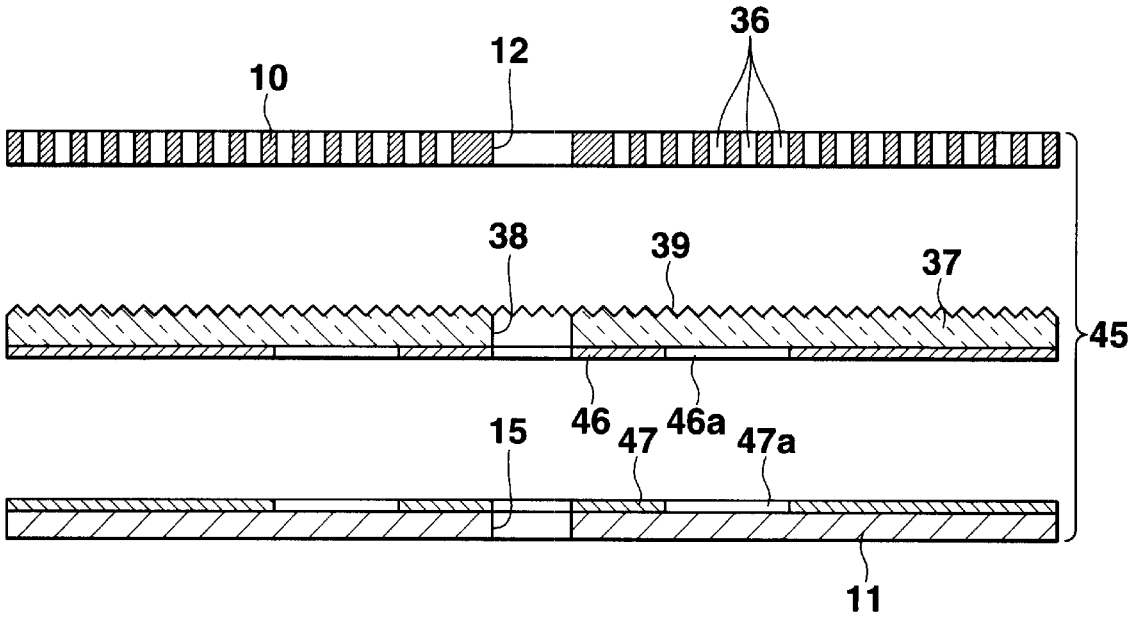
FIG. 18 is an exploded cross-sectional view showing the dial for timepiece of FIG. 17.
Figure 20:
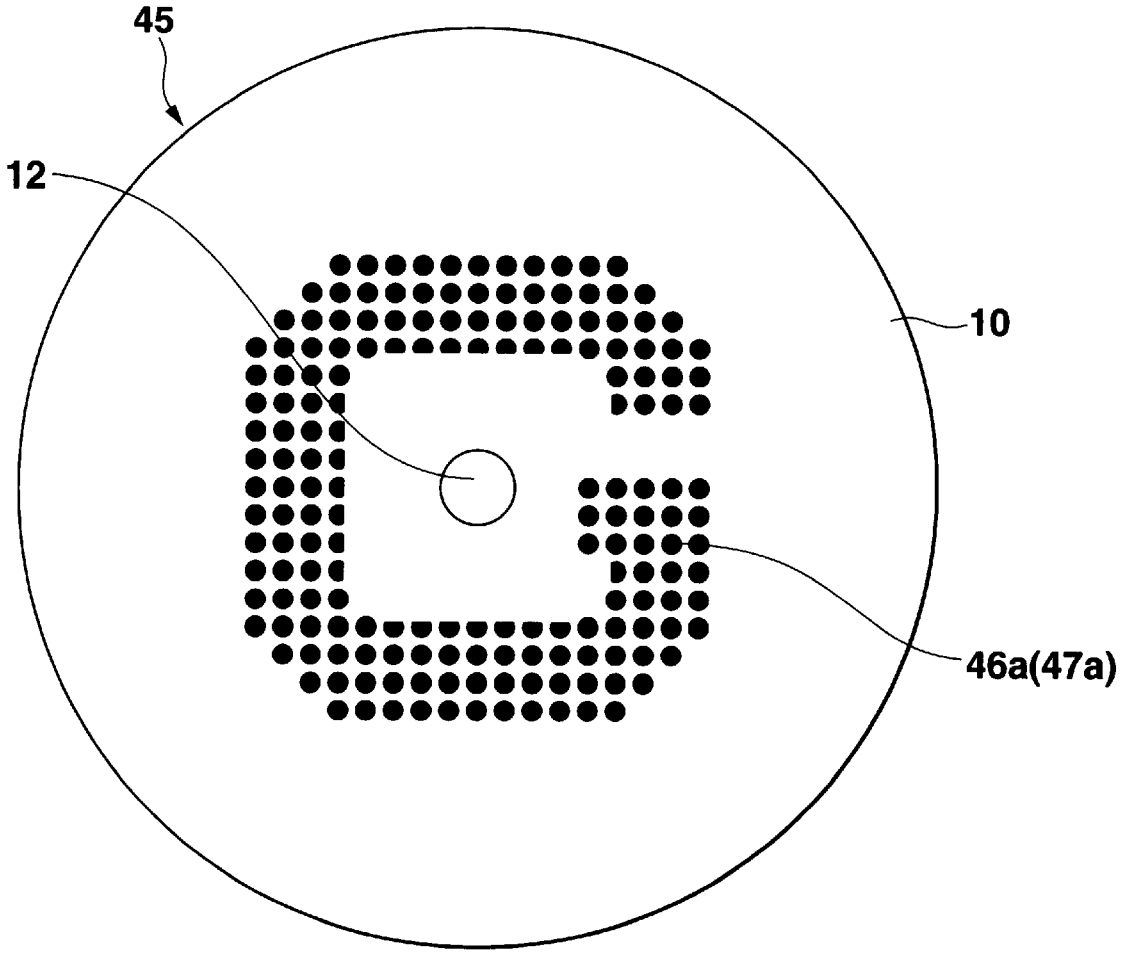

In this case, during the non-emission of the luminescent member 11, as shown in FIG. 16, it is possible that the G-shape of the fourth surface processed layer 46 of the light-transmissive member 37 and that of the second surface processed layer 47 of the luminescent member 11 do not appear by the third surface processed layer 39 which is an irregular layer like a surface of a ground glass, which is provided on the upper surface of the light-transmissive member 37. During the emission of the luminescent member 11, because the light emitted from the luminescent member 11 is transmitted through the blank portion 47*a* of the second surface processed layer 47 of the luminescent member 11 and the blank portion 46*a* of the fourth surface processed layer 46 of the lower surface of the light-transmissive member 37, as shown in FIG. 20, it is possible that the G-shape corresponding to each blank portion 46*a* and 47*a* appears with dots made of the through holes 36 in a state that the G-shaped portion is slightly more blight than the peripheral portion thereof. As a result, the decoration effect shown during the emission of the luminescent member 11 and the decoration effect shown during the non-emission thereof, which are different from each other can be obtained. Thereby, the number of variations of decorative style can increase. Further, various decoration effects can be obtained.

Although the dial 45 for timepiece has a structure in which the third surface processed layer 39 which is an irregular layer like a surface of a ground glass, is provided on the upper surface of the light-transmissive member 37 and the fourth surface processed layer 46 which is a decoration layer having no light-transmissive property, is provided on the lower surface of the light-transmissive member 37 in the sixth embodiment, the present invention is not limited to this. The dial for timepiece may have a structure in which the fourth surface processed layer which is an irregular layer like a surface of a ground glass, is provided on the lower surface of the light-transmissive member 37 and the third surface processed layer 39 is not provided on the upper surface of the light-transmissive member 37. In such a structure, the same function and effect as the sixth embodiment can be obtained by the fourth surface processed layer which is an irregular layer like a surface of a ground glass and which is provided on the lower surface of the light-transmissive member 37 and by the second surface processed layer 47 having no light-transmissive property, which is provided on the upper surface of the luminescent member 11.

Seventh Embodiment

Figure 21:
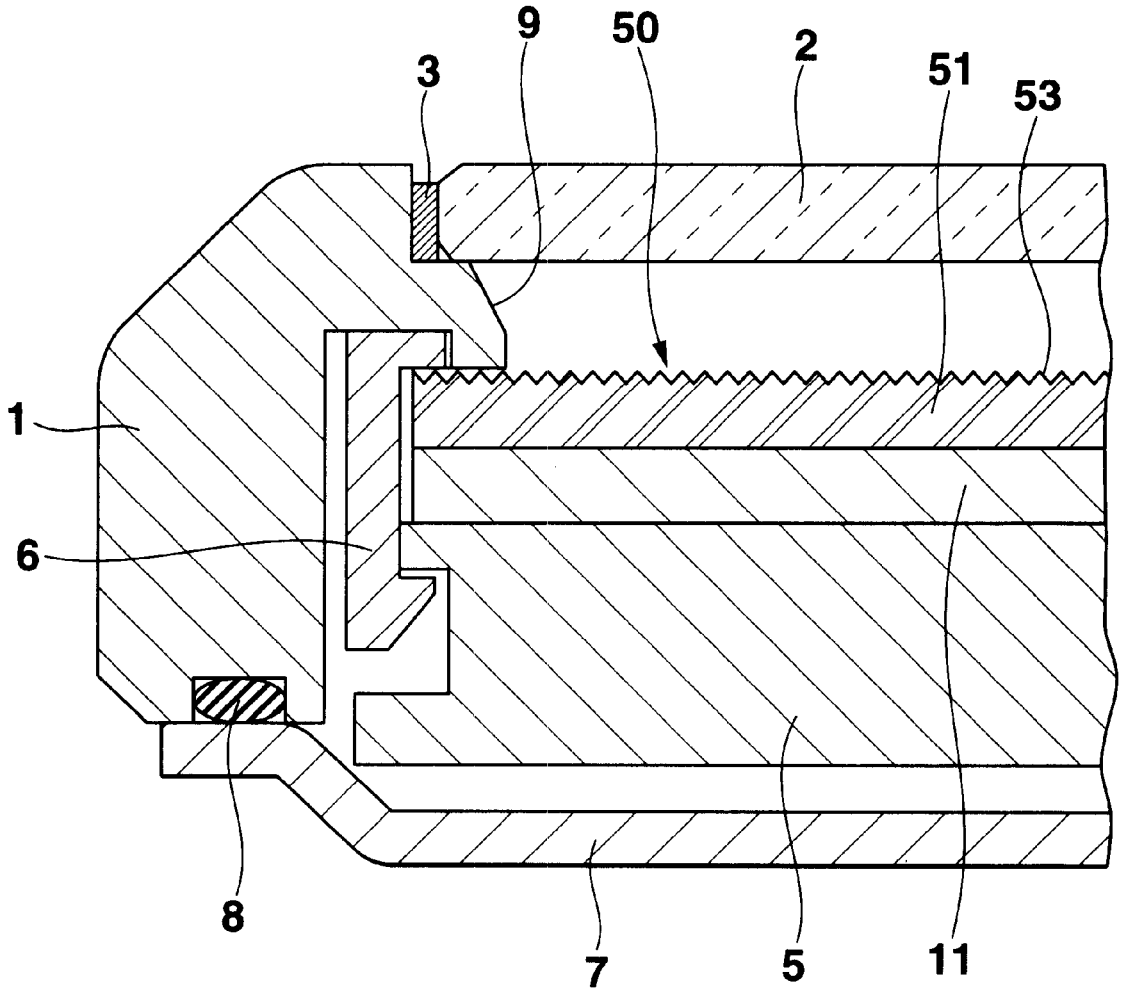
FIG. 21 is an enlarged cross-sectional view showing a principal portion of the seventh embodiment in which a dial for timepiece according to the present invention, is applied to a wrist watch.

Next, with reference to FIGS. 21 to 23, a seventh embodiment in which a dial for timepiece according to the present invention is applied to a wrist watch will be explained. The same reference numerals are attached to the same elements as the first embodiment shown in FIGS. 1 to 4 in order to explain the seventh embodiment.

The wrist watch comprises a wrist watch case 1 like the first embodiment. A watch glass 2 is mounted on an upper portion of the wrist watch case 1 via a packing 3. A dial 50 for timepiece and a watch module 5 are contained in the wrist watch case 1 so as to be attached to an inner frame 6. A rear cover 7 is attached to a lower surface of the wrist watch case 1 via a waterproof ring 8.

The watch module 5 has at least an analog function between an analog function and a digital function. The watch module 5 has a structure so that hands (not shown in the figure) are moved above the dial 50 for timepiece.

Figure 22:
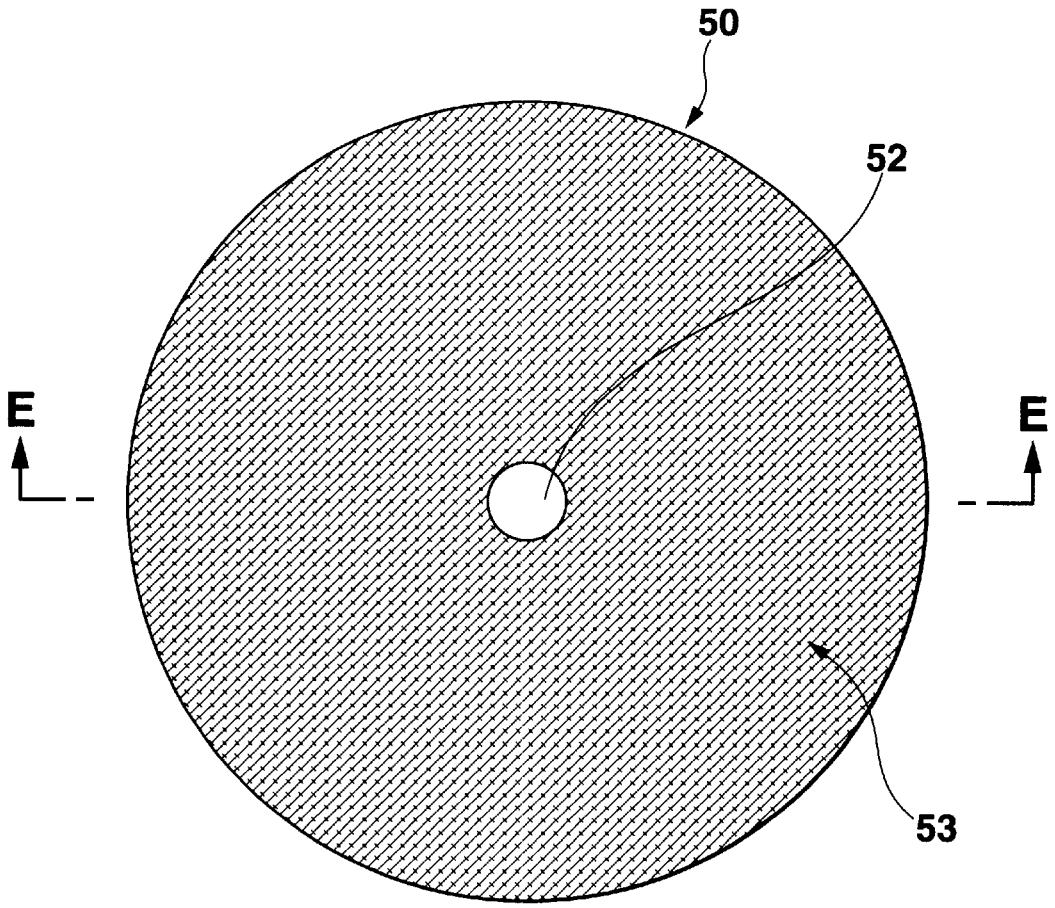
FIG. 22 is a plan view showing the dial for timepiece of FIG. 21.

The dial 50 for timepiece is formed in a circular shape as shown in FIG. 22. As shown in FIG. 23, the dial 50 for timepiece has a two-layer structure having a luminescent member 11 disposed on a lower layer and a light-transmissive member 51 disposed on the upper layer of the luminescent member 11. As shown in FIG. 21, the dial 50 for timepiece is arranged on an upper surface of the watch module 5 positioned under the watch glass 2.

The luminescent member 11 is a plate-like emitting member having an emitting element, such as an EL element, like the first embodiment. The luminescent member 11 is electrically connected with electrodes (not shown in the figure) of the watch module 5. On a central portion of the luminescent member 11, a hand shaft hole 15 for inserting a hand shaft (not shown in the figure) of the watch module 5 is provided as shown in FIG. 23.

Figure 23:
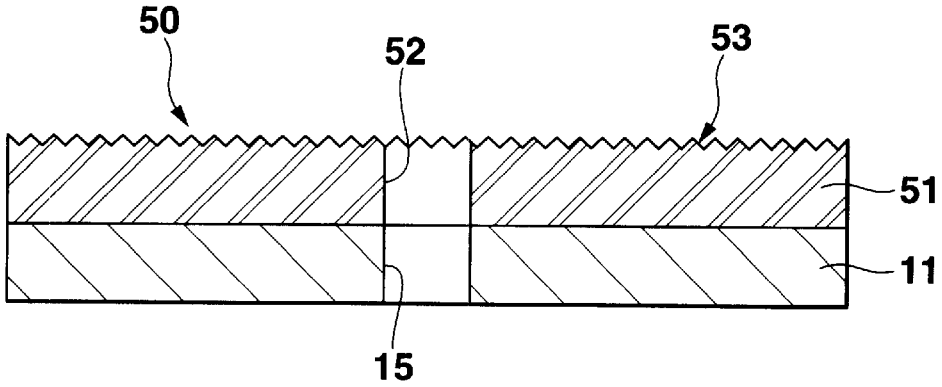
FIG. 23 is an enlarged cross-sectional view taken on line E—E of FIG. 22.

The light-emitting member 51 is a circular plate made of transparent synthetic resin, as shown in FIGS. 22 and 23. On the central portion thereof, a hand shaft hole 52 is provided so as to correspond to the hand shaft hole 15 of the luminescent member 11. On an upper surface of the luminescent member 11, a surface processed layer 53 formed by an electric casting process, and having light-transmissive property, is provided. The electric casting process is one in which a metal product which is the same shape and size as a master is obtained by the electrolysis in the same operation as the electroplating. After the metal is electrodeposited on the master in electric field in a necessary thickness, the deposit is removed from the master. Thereby, the electrodeposit that the shape of the master and the irregularity thereof are precisely inverted can be obtained. In this case, copper, nickel, chrome, and an alloy thereof are used as a metal to be electrodeposited. The surface processed layer 53 formed by the electric casting process is formed into an irregular pattern so as to transmit a light.

In such a dial 50 for timepiece, which is used for a wrist watch, when the luminescent member 11 emits light, the light emitted from the luminescent member 11 is transmitted through the light-transmissive member 51 disposed on the upper surface of the luminescent member 11 and through the surface processed layer 53 of the upper surface of the light-transmissive member 51 and outgoes upwardly. As a result, the light illuminates the upper surface side of the light-transmissive member 51. Thereby, it is possible to recognize time even in a dark place.

Because the surface processed layer 53 formed by the electric casting process is provided on the upper surface of the light-transmissive member 51 in the watch 50 for timepiece, the representation of the irregular pattern of the surface processed layer 53 is varied. When the luminescent member 11 emits light, various diffusing states for the light can be obtained. When the luminescent member 11 does not emit light, various reflecting states for various lights from the outside of the dial 50 for timepiece can be obtained. As a result, the number of variations of decorative style can increase. Therefore, various decoration effects can be obtained.

In this wrist watch, because the dial 50 for timepiece can be seen through the watch glass 2 even though the dial 50 for timepiece is disposed in the watch case 1 and the watch glass 2 is mounted on the upper position of the dial 50 for timepiece, which is disposed in the watch case 1, it is possible to recognize time by the dial 50 for timepiece even in a dark place and to obtain various decoration effects by the dial 50 for timepiece.

Eighth Embodiment

Figure 24:
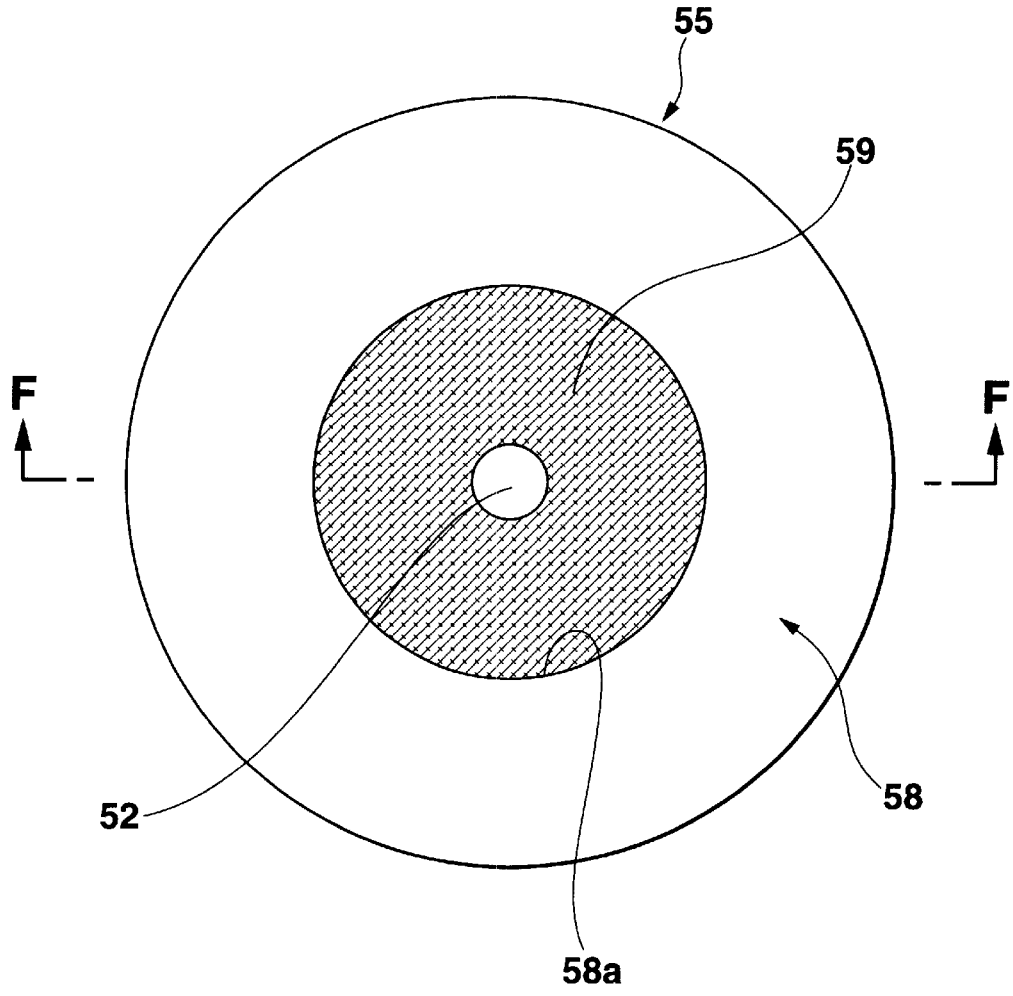
FIG. 24 is a plan view showing the eighth embodiment of the dial for timepiece according to the present invention.
Figure 25:
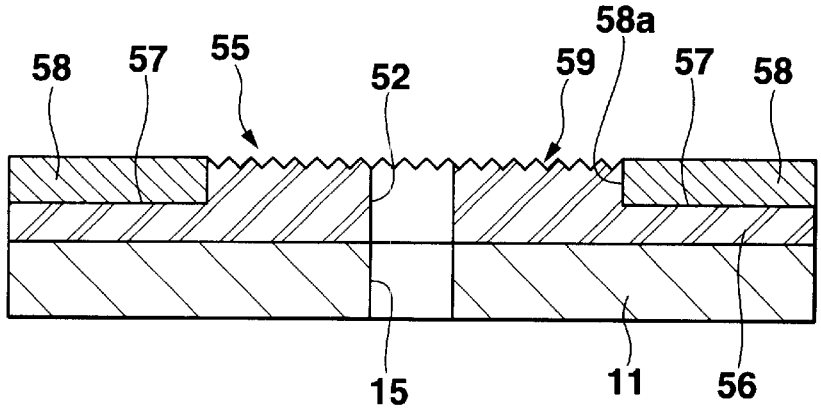
FIG. 25 is an enlarged cross-sectional view taken on line F—F of FIG. 24.

Next, with reference to FIGS. 24 and 25, an eighth embodiment of the dial for timepiece according to the present invention will be explained. The same reference numerals are attached to the same elements as the seventh embodiment shown in FIGS. 21 to 23 in order to explain the eighth embodiment.

The dial 55 for timepiece has a structure in which a concave portion 57 is provided on a light-transmissive member 56 and a metallic member 58 is provided in the concave portion 57. The other structures of the dial 55 for timepiece are approximately the same as those of the seventh embodiment.

That is, the light-transmissive member 56 is formed into a circular plate having a size which is approximately the same as the that of the luminescent member 11. On the central portion thereof, a hand shaft hole 52 is provided like the seventh embodiment. On the peripheral portion of the light-transmissive member 56 except a central part including the hand shaft hole 52, the concave portion 57 is formed into a ring shape. On the upper surface of the central part of the light-transmissive member 56, a surface processed layer 59 having light-transmissive property is formed by the electric casting process like the seventh embodiment. The metallic member 58 is an annular plate having a ring shape, on the central part of which an engaging hole 58*a* is formed. The engaging hole 58*a* is disposed in the concave portion 57 of the peripheral portion of the light-transmissive member 56 so as to engage with the central part of the light-transmissive member 56. In this case, the metallic member 58 and the surface processed layer 59 of the light-transmissive member 56 are formed so that the upper surface of the metallic member 58 and that of the surface processed layer 59 are positioned at approximately the same height.

In such a dial 55 for timepiece, because the surface processed layer 59 of the central part of the light-transmissive member 56 is exposed on the upper side thereof, the light emitted from the luminescent member 11 is transmitted through the surface processed layer 59 of the central part of the light-transmissive member 56 and outgoes upwardly when the luminescent member 11 emits light. As a result, the light brightly illuminates the upper surface side of the central part of the light-transmissive member 56. Because the upper surface side of the metallic member 58 which is disposed on the peripheral side of the central part of the light-transmissive member 56, is also brightened, it is possible to recognize time even in a dark place.

In the dial 55 for timepiece, because the upper surface of the surface processed layer 59 of the central part of the light-transmissive member 56 and the upper surface of the metallic member 58 are exposed on the upper side thereof, the decorative representation is varied by the surface processed layer 59 exposed on the upper side thereof, like the seventh embodiment. Further, because a feeling of metallic gloss is obtained by the metallic member 58, a user can be filled with a feeling of high quality. Because the decoration effects caused by both the upper surface of the surface processed layer 59 of the light-transmissive member 56 and the upper surface of the metallic member 58 can be obtained, the number of variations of decorative style can increase. Therefore, various decoration effects can be obtained.

Figure 26:
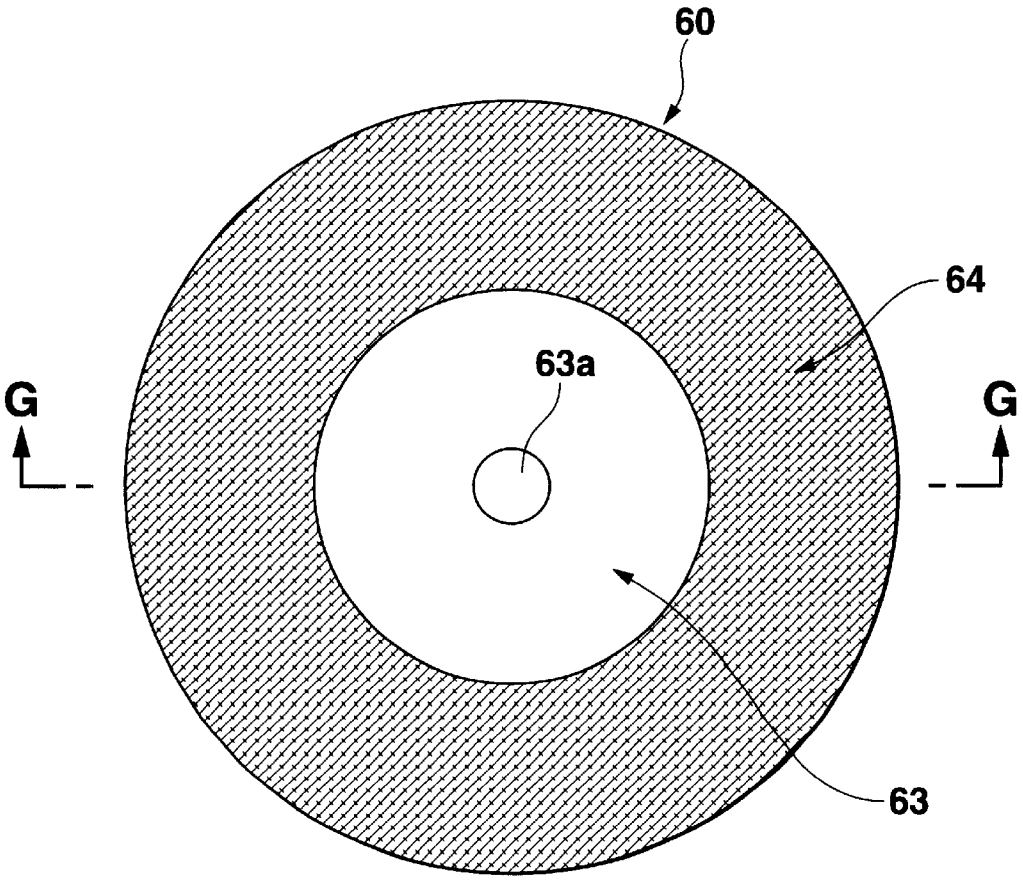
FIG. 26 is a plan view showing a modified example of the dial for timepiece of the eighth embodiment.
Figure 27:
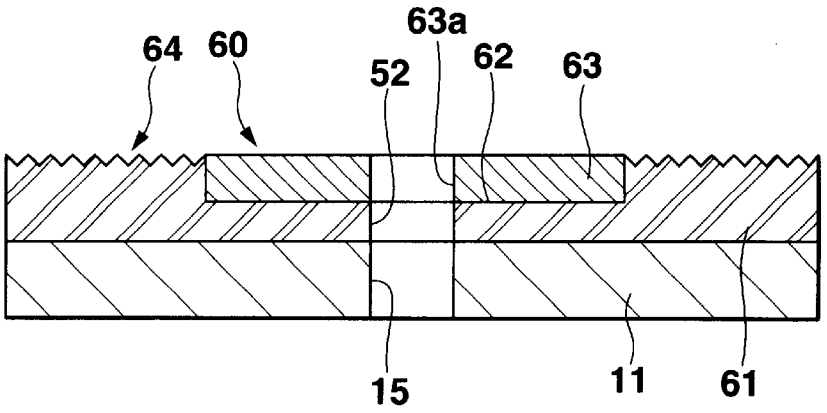
FIG. 27 is an enlarged cross-sectional view taken on line G—G of FIG. 26.

Although the concave portion 57 is formed into a ring shape on the peripheral portion of the light-transmissive member 56 and the metallic member 58 having a ring shape is disposed in the concave portion 57 in the above eighth embodiment, the present invention is not limited to this. For example, the dial for timepiece may have a structure like a modified example shown in FIGS. 26 and 27. A dial 60 for timepiece according to the modified example, has a structure in which a circular concave portion 62 is formed on a central part of a light-transmissive member 61, which includes the hand shaft hole 52 provided on the central portion of the light-transmissive member 61, an annular metallic member 63 is disposed in the concave portion 62, and a surface processed layer 64 having light-transmissive property is formed by the electric casting process on the upper surface of the peripheral portion of the light-transmissive member 61 except the central part of the light-transmissive member 61. In this case, the metallic member 63 and the surface processed layer 64 of the light-transmissive member 61 are also formed so that the upper surface of the metallic member 63 and that of the surface processed layer 64 of the light-transmissive member 61 are positioned at approximately the same height. On the central portion of the metallic member 63, a hand shaft hole 63*a* is formed so as to correspond to the hand shaft hole 52 of the light-transmissive member 61.

In such a dial 60 for timepiece, because the light emitted from the luminescent member 11 is transmitted through the surface processed layer 64 of the peripheral portion of the light-transmissive member 61 and outgoes upwardly, the light brightly illuminates the upper surface side of the peripheral portion of the light-transmissive member 61. Further, the upper surface side of the metallic member 63 which is disposed on the central part of the light-transmissive member 61 is also brightened. Thereby, it is possible to recognize time even in a dark place. Because the decoration effects caused by both the upper surface of the surface processed layer 64 of the peripheral portion of the light-transmissive member 61 and the upper surface of the metallic member 63 can be obtained, the number of variations of decorative style can increase like the eighth embodiment. Therefore, various decoration effects can be obtained.

Ninth Embodiment

Figure 28:
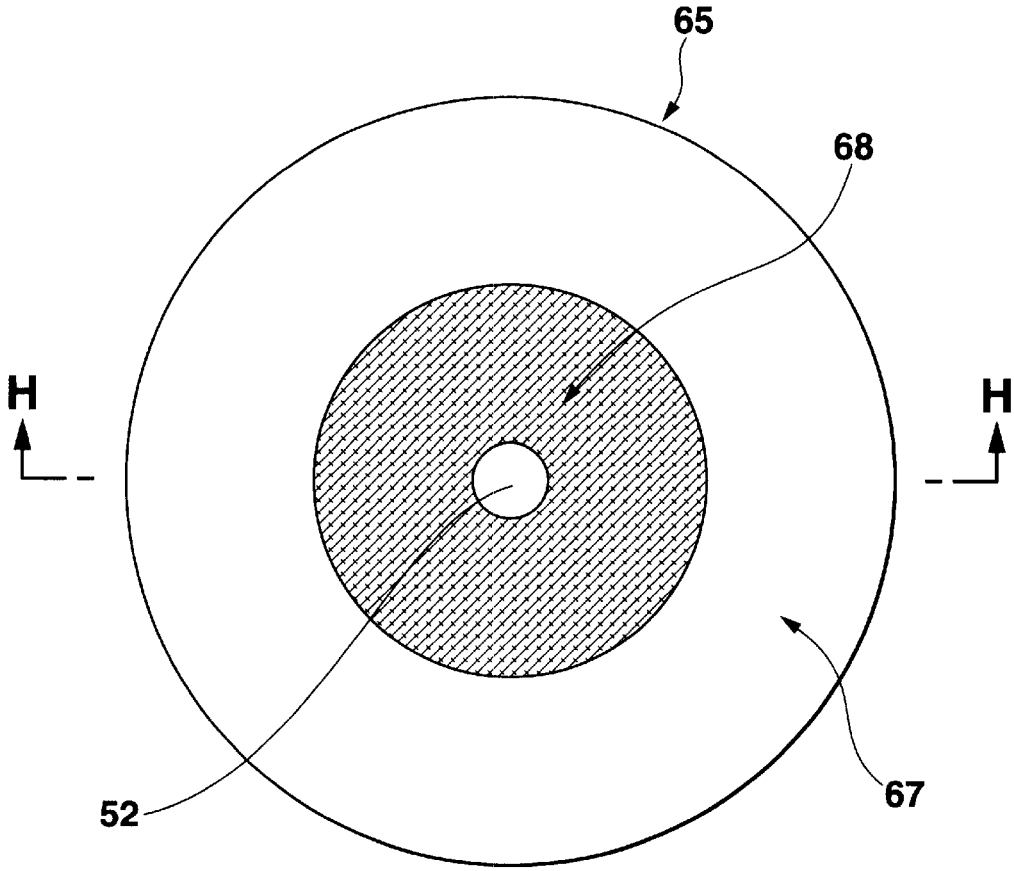
FIG. 28 is a plan view showing the ninth embodiment of the dial for timepiece according to the present invention.
Figure 29:
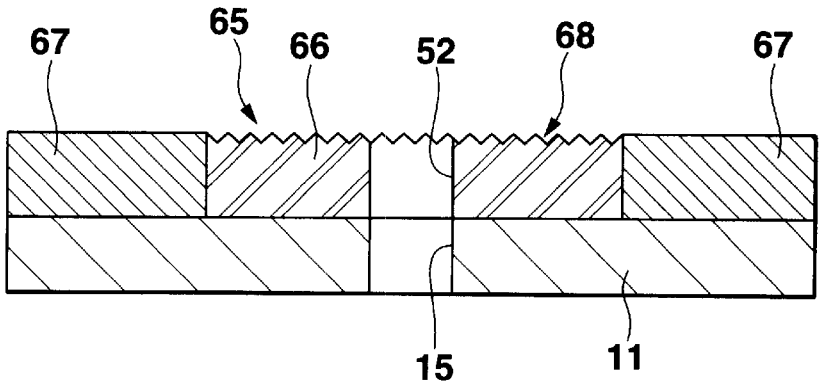
FIG. 29 is an enlarged cross-sectional view taken on line H—H of FIG. 28.

Next, with reference to FIGS. 28 and 29, a ninth embodiment of the dial for timepiece according to the present invention will be explained. The same reference numerals are attached to the same elements as the seventh embodiment shown in FIGS. 21 to 23 in order to explain the ninth embodiment.

The dial 65 for timepiece has a structure in which a light-transmissive member 66 and a metallic member 67 are disposed side by side on an upper surface of the luminescent member 11. The other structures of the dial 65 for timepiece are the same as those of the seventh embodiment.

That is, the light-transmissive member 66 is formed into an annular plate shape corresponding to the central part of the luminescent member 11, which includes the hand shaft hole 15 of the luminescent member 11. On the central portion of the light-transmissive member 66, a hand shaft hole 52 is provided On the upper surface of the light-transmissive member 66 except the hand shaft hole 52, a surface processed layer 68 formed by an electric casting process, and having light-transmissive property, is provided. The metallic member 67 is an annular plate having a ring shape, which is disposed on the peripheral side of the light-transmissive member 66. The metallic member 67 is formed so that the thickness thereof is approximately the same as that of the light-transmissive member 66 and the outer diameter thereof is the same as that of the luminescent member 11. In this case, the metallic member 67 and the surface processed layer 68 of the light-transmissive member 66 are formed so that the upper surface of the metallic member 67 and that of the surface processed layer 68 are positioned at approximately the same height.

In such a dial 65 for timepiece, like the eighth embodiment, because the surface processed layer 68 of the light-transmissive member 66 which is disposed on the central part of the luminescent member 11, is exposed on the upper side thereof, the light emitted from the luminescent member 11 is transmitted through the surface processed layer 68 of the central part of the light-transmissive member 66 and outgoes upwardly when the luminescent member 11 emits light. As a result, the light brightly illuminates the upper surface side of the light-transmissive member 66 disposed on the central part of the luminescent member 11. Because the upper surface side of the metallic member 67 which is disposed on the peripheral side of the light-transmissive member 66 is also brightened, it is possible to recognize time even in a dark place.

In the dial 65 for timepiece, because the upper surface of the surface processed layer 68 of the light-transmissive member 66 and the upper surface of the metallic member 67 are exposed on the upper side thereof, the decorative representation is varied by the surface processed layer 68 exposed on the upper side thereof. Further, because a feeling of metallic gloss is obtained by the metallic member 67 like the eighth embodiment, a user can be filled with a feeling of high quality. Because the decoration effects caused by both the surface processed layer 59 and the metallic member 58 can be obtained, the number of variations of decorative style can increase. Therefore, various decoration effects can be obtained.

Figure 30:
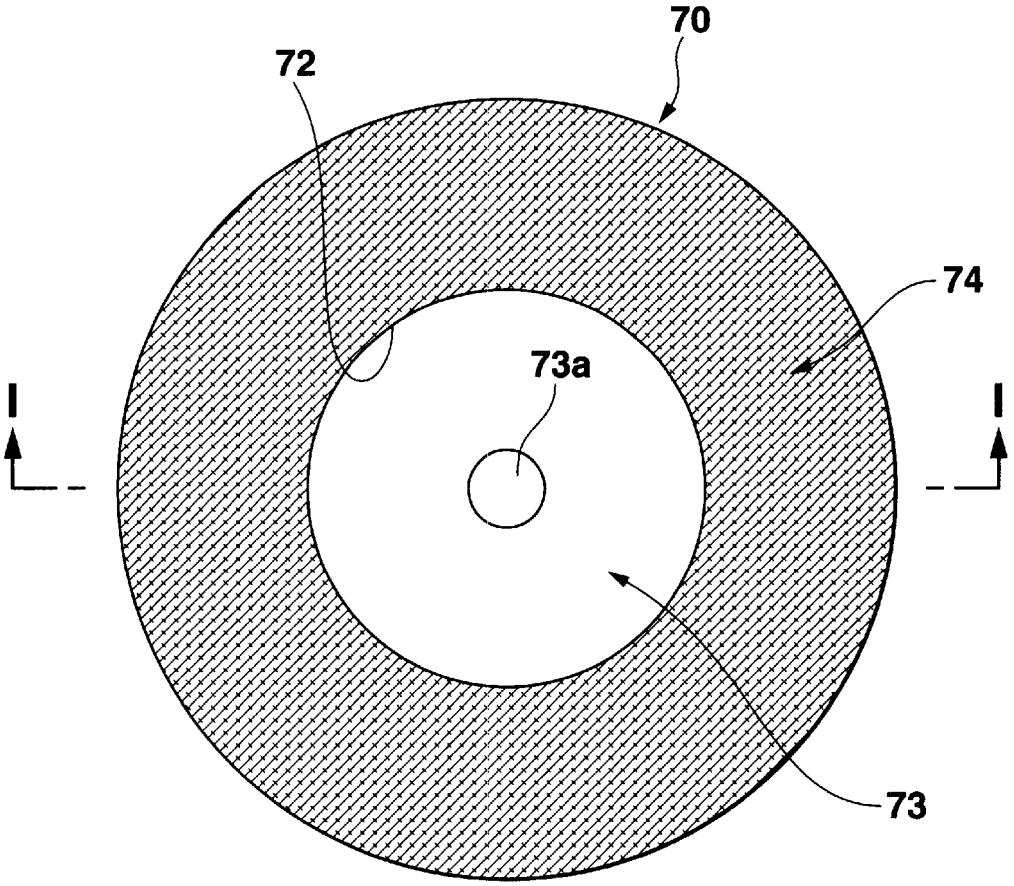
FIG. 30 is a plan view showing a modified example of the dial for timepiece of the ninth embodiment.
Figure 31:
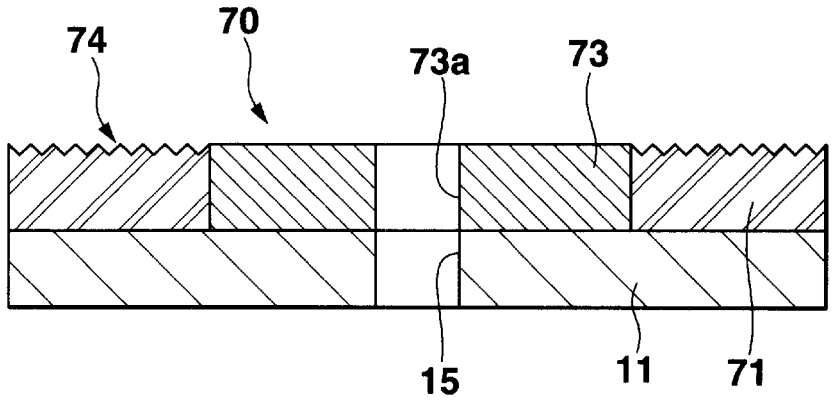
FIG. 31 is an enlarged cross-sectional view taken on line I—I of FIG. 30.

Although the metallic member 67 having a ring shape is disposed on the peripheral side of the light-transmissive member 66 in the above ninth embodiment, the present invention is not limited to this. For example, the dial for timepiece may have a structure like a modified example shown in FIGS. 30 and 31. A dial 70 for timepiece according to the modified example, has a structure in which a circular engaging hole 72 is provided on a central part of a light-transmissive member 71, an annular metallic member 73 is disposed in the engaging hole 72, and a surface processed layer 74 having light-transmissive property is formed by the electric casting process on the upper surface of the light-transmissive member 71. In this case, the metallic member 73 and the surface processed layer 74 of the light-transmissive member 66 are also formed so that the upper surface of the metallic member 73 and that of the surface processed layer 74 of the light-transmissive member 66 are positioned at approximately the same height. On the central portion of the metallic member 73, a hand shaft hole 73*a* is formed so as to correspond to the hand shaft hole 15 of the luminescent member 11.

In such a dial 70 for timepiece, because the light emitted from the luminescent member 11 is transmitted through the surface processed layer 74 of the light-transmissive member 71 disposed on the peripheral side of the luminescent member 11 and outgoes upwardly, the light brightly illuminates the upper surface side of the light-transmissive member 71. Further, the upper surface side of the metallic member 73 which is disposed on the central part of the light-transmissive member 71 is also brightened. Thereby, it is possible to recognize time even in a dark place. Because the decoration effects caused by both the upper surface of the surface processed layer 74 of the light-transmissive member 71 and the upper surface of the metallic member 73 can be obtained, the number of variations of decorative style can increase like the modified example of the eighth embodiment. Therefore, various decoration effects can be obtained.

Tenth Embodiment

Figure 32:
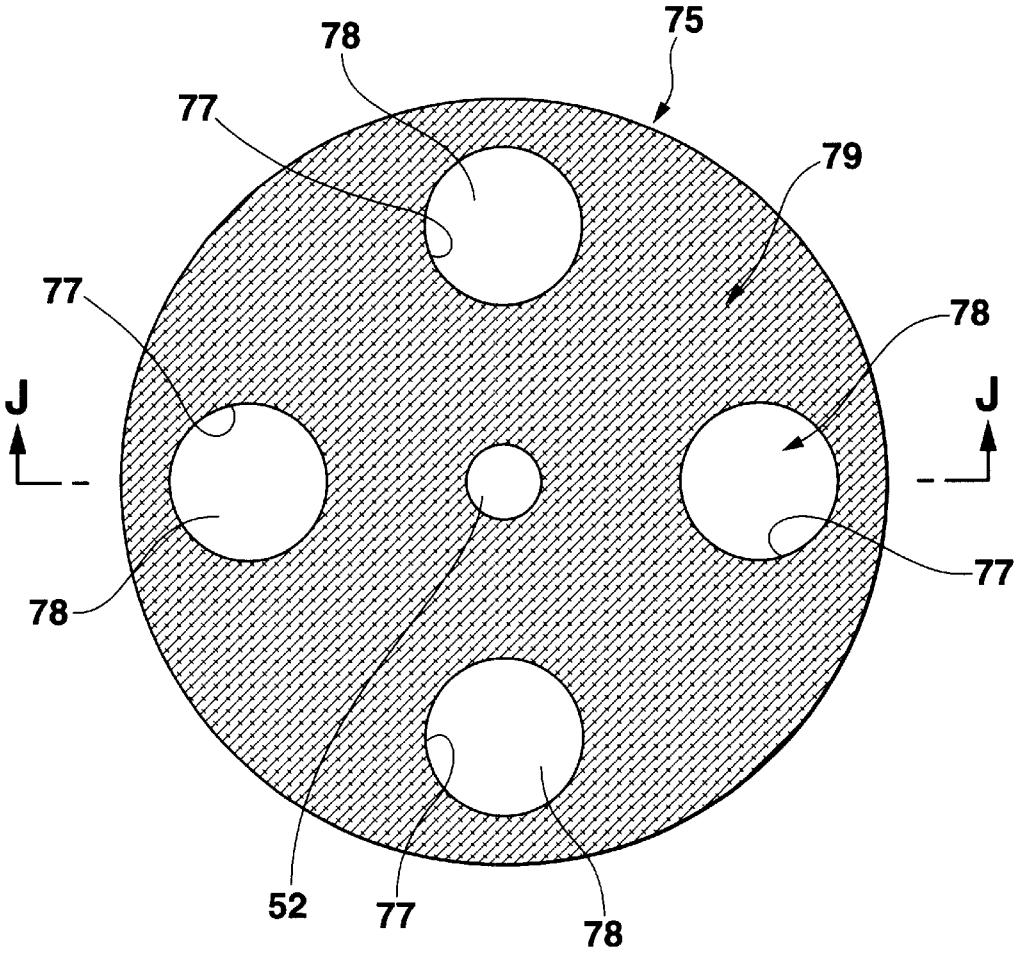
FIG. 32 is a plan view showing the tenth embodiment of the dial for timepiece according to the present invention.
Figure 33:
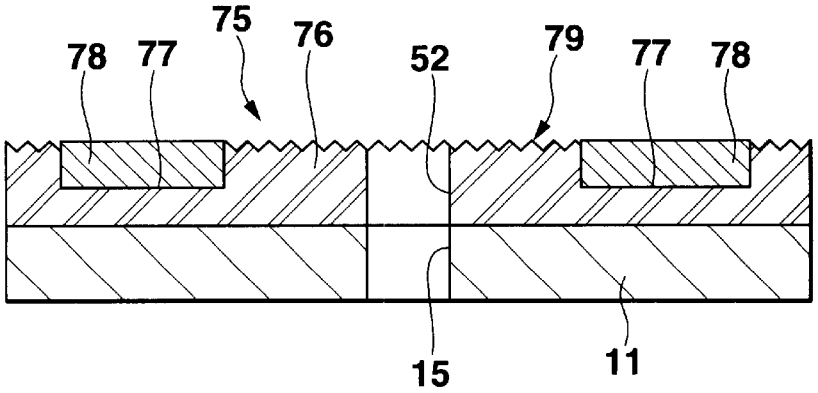
FIG. 33 is an enlarged cross-sectional view taken on line J—J of FIG. 32.

Next, with reference to FIGS. 32 and 33, a tenth embodiment of the dial for timepiece according to the present invention will be explained. The same reference numerals are attached to the same elements as the seventh embodiment shown in FIGS. 21 to 23 in order to explain the tenth embodiment.

The dial 75 for timepiece has a structure in which concave portions 77 are provided in a plurality of positions on a light-transmissive member 76 and each metallic member 78 is provided in each concave portion 77. The other structures of the dial 75 for timepiece are approximately the same as those of the seventh embodiment.

That is, the light-transmissive member 76 is formed into a circular plate having a size which is approximately the same as the that of the luminescent member 11. On the central portion thereof, a hand shaft hole 52 is provided. In a plurality of positions (in case of FIG. 32, in four positions) of the light-transmissive member 76 except the hand shaft hole 52, concave portions 77 having a small diameter are formed. On the upper surface of the light-transmissive member 76 except each concave portion 77 and the hand shaft hole 52, a surface processed layer 79 having light-transmissive property is formed by the electric casting process. The metallic member 78 is a small circular plate having a size which is the same as that of each concave portion 77. Each metallic member 78 is disposed in each concave portion 77. In this case, the metallic member 78 and the surface processed layer 79 of the light-transmissive member 76 are formed so that the upper surface of the metallic member 78 and that of the surface processed layer 79 are positioned at approximately the same height.

In such a dial 75 for timepiece, because the surface processed layer 79 provided on the upper surface of the light-transmissive member 76 is exposed on the upper side thereof, the light emitted from the luminescent member 11 is transmitted through the surface processed layer 79 of the light-transmissive member 76 and out goes upwardly. As a result, the light brightly illuminates the upper surface side of the light-transmissive member 76. Because the upper surface side of each metallic member 78 which is disposed in each concave portion 77 of the light-transmissive member 76 is also brightened, it is possible to recognize time even in a dark place.

In the dial 75 for timepiece, because the upper surface of the surface processed layer 79 of the light-transmissive member 76 and the upper surface of each metallic member 78 disposed in a plurality of positions are exposed on the upper side thereof, the decorative representation is varied by the surface processed layer 79 exposed on the upper side thereof. Further, because a feeling of metallic gloss is obtained by the metallic member 78, a user can be filled with a feeling of high quality. Because the decoration effects caused by both the surface processed layer 79 and the metallic member 78 can be obtained, the number of variations of decorative style can increase. Therefore, various decoration effects can be obtained.

Figure 34:
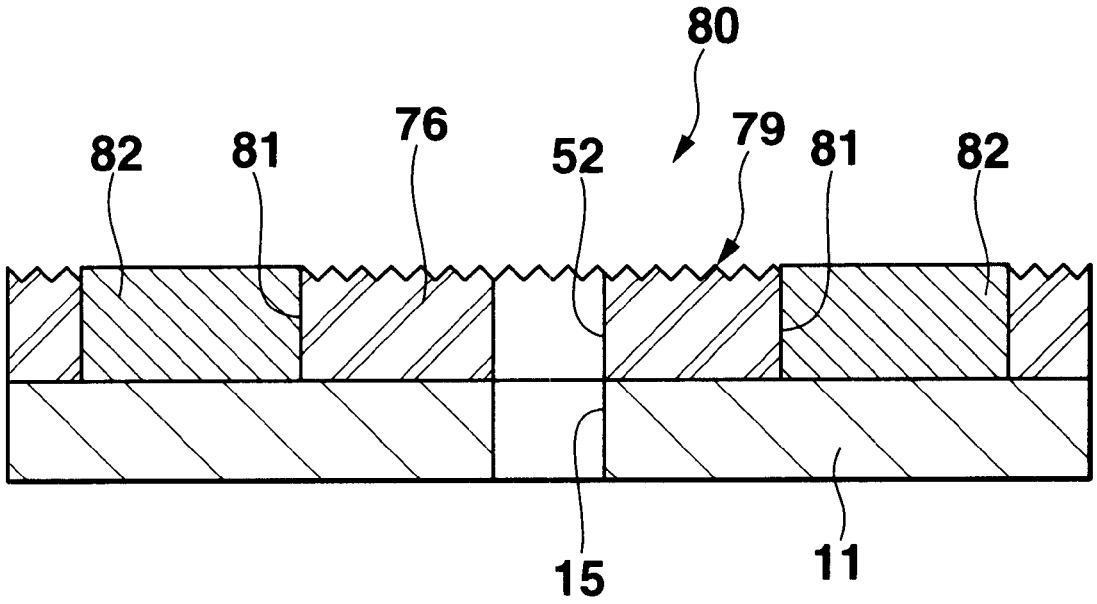
FIG. 34 is an enlarged cross-sectional view showing a modified example of the dial for timepiece of the tenth embodiment.

Although the concave portions 77 are provided in a plurality of positions on the light-transmissive member 76 and the metallic members 78 are disposed in each concave portion 77 in the above tenth embodiment, the present invention is not limited to this. For example, the dial for timepiece may have a structure like a modified example shown in FIG. 34. The dial 80 for timepiece has a structure in which through holes 81 are provided in a plurality of positions in the light-transmissive member 76, circular metallic members 82 having a thickness which is approximately the same as that of the light-transmissive member 76 are disposed in each through hole 81, and a surface processed layer 79 having light-transmissive property is provided by the electric casting process on the upper surface of the light-transmissive member 76.

In such a dial 80 for timepiece, because the upper surface of the surface processed layer 79 of the light-transmissive member 76 and the upper surface of each metallic member 82 disposed in a plurality of positions are exposed on the upper side thereof so that the upper surface of the surface processed layer 79 and that of each metallic member are positioned at approximately the same height, the light brightly illuminates the upper surface side of the light-transmissive member 76 like the tenth embodiment. Further, the upper surface sides of the metallic members 82 which are disposed in a plurality of positions are also brightened. Thereby, it is possible to recognize time even in a dark place. Because the decoration effects caused by both the upper surface of the surface processed layer 79 of the light-transmissive member 76 and the upper surfaces of the metallic members 82 can be obtained, the number of variations of decorative style can increase like the tenth embodiment. Therefore, various decoration effects can be obtained.

Eleventh Embodiment

Figure 35:
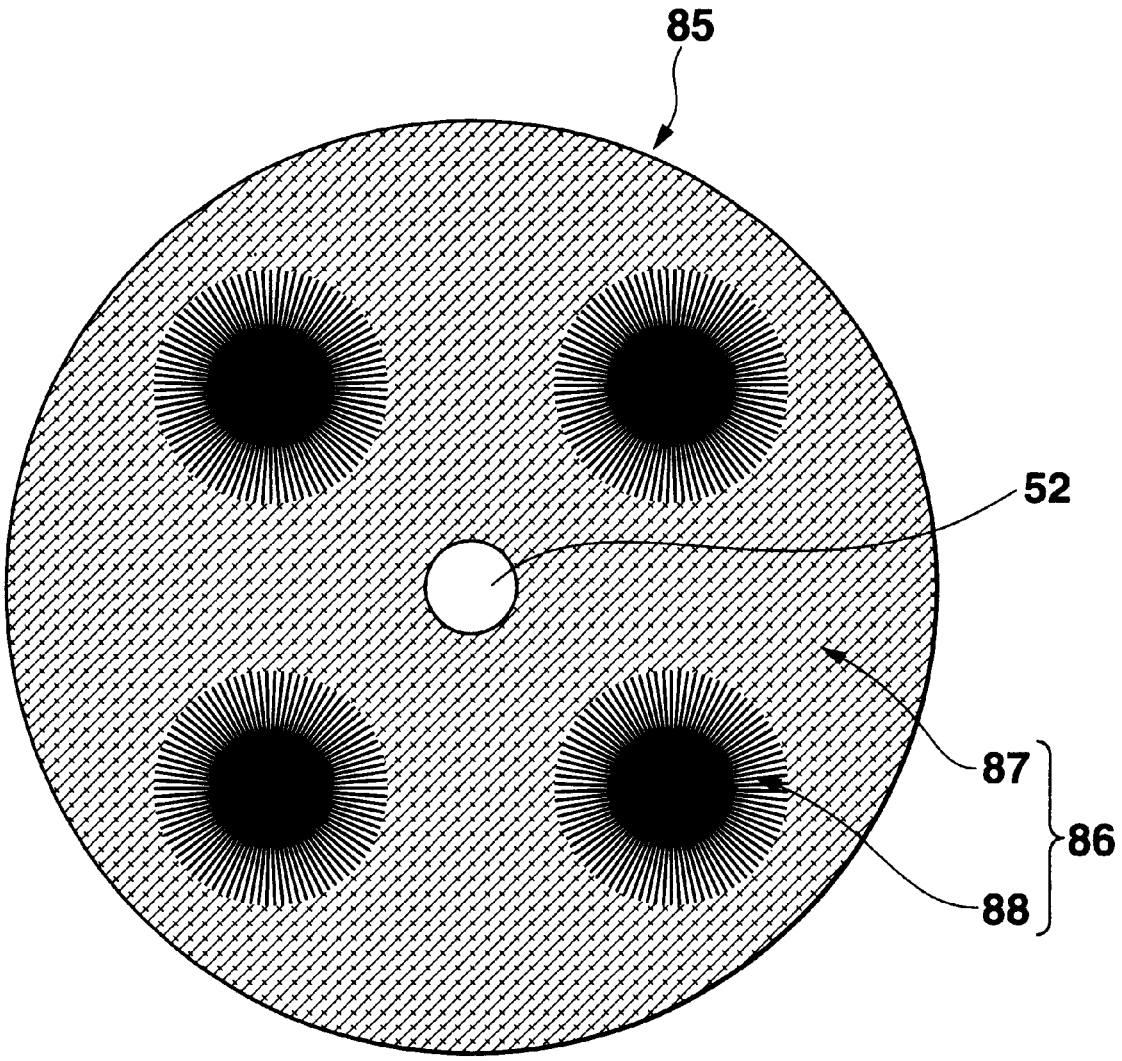
FIG. 35 is a plan view showing the eleventh embodiment of the dial for timepiece according to the present invention.

Next, with reference to FIG. 35, an eleventh embodiment of the dial for timepiece according to the present invention will be explained. The same reference numerals are attached to the same elements as the seventh embodiment shown in FIGS. 21 to 23 in order to explain the eleventh embodiment.

The dial 85 for timepiece has a structure in which a surface processed layer 86 on which different designs are mingled is provided on the upper surface of the light-transmissive member 51. The other structures of the dial 85 for timepiece are approximately the same as those of the seventh embodiment.

That is, the light-transmissive member 86 has light-transmissive property. The light-transmissive member 86 has a structure in which a first electric casting design portion 87 is formed by the electric casting process on the upper surface of the light-transmissive member 51 and a plurality of second electric casting design portions 88 of which design is different from that of the first electric casting design portion 87 are partially formed in a plurality of positions in the first electric casting design portion 87.

In such a dial 85 for timepiece, because the light emitted from the luminescent member 11 is transmitted through the surface processed layer 86 provided on the upper surface of the light-transmissive member 51, the light brightly illuminates the upper surface side of the light-transmissive member 51. Thereby, it is possible to recognize time even in a dark place. Because the surface processed layer 86 has a structure in which the first electric casting design portion 87 is mingled with the second electric casting design portions 88, the decorative representation is more varied by the first and the second electric casting design portions 87 and 88. The number of variations of decorative style can increase more than the seventh embodiment. Therefore, more various decoration effects can be obtained.

The above-described surface processed layer 86 can be applied to each surface processed layer 59, 64, 68, 74 and 79 which is described in the eighth to tenth embodiments and the modified examples thereof.

Twelfth Embodiment

Figure 36:
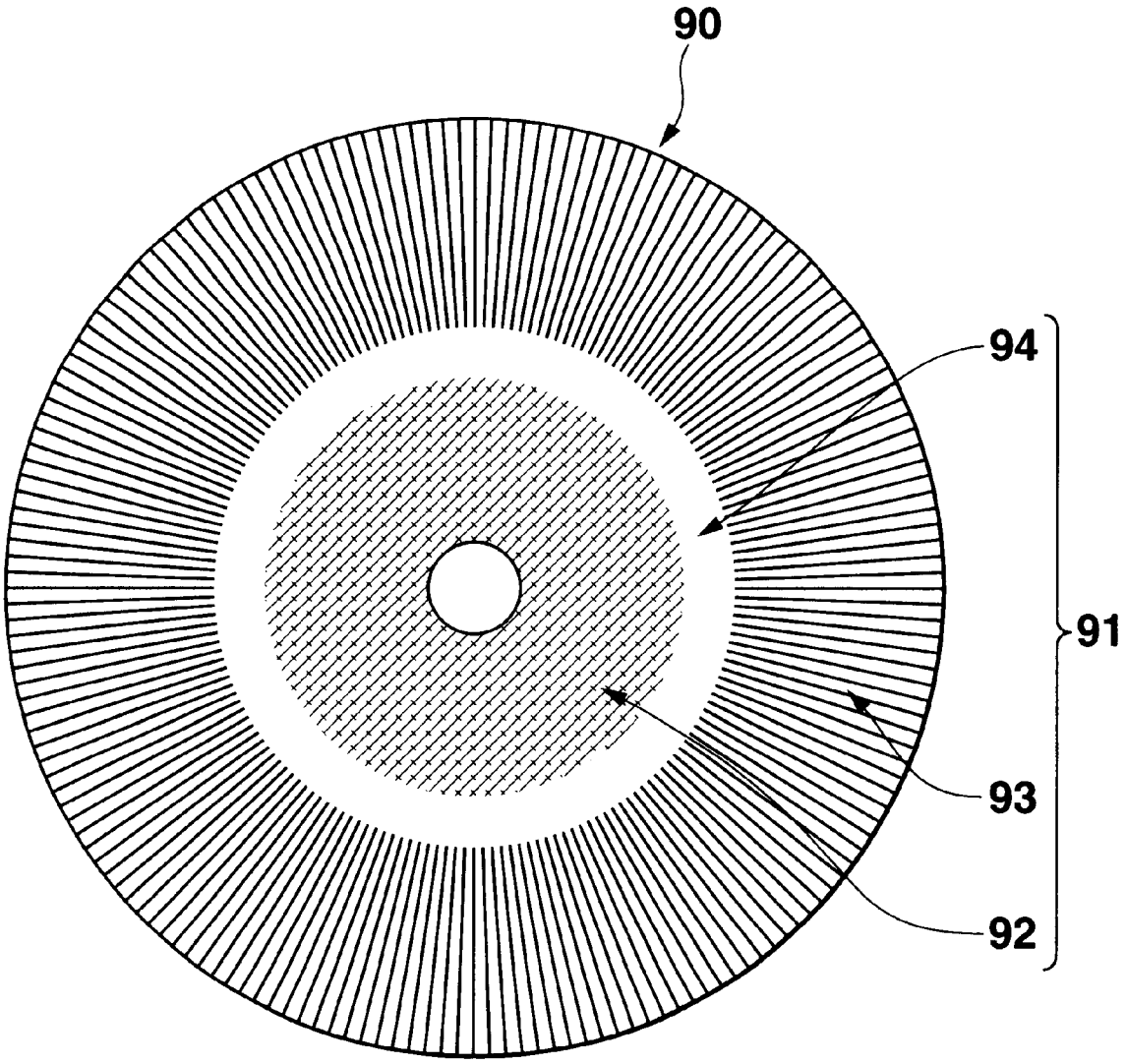
FIG. 36 is a plan view showing the twelfth embodiment of the dial for timepiece according to the present invention.

Next, with reference to FIG. 36, a twelfth embodiment of the dial for timepiece according to the present invention will be explained. The same reference numerals are attached to the same elements as the seventh embodiment shown in FIGS. 21 to 23 in order to explain the twelfth embodiment.

The dial 90 for timepiece has a structure in which a surface processed layer 91 on which different designs are mingled is provided on the upper surface of the light-transmissive member 51. The other structures of the dial 90 for timepiece are the same as those of the seventh embodiment.

That is, the light-transmissive member 91 has light-transmissive property. The light-transmissive member 91 has a structure in which a first and a second electric casting design portions 92 and 93 which are different from each other are formed into concentric circular rings by the electric casting process on the upper surface of the light-transmissive member 51 and a mirror-surface portion 94 is formed into a concentric circular ring between the first and the second electric casting design portions 92 and 93.

In such a dial 90 for timepiece, because the light emitted from the luminescent member 11 is transmitted through the surface processed layer 91 provided on the upper surface of the light-transmissive member 51, the light brightly illuminates the upper surface side of the light-transmissive member 51. Thereby, it is possible to recognize time even in a dark place. Because the surface processed layer 91 has a structure in which the first and the second electric casting design portions 92 and 93 and the mirror-surface portion 94 are mingled so as to form them into concentric circular rings, the decorative representation is varied more than the eleventh embodiment by the first and the second electric casting design portions 92 and 93 and the mirror-surface portion 94. The number of variations of decorative style can increase. Therefore, more various decoration effects can be obtained.

The above-described surface processed layer 91 can be applied to each surface processed layer 59, 64, 68, 74 and 79 which is described in the eighth to tenth embodiments and the modified examples thereof.

Thirteenth Embodiment

Figure 37:
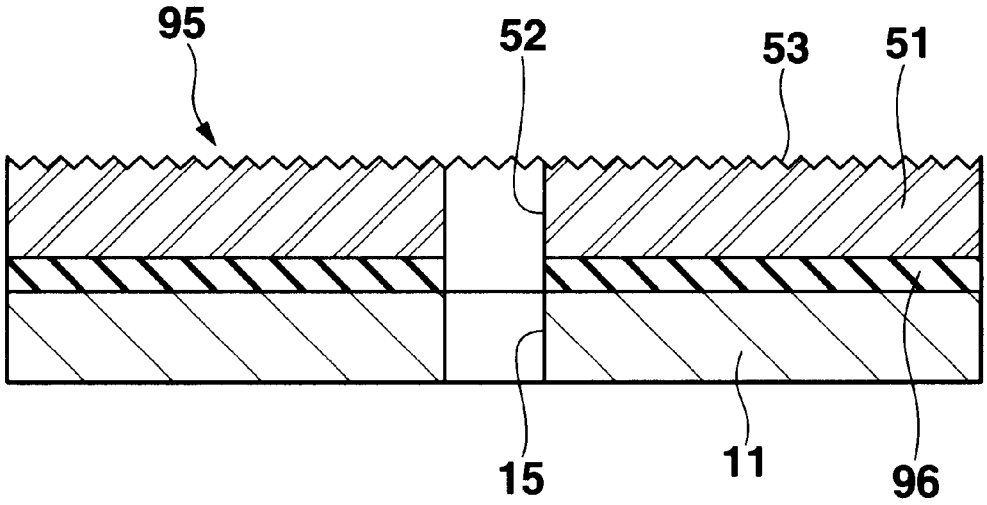
FIG. 37 is an enlarged cross-sectional view showing the thirteenth embodiment-of the dial for timepiece according to the present invention.

Next, with reference to FIG. 37, a thirteenth embodiment of the dial for timepiece according to the present invention will be explained. The same reference numerals are attached to the same elements as the seventh embodiment shown in FIGS. 21 to 23 in order to explain the thirteenth embodiment.

The dial 95 for timepiece has a structure in which a metallic layer 96 having light-transmissive property is provided on the lower surface of the light-transmissive member 51. The other structures of the dial 95 for timepiece are the same as those of the seventh embodiment.

That is, the metallic layer 96 is made of a metal, such as aluminum, gold, silver, chrome or the like and is thinly formed on the lower surface of the light-transmissive member 51 by the deposition so that the thickness thereof is about 200 Å to 500 Å. Thereby, a light can be transmitted through the metallic layer 96. In this case, a surface processed layer 53 formed by the electric casting process, and having light-transmissive property, is provided on the upper surface of the light-transmissive member 51.

In such a dial 95 for timepiece, when the luminescent member 11 emits a light, the light emitted from the luminescent member 11 is transmitted through the metallic layer 96. Further, the transmitted light is transmitted through the light-transmissive member 51 disposed on the upper surface of the metallic layer 96 and the surface processed layer 53 and outgoes upwardly. As a result, the light illuminates the upper surface side of the light-transmissive member 51 like the seventh embodiment. Thereby, it is possible to recognize time even in a dark place.

Because the surface processed layer 53 formed by the electric casting process is provided on the upper surface of the light-transmissive member 51 in the dial 95 for timepiece, the decorative representation is varied by the surface processed layer 53 like the seventh embodiment. In particular, because a feeling of metallic gloss can be obtained by the metallic layer 96 during the non-emission of the luminescent member 11, a user can be filled with a feeling of high quality. The decoration effect shown during the emission of the luminescent member 11 and the decoration effect shown during the non-emission thereof, which are different from each other can be obtained. Thereby, the number of variations of decorative style can increase more than the seventh embodiment. Further, various decoration effects can be obtained.

Figure 38:
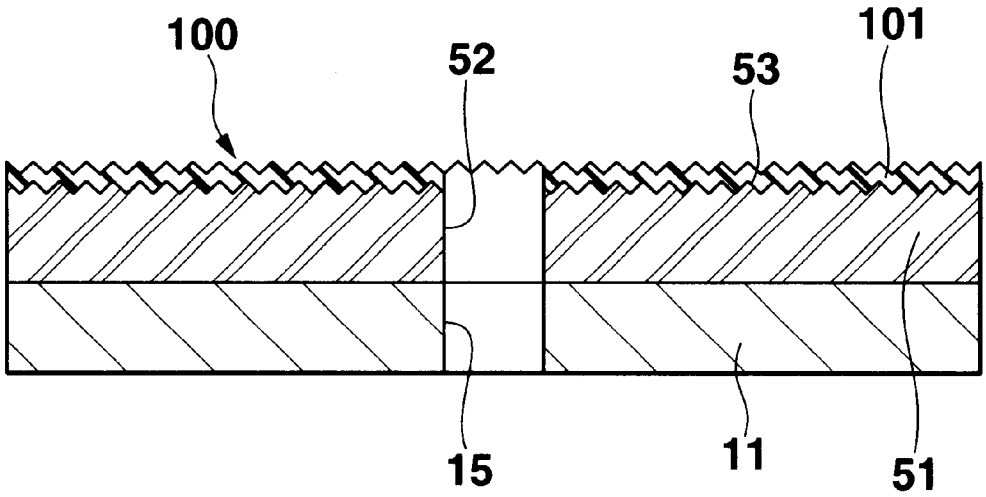
FIG. 38 is an enlarged cross-sectional view showing a modified example of the dial for timepiece of the thirteenth embodiment.

Although the metallic layer 96 is provided on the lower surface of the light-transmissive member 51 in the above thirteenth embodiment, the present invention is not limited to this. For example, like a dial 100 for timepiece, which is shown in FIG. 38 as a modified example, the dial for timepiece may have a structure in which a metallic layer 101 having light-transmissive property is provided on the upper surface of the light-transmissive member 51, that is, on the upper surface of the surface processed layer 53. The metallic layer 101 has the same structure as the metallic layer 96 of the thirteenth embodiment. However, because the metallic layer 101 is provided on the surface processed layer 53 disposed on the upper surface of-the light-transmissive member 51, the metallic layer 101 is formed into the same irregular shape as the surface processed layer 53.

Even in such a dial 100 for timepiece, because the light emitted from the luminescent member 11 is transmitted through the surface processed layer 53 of the light-transmissive member 51 and the metallic layer 101, and outgoes upwardly, it is possible to recognize time even in a dark place. Because the metallic layer 101 is formed into the same irregular shape as the surface processed layer 53, the decorative representation is varied by the metallic layer 101. Because a feeling of metallic gloss can be obtained by the metallic layer 101 during the non-emission of the luminescent member 11, a user can be filled with a feeling of high quality. The decoration effect shown during the emission of the luminescent member 11 and the decoration effect shown during the non-emission thereof, which are different from each other can be obtained. Thereby, the number of variations of decorative style can increase like the thirteenth embodiment. Further, various decoration effects can be obtained.

Fourteenth Embodiment

Figure 39:
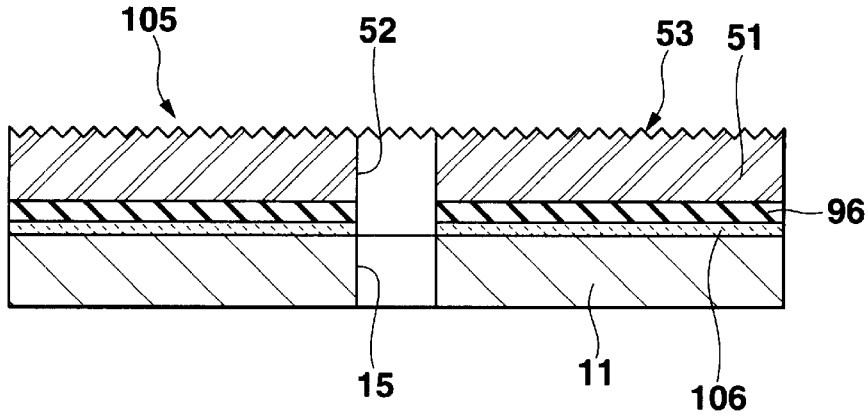
FIG. 39 is an enlarged cross-sectional view showing the fourteenth embodiment of the dial for timepiece according to the present invention.

Next, with reference to FIG. 39, a fourteenth embodiment of the dial for timepiece according to the present invention will be explained. In this case, the same reference numerals are attached to the same elements as the thirteenth embodiment shown in FIG. 37 in order to explain the fourteenth embodiment.

The dial 105 for timepiece has a structure in which a decoration layer 106 is provided on the lower surface of the metallic layer 96 having light-transmissive property, which is provided on the lower surface of the light-transmissive member 51. The other structures of the dial 105 for timepiece are the same as those of the thirteenth embodiment.

That is, the decoration layer 106 is formed into the shape of a pattern, a figure, a design or the like, by printing it on the lower surface of the metallic layer 96. The decoration layer 106 may have light-transmissive property or may have no light-transmissive property. When the decoration layer 106 has light-transmissive property, the decoration layer 106 is a color layer through which a light of which the color is different from that of the metallic layer 96 is transmitted. When the decoration layer 106 has no light-transmissive property, the decoration layer 106 is formed so that a light is transmitted through spaces (not shown in the figure) of the decoration layer 106 according to a pattern, a figure, a design thereof. In this case, the surface processed layer 53 formed by the electric casting process, and having light-transmissive property, is also provided on the upper surface of the light-transmissive member 51.

In such a dial 105 for timepiece, when the decoration layer 106 has light-transmissive property, the light emitted from the luminescent member 11 is transmitted through the decoration layer 106. Further, the transmitted light is transmitted through the metallic layer 96, the light-transmissive member 51 and the surface processed layer 53 and outgoes upwardly. When the decoration layer 106 has no light-transmissive property, the light emitted from the luminescent member 11 is transmitted through the spaces of the decoration layer 106 according to a pattern, a figure, or a design of the decoration layer 106. Further, the transmitted light is transmitted through the metallic layer 96, the light-transmissive member 51 and the surface processed layer 53 and outgoes upwardly. In both cases, the light illuminates the upper surface side of the light-transmissive member 51. Thereby, it is possible to recognize time even in a dark place.

Because the surface processed layer 53 formed by the electric casting process, is provided on the upper surface of the light-transmissive member 51 in the dial 105 for timepiece, the decorative representation is varied by the surface processed layer 53. In particular, because a pattern, a figure, or a design of the decoration layer 106 appears on the dial 105 for timepiece during the emission of the luminescent member 11, the decoration effect can be obtained by the decoration layer 106. Because a feeling of metallic gloss can be obtained by hiding the decoration layer 106 under the metallic layer 96 during the non-emission of the luminescent member 11, a user can be filled with a feeling of high quality. The decoration effect can be obtained by the three layers which are the surface processed layer 53, the metallic layer 96 and the decoration layer 106. Thereby, the number of variations of decorative style can increase. Further, more various decoration effects can be obtained.

Although the metallic layer 96 is provided on the lower surface of the light-transmissive member 51 in the above fourteenth embodiment, the present invention is not limited to this. The dial for timepiece may have a structure shown in FIG. 40 or FIG. 41.

Figure 40:
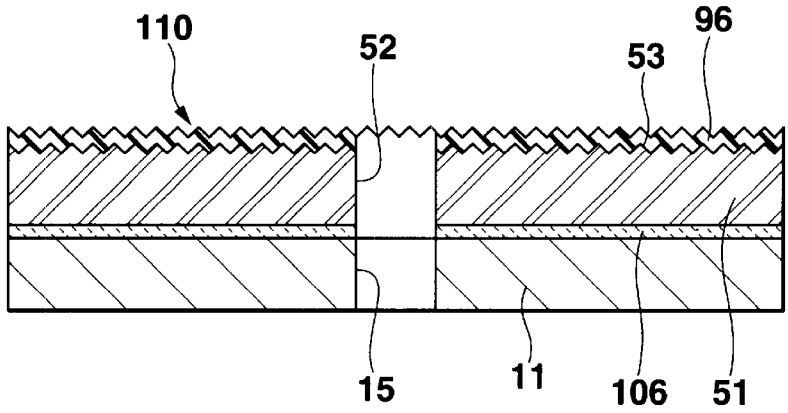
FIG. 40 is an enlarged cross-sectional view showing the first modified example of the dial for timepiece of the fourteenth embodiment.

That is, the dial 110 for timepiece, which is shown in FIG. 40 as a first modified example of the fourteenth embodiment has a structure in which the metallic layer 96 having light-transmissive property is provided on the upper surface of the light-transmissive member 51, that is, on the upper surface of the surface processed layer 53, and in which the decoration layer 106 is provided on the lower surface of the light-transmissive member 51. Even in such a structure, because the decoration layer 106 appears on the dial 110 for timepiece during the emission of the luminescent member 11, the decoration effect can be obtained by the three layers which are the surface processed layer 53, the metallic layer 96 and the decoration layer 106 like the fourteenth embodiment. Thereby, the number of variations of decorative style can increase. Further, various decoration effects can be obtained.

Figure 41:
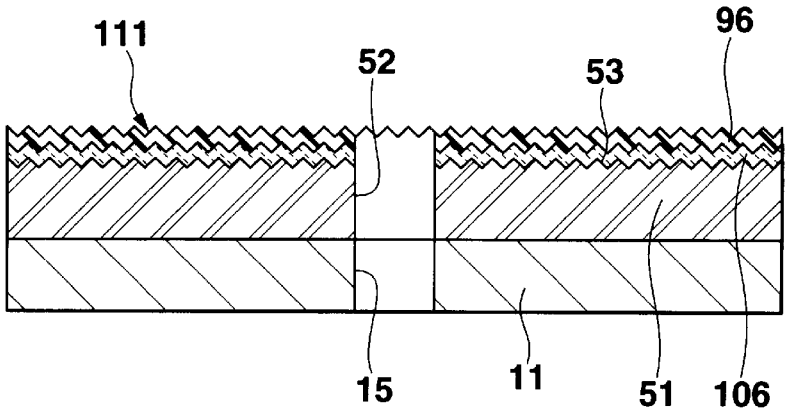
FIG. 41 is an enlarged cross-sectional view showing the second modified example of the dial for timepiece of the fourteenth embodiment.

The dial 111 for timepiece, which is shown in FIG. 41 as a second modified example of the fourteen embodiment has a structure in which the decoration layer 106 is provided on the upper surface of the light-transmissive member 51, that is, on the upper surface of the surface processed layer 53, and the metallic layer 96 having light-transmissive property is provided on the lower surface of the decoration layer 106. Even in such a structure, because the decoration layer 106 appears on the dial 111 for timepiece during the emission of the luminescent member 11, the decoration effect can be obtained by the three layers which are the surface processed layer 53, the metallic layer 96 and the decoration layer 106 like the fourteenth embodiment. Thereby, the number of variations of decorative style can increase. Further, various decoration effects can be obtained.

Fifteenth Embodiment

Figure 42:
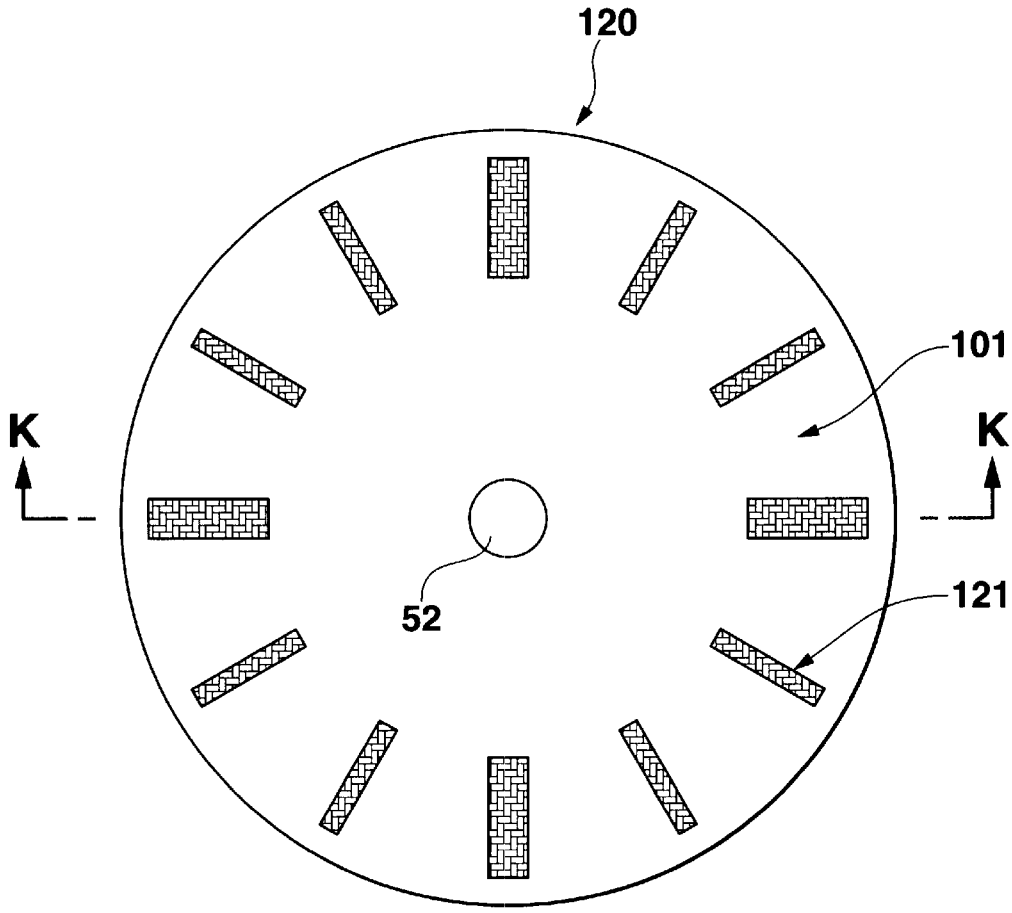
FIG. 42 is a plan view showing the fifteenth embodiment of the dial for timepiece according to the present invention.
Figure 43:
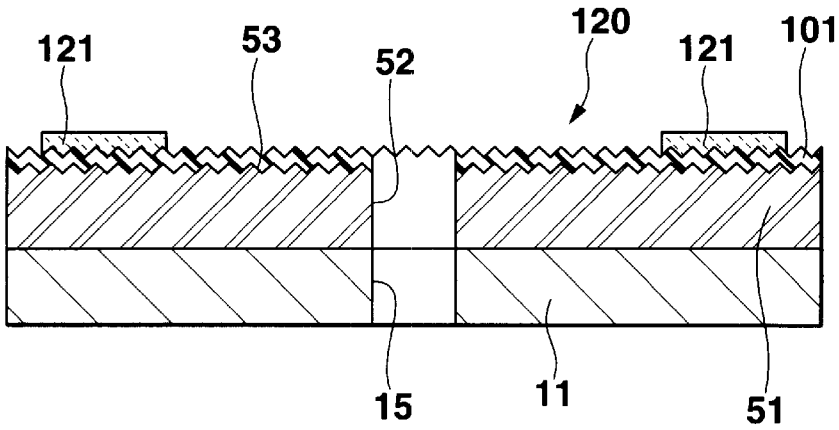
FIG. 43 is an enlarged cross-sectional view taken on line K—K of FIG. 42.

Next, with reference to FIGS. 42 and 43, a fifteenth embodiment of the dial for timepiece according to the present invention will be explained. In this case, the same reference numerals are attached to the same elements as the modified example of the thirteenth embodiment, which is shown in FIG. 38, in order to explain the fifteenth embodiment.

The dial 120 for timepiece has a structure in which the metallic layer 101 having light-transmissive property is provided on the upper surface of the light-transmissive member 51, and a decoration layer 121, such as time indices, is provided on the upper surface of the metallic layer 101. The other structures of the dial 120 for timepiece are the same as those of the modified example of the thirteenth embodiment.

That is, the decoration layer 121 acts as time indices formed into the shape of a stick by printing them on the upper surface of the metallic layer 101, and is provided in positions corresponding to one to twelve o'clock positions of a clock. The decoration layer 121 may be one through which a light of which the color is different from that of the metallic layer 101 is transmitted or may have no light-transmissive property like the fourteenth embodiment. In this case, the surface processed layer 53 formed by the electric casting process, and having light-transmissive property, is also provided on the upper surface of the light-transmissive member 51.

In such a dial 120 for timepiece, when the light emitted from the luminescent member 11 is transmitted through the light-transmissive member 51 and the surface processed layer 53 thereof and further the transmitted light is transmitted through the metallic layer 101 and outgoes upwardly, the decoration layer 121, such as time indices, can appear on the dial 120 for timepiece and can be illuminated even though the decoration layer 121 has light-transmissive property or has no light-transmissive property. Thereby, it is possible to recognize time even in a dark place. Because a feeling of metallic gloss can be obtained by the metallic layer 101 during the non-emission of the luminescent member 11, a user can be filled with a feeling of high quality. Because the metallic layer 101 is formed into the same irregular shape as the surface processed layer 53, the decorative representation can be varied by the metallic layer 101. The decoration effect can be obtained by the three layers which are the surface processed layer 53, the metallic layer 101 and the decoration layer 121. Thereby, the number of variations of decorative style can increase. Further, various decoration effects can be obtained.

Sixteenth Embodiment

Figure 44:
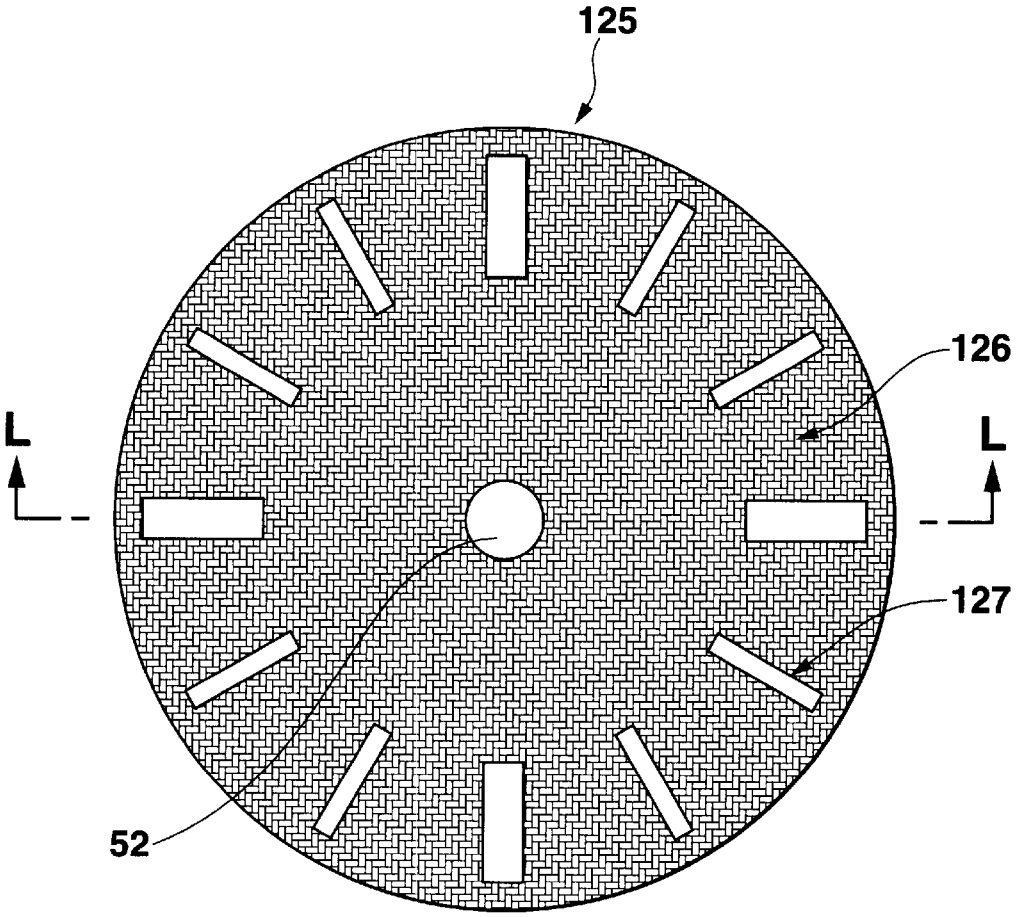
FIG. 44 is a plan view showing the sixteenth embodiment of the dial for timepiece according to the present invention.
Figure 45:
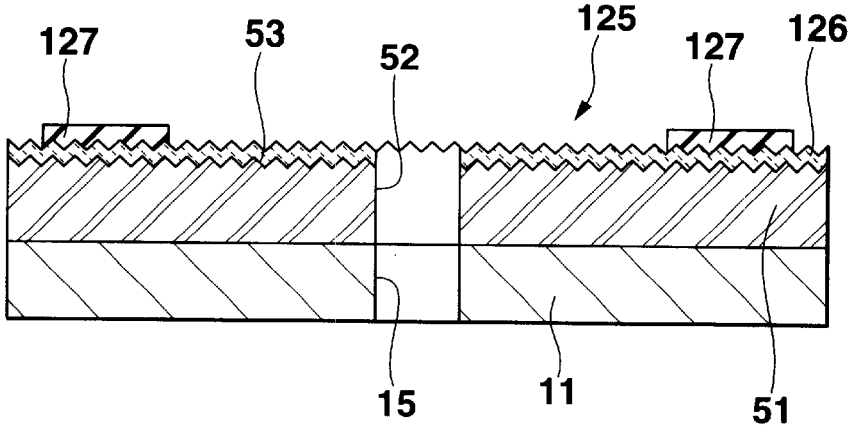
FIG. 45 is an enlarged cross-sectional view taken on line L—L of FIG. 44.

Next, with reference to FIGS. 44 and 45, a sixteenth embodiment of the dial for timepiece according to the present invention will be explained. In this case, the same reference numerals are attached to the same elements as the seventh embodiment shown in FIGS. 21 to 23, in order to explain the sixteenth embodiment.

The dial 125 for timepiece has a structure in which a decoration layer 126 having light-transmissive property is provided on the upper surface of the surface processed layer 53 of the light-transmissive member 51, and a metallic layer 127, such as time indices, is provided on the upper surface of the decoration layer 126. The other structures of the dial 125 for timepiece are the same as those of the seventh embodiment.

That is, the decoration layer 126 is formed by printing it on the upper surface of the light-transmissive member 51, that is, on the upper surface of the surface processed layer 53 and has light-transmissive property. Although the decoration layer 126 is not colored and is transparent, it is preferable that the decoration layer 127 is a color translucent member of which a color is different from that of the metallic layer 127. The metallic layer 127 is made of the same material as the thirteenth embodiment and acts as time indices formed into the shape of a stick with a thickness (for example, about 200 Å to 500 Å), so as to transmit a light, by the deposition on the upper surface of the decoration layer 126. The time indices is provided in positions corresponding to one to twelve o'clock positions of a clock.

In such a dial 125 for timepiece, when the light emitted from the luminescent member 11 is transmitted through the light-transmissive member 51 and the surface processed layer 53 thereof and further the transmitted light is transmitted through the decoration layer 126 and outgoes upwardly, a part of the outgoing light is transmitted through the metallic layer 127. Because the light transmitted through the metallic layer 127 is a colored light having a color which is different from that of the decoration layer 126, the metallic layer 127 which is time indices can appear on the dial 125 for timepiece and can be illuminated by the light transmitted through the decoration layer 126. Thereby, it is possible to recognize time even in a dark place. Because time indices giving a feeling of using a metal to a user can be obtained by the metallic layer 127 during the non-emission of the luminescent member 11, a user can be filled with a feeling of richness. The decoration effect can be obtained by the three layers which are the surface processed layer 53, the metallic layer 127 and the decoration layer 126. Thereby, the number of variations of decorative style can increase. Further, various decoration effects can be obtained.

Seventeenth Embodiment

Figure 46:
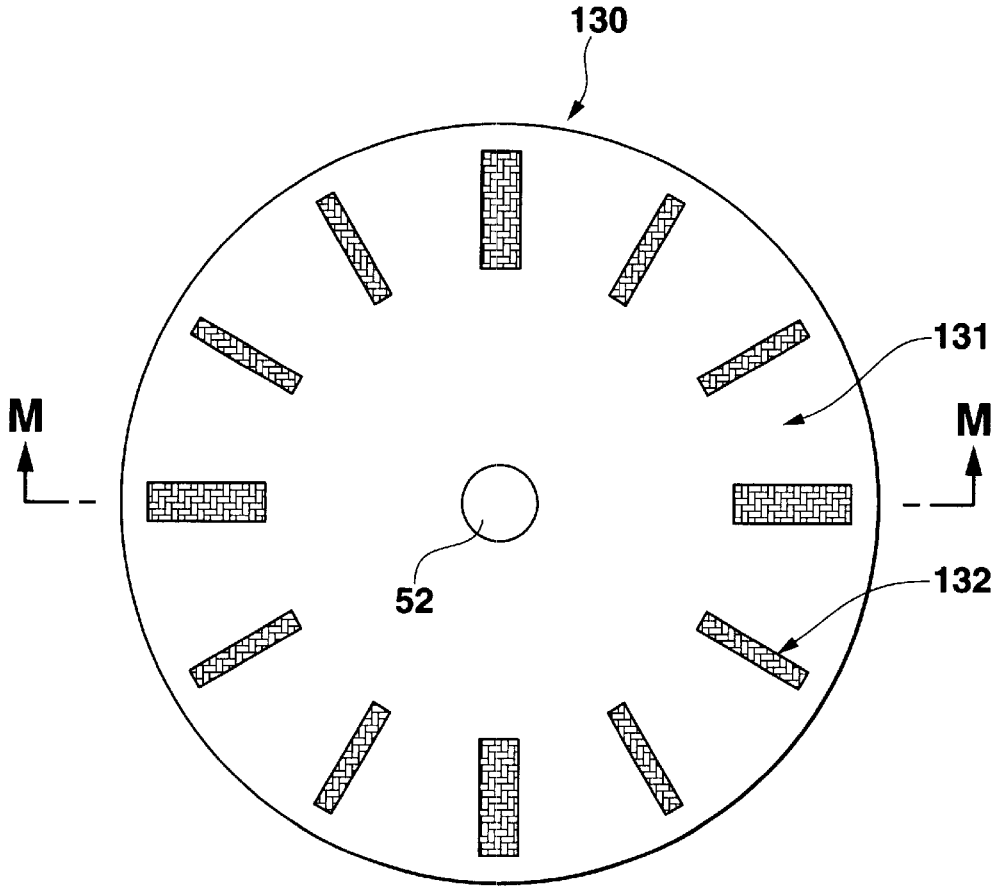
FIG. 46 is a plan view showing the seventeenth embodiment of the dial for timepiece according to the present invention.
Figure 47:
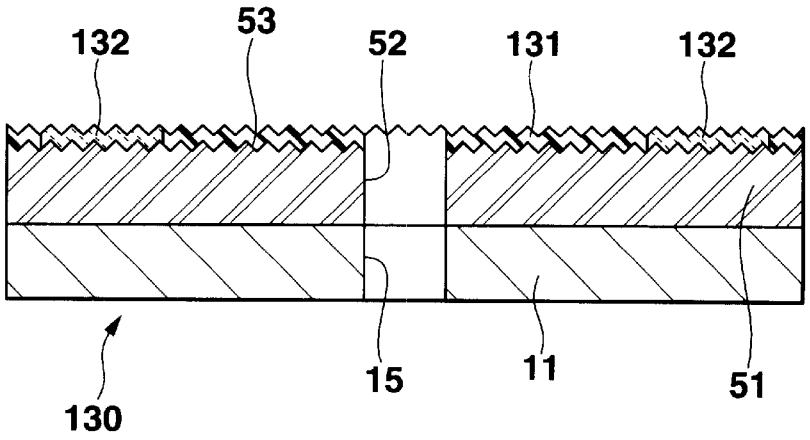
FIG. 47 is an enlarged cross-sectional view taken on line M—M of FIG. 46.

Next, with reference to FIGS. 46 and 47, a seventeenth embodiment of the dial for timepiece according to the present invention will be explained. In this case, the same reference numerals are attached to the same elements as the seventh embodiment shown in FIGS. 21 to 23, in order to explain the seventeenth embodiment.

The dial 130 for timepiece has a structure in which a metallic layer 131 having light-transmissive property and a decoration layer 132 are provided on the upper surface of the light-transmissive member 51 so as to arrange them. The other structures of the dial 130 for timepiece are the same as those of the seventh embodiment.

That is, the metallic layer 131 is made of the same material as the thirteenth embodiment and is formed partially by the deposition on the upper surface of the light-transmissive member 51, that is, on the upper surface of the surface processed layer 53 with a thickness of about 200 Å to 500 Å so as to be light-transmissible. Thereby, a light can be transmitted. The decoration layer 132 is time indices formed into the shape of a stick by printing them and is provided in the metallic layer 131. The decoration layer 132 may transmit a colored light of which a color is different from that of the metallic layer 96. The decoration layer may has no light-transmissive property.

In such a dial 130 for timepiece, when the light emitted from the luminescent member 11 is transmitted through the light-transmissive member 51 and the surface processed layer 53 thereof and further a part of the transmitted light is transmitted through the metallic layer 131 and outgoes upwardly, the decoration layer 132 can appear on the dial 130 for timepiece and can be illuminated even though the decoration layer 132 transmits a light or does not transmit a light. Thereby, it is possible to recognize time even in a dark place. Because a feeling of using a metal can be obtained by the metallic layer 131, a user can be filled with a feeling of richness. The decoration effect can be obtained by the three layers which are the surface processed layer 53, the metallic layer 131 and the decoration layer 132. Thereby, the number of variations of decorative style can increase. Further, various decoration effects can be obtained.

Although it is described that the decoration layer or the metallic layer is formed into the time indices having a stick shape in the above fifteenth to seventeenth embodiments, the present invention is not limited to this. For example, the time indices maybe formed into an Arabic character, a mark, a figure, a design or the like.

Although it is described that the decoration layers have the same light-transmissive property in the above fourteenth to seventeenth embodiments and the modified examples thereof, the present invention is not limited to this. For example, the decoration layer may be formed so that the light-transmissive property thereof is partially different. If the decoration layer is formed as described above, the decoration layer shows designs so that the design shown during the emission of the luminescent member 11 is different from one shown during the non-emission of the luminescent member 11. Thereby, the number of variations of decorative style can increase more. Further, more various decoration effects can be obtained. In this case, when the luminescent member 11 has a structure in which the light intensity thereof can be adjusted, a decorative representation, such as a design or the like, can be more varied by adjusting the light intensity. Thereby, the number of variations of decorative style can increase more. Further, more various decoration effects can be obtained.

Although it is described that the light-transmissive member is made of a transparent material in the above seventh to seventeenth embodiments and the modified examples thereof, the present invention is not limited to this. For example, the light-transmissive member may be made of color translucent material or material containing powder. If the light-transmissive member is formed as described above, the light emitted from the luminescent member 11 can be changed into a colored light or the light-transmissive property can be changed. Thereby, the number of variations of decorative style can increase more. Further, more various decoration effects can be obtained.

Although it is described that the present invention is applied to a wrist watch having an analog function in the first to seventeenth embodiments and the modified examples thereof, the present invention is not limited to those. For example, the present invention can be applied to a wrist watch having a digital function or to a wrist watch having a digital function and an analog function. Further, the present invention is not limited to a wrist watch. The present invention can be broadly applied to timepieces, for example, a table clock, an alarm clock, a travel watch, a wall clock or the like.

Eighteenth Embodiment

Hereinafter, the eighteenth embodiment in which a dial for timepiece according to the present invention is applied to a wrist watch will be explained with reference to FIGS. 48 and 49. In this case, the same reference numerals are attached to the same elements as the first embodiment shown in FIG. 1 in order to explain the eighteenth embodiment.

Figure 48:
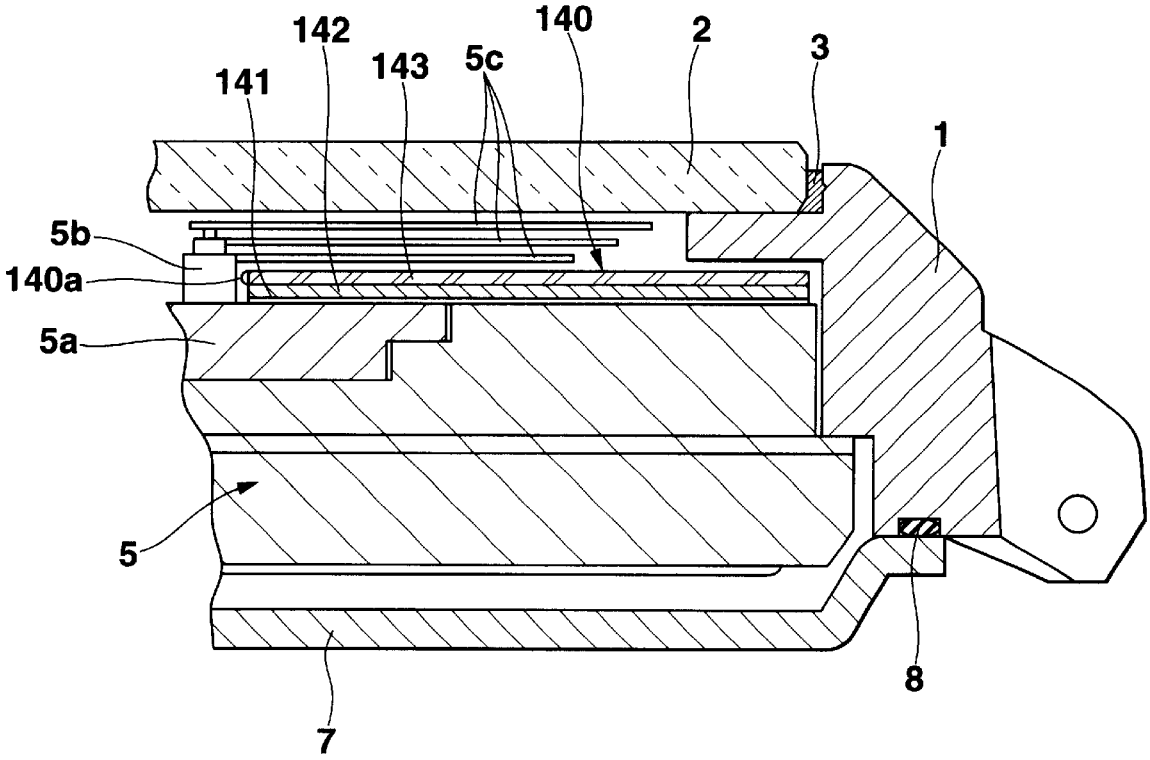
FIG. 48 is an enlarged cross-sectional view showing a principal portion of the eighteenth embodiment in which a dial for timepiece according to the present invention, is applied to a wrist watch.

FIG. 48 is a principal enlarged sectional view showing an inner structure of a wrist watch. The wrist watch comprises a wrist watch case 1 like the first embodiment. A watch glass 2 is mounted on an upper portion of the wrist watch case 1 via a packing 3. A dial 140 for timepiece and a watch module 5 are contained in the wrist watch case 1. A rear cover 7 is attached to a lower surface of the wrist watch case 1 via a waterproof ring 8.

The watch module 5 comprises an analog movement 5*a* having at least an analog function between an analog function and a digital function. A hand shaft 5*b* of the analog movement 5*a* projects upwardly through a hand shaft hole 140*a* provided on a central portion of the dial 140 for timepiece. Hands 5*c*, such as an hour hand, a minute hand, a second hand are the like, are attached to an upper end portion of the projecting hand shaft 5*b*. The watch module 5 has a structure so that hands 5*c* are moved above the dial 140 for timepiece.

As shown in FIG. 48, the dial 140 for timepiece comprises a metallic plate 141, such as stainless steel or the like, a luminescent member 142 disposed on an upper surface of the metallic plate 141 and a decoration member 143 having light-transmissive property and disposed above the luminescent member 142, which are disposed in an order from a lower side of the dial 140 for timepiece. These members are formed in a plate-like shape. The dial 140 for timepiece is disposed on an upper surface of the watch module 5.

In this case, the luminescent member 142 is a plate-like emitting member having an emitting element, such as an EL element. The luminescent member 142 is electrically connected to the watch module 5 and emits a light when it is turned on. Because a part of the emitted light which outgoes below, is reflected on the metallic plate 141 disposed under the luminescent member 142, all the emitted light outgoes upwardly.

Figure 49:
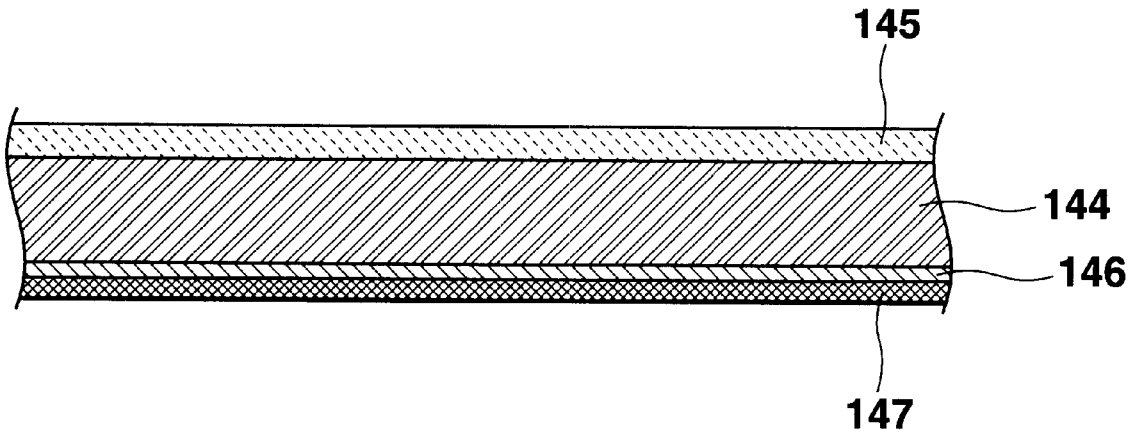
FIG. 49 is an enlarged cross-sectional view showing a principal portion of a decoration member of the dial for timepiece of FIG. 48.

As shown in FIG. 49, the decoration member 143 comprises a light-transmissive member 144 made of transparent synthetic resin, such as acrylic resin or the like, a color layer 145 disposed on the upper surface of the light-transmissive member 144 and having light-transmissive property, a thin film metallic layer 146 provided on the lower surface of the light-transmissive member 144, a transparent protect film 147 provided on the lower surface of the thin film metallic layer 146. The decoration member 143 having the above layers is disposed on the upper surface of the luminescent member 142.

The color layer 145 is a filter which transmits a light having a predetermined frequency, that is, a colored light. The color layer 145 is provided on the upper surface of the light-transmissive member 144 by application, printing, deposition or the like.

The thin film metallic layer 146 is formed by application, printing, deposition or the like so as to have a thickness of about 1 μm to 5 μm. The thin film metallic layer 146 has a number of minute holes. Thereby, the thin film metallic layer 146 has light-transmissive property.

In such a dial 140 for timepiece, when the luminescent member 142 is turned on and emits a light, the emitted light outgoes toward the upper position of the luminescent member 142. The emitted light is transmitted through the transparent protect film 147, the thin film metallic layer 146, the light-transmissive member 144 and the color layer 145 in this order. The colored light selected by the color layer 145 illuminates the upper surface side of the color layer 145. Thereby, it is possible to recognize time through the watch glass 2 even in a dark place.

In the dial 140 for timepiece, both during the emission of the luminescent member 142 and during the non-emission thereof, the decoration effect caused by the colored light selected by the color layer 145 and the metallic decoration effect caused by the thin film metallic layer 146 are obtained. As a result, the number of variations of decorative style can increase by both layers. Therefore, various decoration effects can be obtained. In this case, because the transparent protect film 147 is provided on the lower surface of the thin film metallic layer 146, the thin film metallic layer 146 can be protected firmly and excellently even though the thin film metallic layer 146 is formed thinly.

In this wrist watch, because the dial 140 for timepiece can be seen through the watch glass 2 even though the dial 140 for timepiece is disposed in the watch case 1 and the watch glass 2 is mounted on the upper position of the dial 140 for timepiece, which is disposed in the watch case 1, it is possible to recognize time by the dial 140 for timepiece even in a dark place and to obtain various decoration effects by the dial 140 for timepiece.

Nineteenth Embodiment

Figure 50:
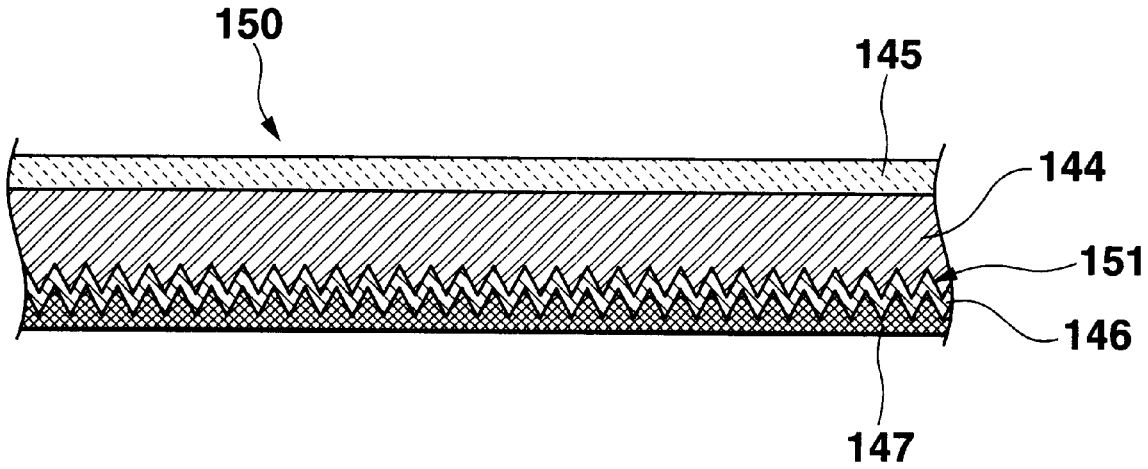
FIG. 50 is an enlarged cross-sectional view showing a principal portion of the nineteenth embodiment of the dial for timepiece according to the present invention.

Next, with reference to FIG. 50, a nineteenth embodiment of the dial for timepiece according to the present invention will be explained. The same reference numerals are attached to the same elements as the eighteenth embodiment shown in FIGS. 48 and 49 in order to explain the nineteenth embodiment.

The dial 150 for timepiece has a structure in which an irregular portion 151 is formed on the lower surface of the light-transmissive member 144, and in which the thin film metallic layer 146 and the transparent protect film 147 are provided on the lower surface of the irregular portion 151. The other structures of the dial 150 for timepiece are approximately the same as those of the eighteenth embodiment.

That is, the irregular portion 151 is formed by the honing process or by the hairline process in a certain pattern, such as a radial pattern, a concentric circular pattern, a lattice pattern or the like. The thin film metallic layer 146 is formed in the same irregular shape as the irregular portion 151. In the protect film 147 disposed on the lower surface of the thin film metallic layer 146, the upper surface thereof is formed in the irregular shape and the lower surface thereof is formed flat.

In such a dial 150 for timepiece, the same effect as the eighteenth embodiment can be obtained. Further, in particular, because the irregular portion 151 is formed on the lower surface of the light-transmissive member 144, the light emitted by the luminescent member 142 is diffused according to the pattern of the irregular portion 151, such as a radial pattern, a concentric circular pattern, a lattice pattern or the like. Because the decoration effect can be obtained by the above irregular portion, the dial 150 for timepiece can obtain the decoration effects more variously than that of the eighteenth embodiment.

Although it is described that the irregular portion 151 is formed on the lower surface of the light-transmissive member 144 in the above nineteenth embodiment, the present invention is not limited to this. For example, the dial for timepiece may have a structure in which the irregular portion 151 is formed as shown in FIGS. 51 to 53.

Figure 51:
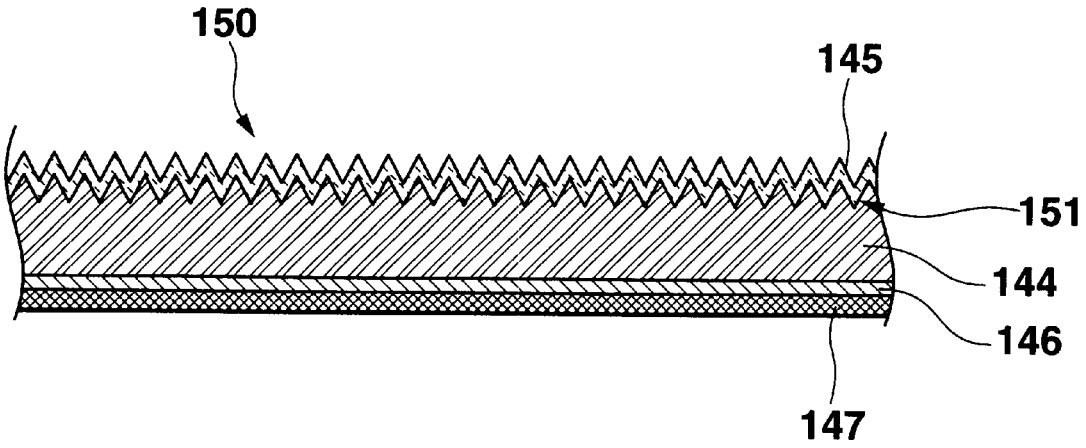
FIG. 51 is an enlarged cross-sectional view showing a principal portion of the first modified example of the nineteenth embodiment.

That is, a first modified example of the dial 150 for timepiece, which is shown in FIG. 51, has a structure in which the irregular portion 151 is formed on the upper entire surface of the light-transmissive member 144 and the color layer 145 is provided on the upper surface of the irregular portion 151. In such a structure, the same effect as the nineteenth embodiment can be obtained.

Figure 52:
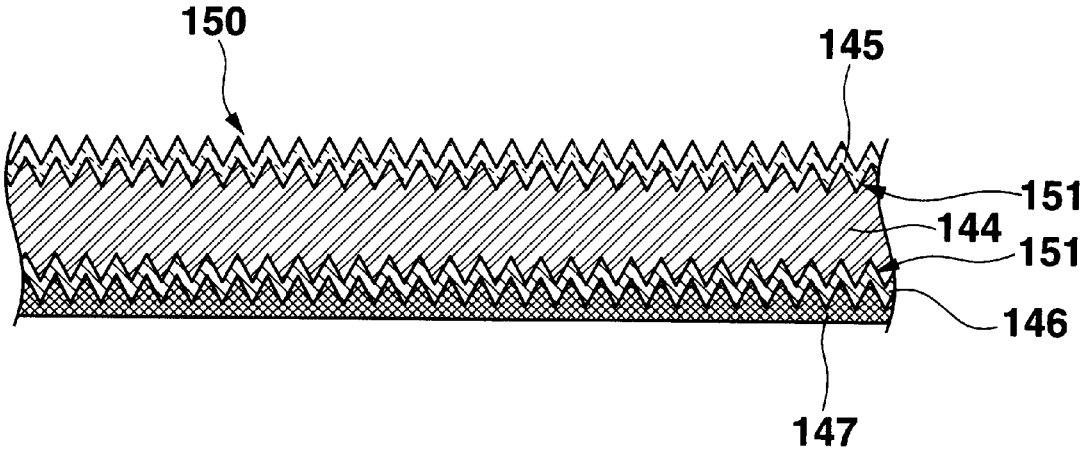
FIG. 52 is an enlarged cross-sectional view showing a principal portion of the second modified example of the nineteenth embodiment.

A second modified example of the dial 150 for timepiece, which is shown in FIG. 52, has a structure in which the irregular portions 151 are formed on both the upper entire surface of the light-transmissive member 144 and the lower entire surface thereof. In such a structure, because the decoration effect caused by each irregular portion 151 formed on both upper and lower surfaces of the light-transmissive member 144, can be obtained, the dial for timepiece can obtain the decoration effects more variously than that of the nineteenth embodiment.

Figure 53:
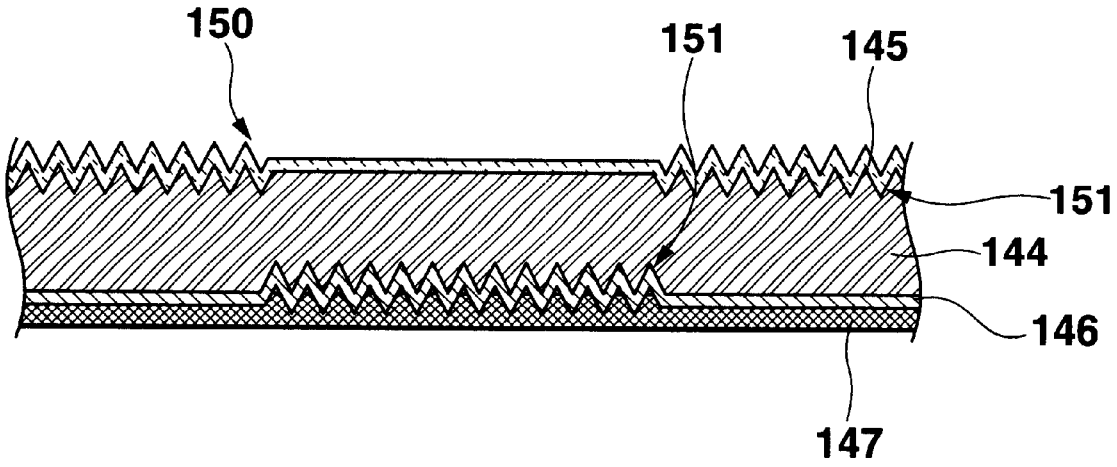
FIG. 53 is an enlarged cross-sectional view showing a principal portion of the third modified example of the nineteenth embodiment.

Further, a third modified example of the dial 150 for timepiece, which is shown in FIG. 53, has a structure in which the irregular portions 151 are formed partially on both the upper surface of the light-transmissive member 144 and the lower surface thereof. In this case, it is preferable that the irregular portion 151 formed on the upper surface of the light-transmissive member 144 and the irregular portion 151 formed on the lower surface of the light-transmissive member 144 are provided so as not to overlap each other and so as to alternate the irregular portion with a flat portion. When the dial for timepiece has such a structure, two decoration effects which are independent of each other, can be obtained by each irregular portion 151 formed on both upper and lower surfaces of the light-transmissive member 144. Thereby, more various decoration effects can be obtained.

Twentieth Embodiment

Figure 54:
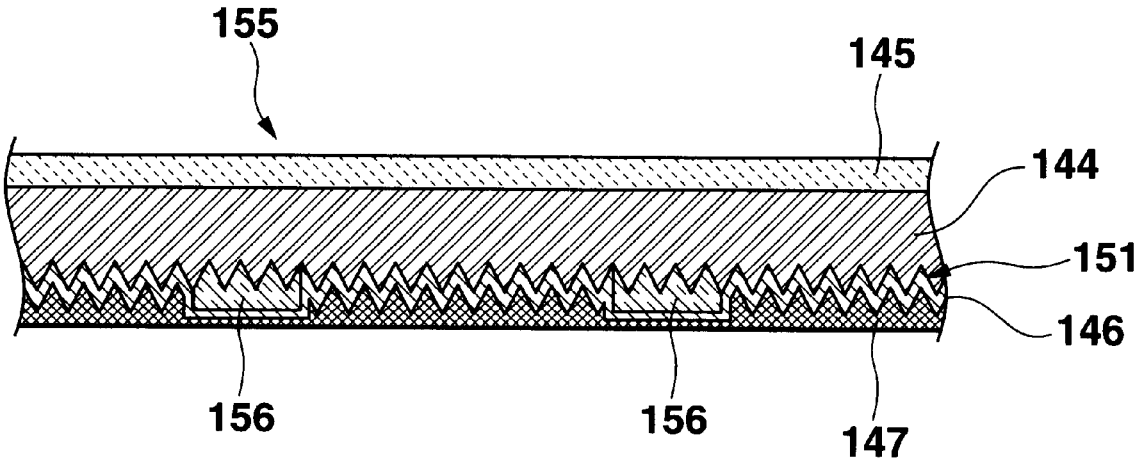
FIG. 54 is an enlarged cross-sectional view showing a principal portion of the twentieth embodiment of the dial for timepiece according to the present invention.

Next, with reference to FIG. 54, a twentieth embodiment of the dial for timepiece according to the present invention will be explained. In this case, the same reference numerals are attached to the same elements as the nineteenth embodiment shown in FIG. 50, in order to explain the twentieth embodiment.

The dial 155 for timepiece has a structure in which decoration portions 156 are provided on the lower surface of the irregular portion 151 formed on the lower surface of the light-transmissive member 144, and in which the thin film metallic layer 146 covers the decoration portions 156. The other structures of the dial 155 for timepiece are the same as those of the nineteenth embodiment.

That is, the decoration portions 156 are symbols, figures, marks, or the like, such as time induces. The decoration portions 156 are made of material having light-transmissive property or one having no light-transmissive property.

Further, the decoration portion 156 is partially provided in a predetermined position of the lower surface of the irregular portion 151 by printing, coating (clear coating) or the like. The lower surface of the decoration portion 156 is formed flat. The thin film metallic layer 146 is formed in an irregular shape in a position corresponding to the irregular portion 151 and is formed flat in a position corresponding to the decoration portion 156.

In such a dial 155 for timepiece, the same effect as the nineteenth embodiment can be obtained. Further, in particular, because the decoration portions 156 are provided on the lower surface of the irregular portion 151, the decoration effect can be caused by the decoration portions 156. Thereby, the number of variations of decorative style can increase more. Further, more various decoration effects can be obtained.

Figure 55:
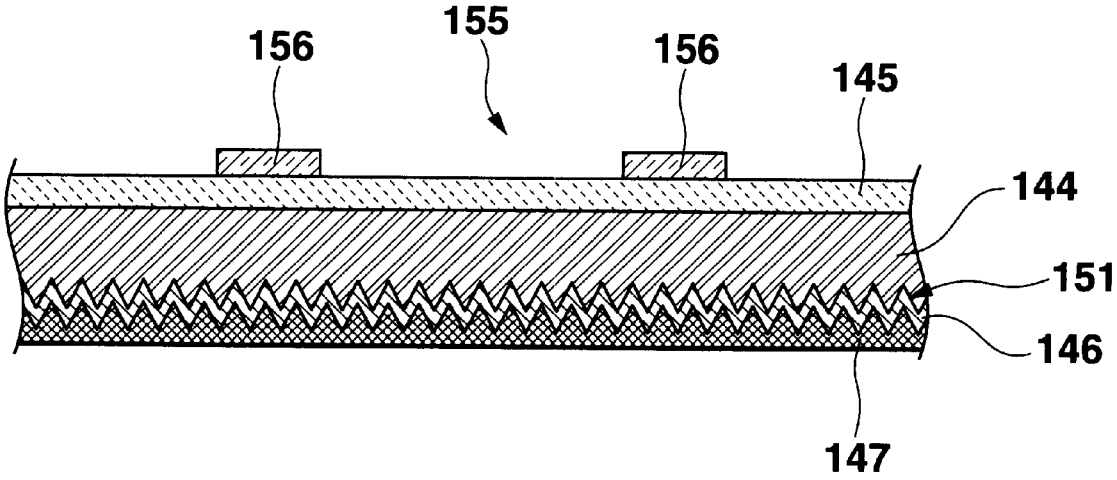
FIG. 55 is an enlarged cross-sectional view showing a principal portion of a modified example of the twentieth embodiment.

Although it is described that the decoration portions 156 are provided on the irregular portion 151 formed on the lower surface of the light-transmissive member 144 in the twentieth embodiment, the present invention is not limited to this. For example, like a modified example shown in FIG. 55, the dial for timepiece may have a structure in which the decoration portion 156 is partially provided in a predetermined position of the upper surface of the color layer 145. In such a structure, the same effect as the twentieth embodiment can be obtained. Further, in particular, because the decoration portions 156 seems to rise to the surface of the dial for timepiece, more decorative dial for timepiece, can be obtained. In this case, the color layer 145 may be formed flat as shown in FIG. 55. As shown in FIGS. 51 to 53, the color layer 145 may be formed in an irregular shape corresponding to the irregular portion 151 formed on the upper surface of the light-transmissive member 144.

Twenty-first Embodiment

Figure 56:
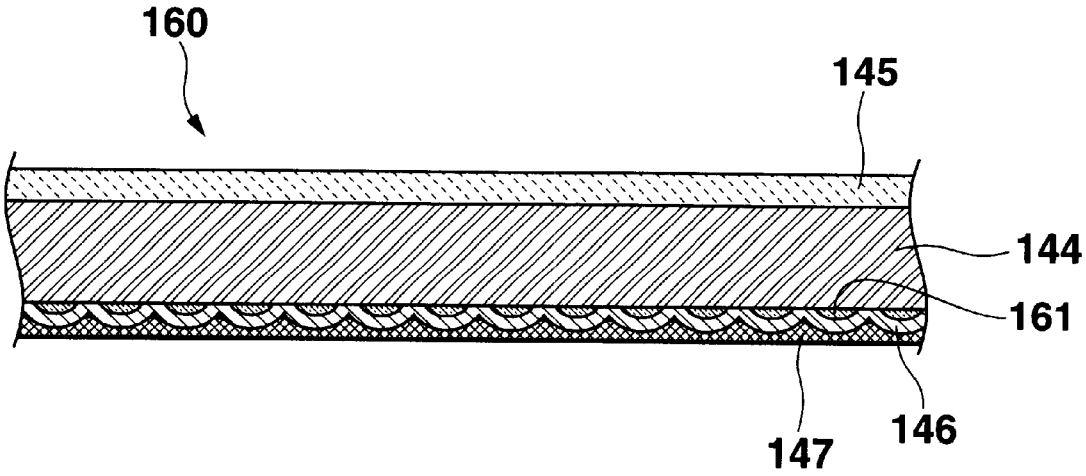
FIG. 56 is an enlarged cross-sectional view showing a principal portion of the twenty-first embodiment of the dial for timepiece according to the present invention.

Next, with reference to FIG. 56, a twenty-first embodiment of the dial for timepiece according to the present invention will be explained. In this case, the same reference numerals are attached to the same elements as the eighteenth embodiment shown in FIGS. 48 and 49, in order to explain the twenty-first embodiment.

The dial 160 for timepiece has a structure in which a printing layer 161 is provided on the lower surface of the light-transmissive member 144, and in which the thin film metallic layer 146 and the transparent protect film 147 are provided on the lower surface of the printing layer 161. The other structures of the dial 160 for timepiece are the same as those of the eighteenth embodiment.

That is, the printing layer 161 is wholly formed in an irregular shape and in a certain pattern, such as a radial pattern, a concentric circular pattern, a lattice pattern or the like, on the lower surface of the light-transmissive member 144 by printing, coating or the like so as to provide a number of projecting portions having a cross section formed in a semicircle. The thin film metallic layer 146 is formed in the same irregular shape as the printing layer 161. In the transparent protect film 147 disposed on the lower surface of the thin film metallic layer 146, the upper surface thereof is formed in an irregular shape and the lower surface thereof is formed flat.

In such a dial 160 for timepiece, the same effect as the eighteenth embodiment can be obtained. Further, in particular, because the printing layer 161 having an irregular shape is provided on the lower surface of the light-transmissive member 144, the light emitted by the luminescent member 142 is diffused according to the irregular shape of the printing layer 161. Because the decoration effect can be obtained by the above printing layer, the dial 160 for timepiece can obtain the decoration effects more variously than that of the eighteenth embodiment. In this case, the printing layer 161 can be simply and easily provided by printing, coating or the like. Thereby, the dial for timepiece, which is manufactured at a low cost, can be obtained.

Although it is described that the printing layer 161 having an irregular shape is provided on the lower surface of the light-transmissive member 144 in the above twenty-first embodiment, the present invention is not limited to this. For example, the dial for timepiece may have a structure in which the printing layer 161 is provided as shown in FIGS. 57 to 59.

Figure 57:
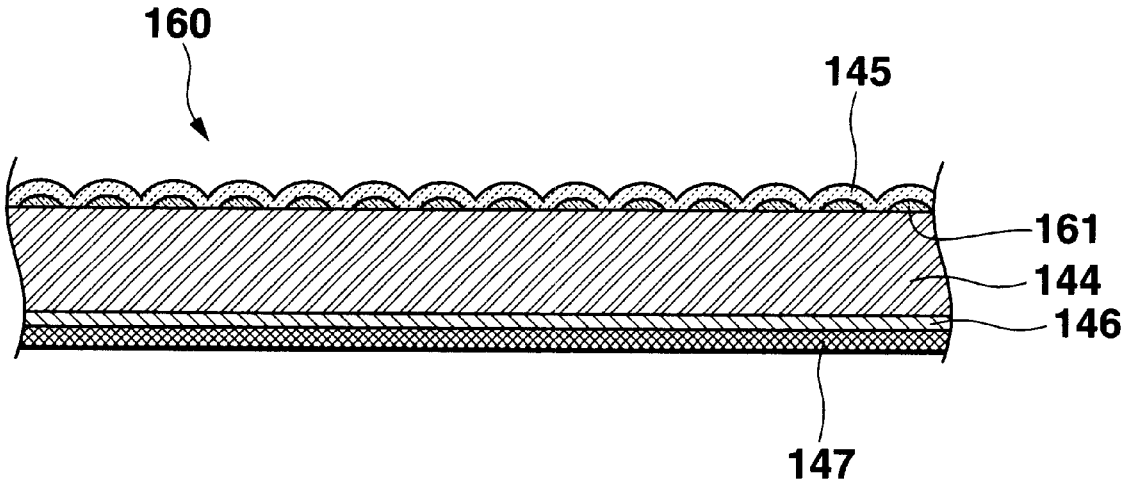
FIG. 57 is an enlarged cross-sectional view showing a principal portion of the first modified example of the twenty-first embodiment.

That is, a first modified example of the dial 160 for timepiece, which is shown in FIG. 57, has a structure in which the printing layer 161 having an irregular shape is provided on the upper entire surface of the light-transmissive member 144, and in which the color layer 145 is provided on the upper surface of the printing layer 161. In such a structure, the same effect as the twenty-first embodiment can be obtained.

Figure 58:
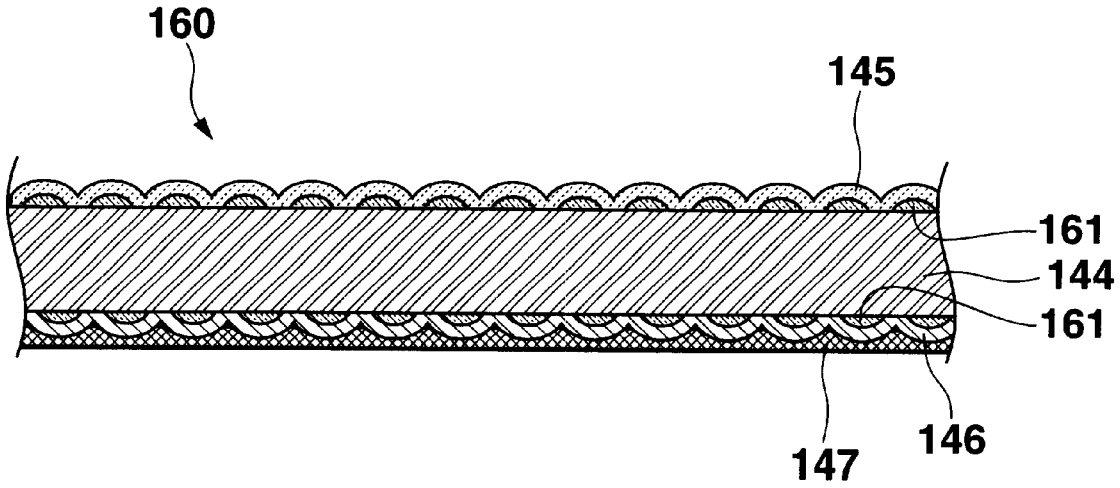
FIG. 58 is an enlarged cross-sectional view showing a principal portion of the second modified example of the twenty-first embodiment.

A second modified example of the dial 160 for timepiece, which is shown in FIG. 58, has a structure in which the printing layers 161 are provided on both the upper entire surface of the light-transmissive member 144 and the lower entire surface thereof. In such a structure, because the decoration effect caused by each irregular shape of the printing layers 161 formed on both upper and lower surfaces of the light-transmissive member 144, can be obtained, the dial for timepiece can obtain the decoration effects more variously than that of the twenty-first embodiment.

Figure 59:
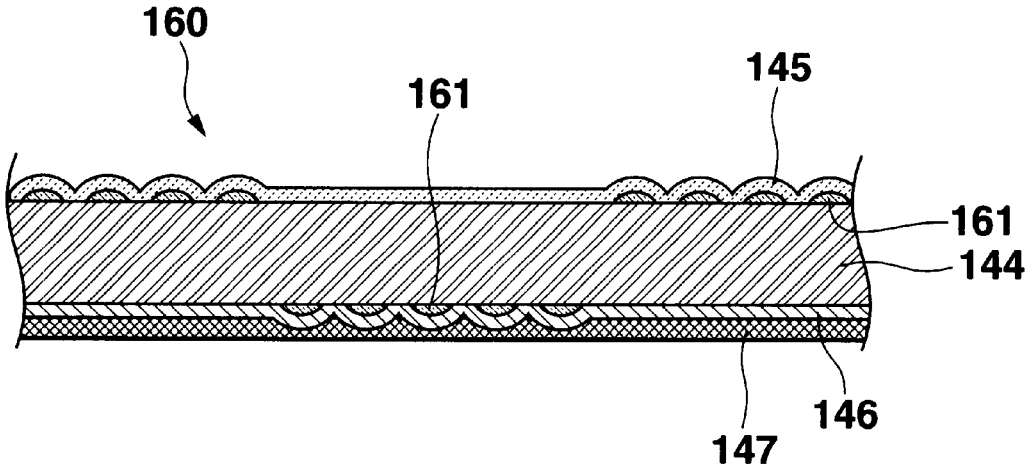
FIG. 59 is an enlarged cross-sectional view showing a principal portion of the third modified example of the twenty-first embodiment.

Further, a third modified example of the dial 160 for timepiece, which is shown in FIG. 59, has a structure in which the printing layers 161 are formed partially on both the upper surface of the light-transmissive member 144 and the lower surface thereof. In this case, it is preferable that the printing layer 161 provided on the upper surface of the light-transmissive member 144 and the printing layer 161 provided on the lower surface of the light-transmissive member 144 are provided so as not to overlap each other and so as to alternate the irregular portion with a flat portion. When the dial for timepiece has such a structure, two decoration effects which are independent of each other, can be obtained by each irregular shape of the printing layers 161 provided on both upper and lower surfaces of the light-transmissive member 144. Thereby, more various decoration effects can be obtained.

Twenty-second Embodiment

Figure 60:
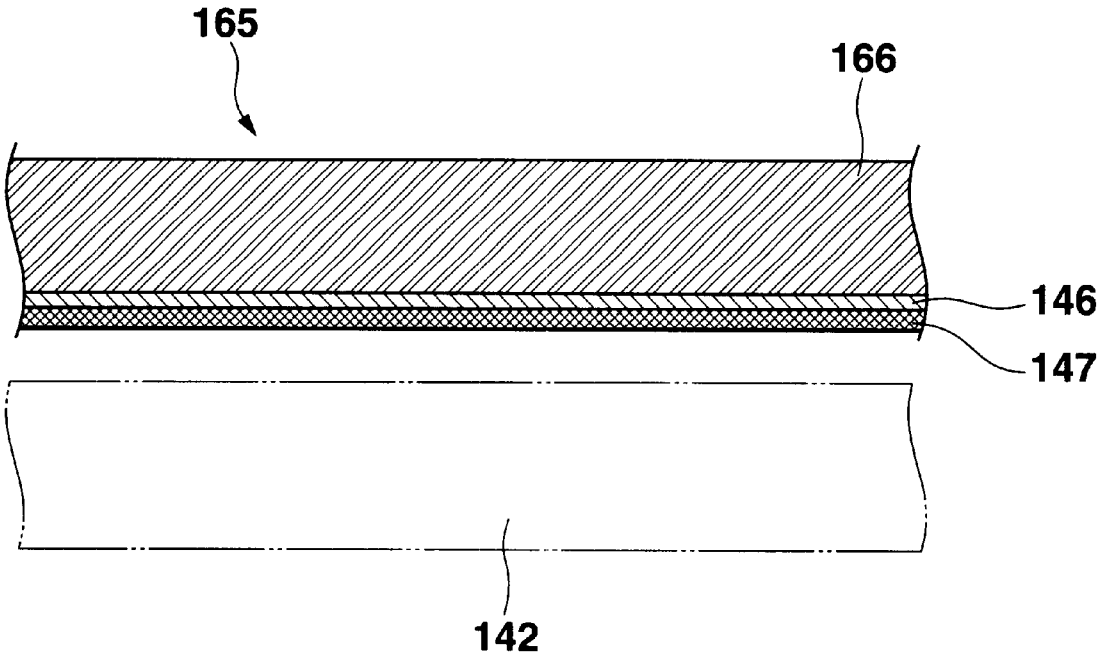
FIG. 60 is an enlarged cross-sectional view showing a principal portion of the twenty-second embodiment of the dial for timepiece according to the present invention.

Next, with reference to FIG. 60, a twenty-second embodiment of the dial for timepiece according to the present invention will be explained. In this case, the same reference numerals are attached to the same elements as the eighteenth embodiment shown in FIGS. 48 and 49, in order to explain the twenty-second embodiment.

The dial 165 for timepiece has a structure in which a light-transmissive color member 166 is disposed above the luminescent member 142, and in which the thin film metallic layer 146 and the transparent protect film 147 are layered on the lower surface of the light-transmissive color member 166. The other structures of the dial 165 for timepiece are the same as those of the eighteenth embodiment.

That is, the light-transmissive color member 166 is made of a color translucent material or a material containing color powders. The light-transmissive color member 166 transmits a light having a predetermined frequency, that is, a colored light.

In such a dial 165 for timepiece, when the luminescent member 142 is turned on and emitting a light, the emitted light outgoes toward the upper position of the luminescent member 142. The emitted light is transmitted through the transparent protect film 147, the thin film metallic layer 146 and the light-transmissive color member 166 in this order. The colored light selected by the light-transmissive color member 166 illuminates the upper surface side of the light-transmissive color member 166. Thereby, it is possible to recognize time through the watch glass 2 even in a dark place like the eighteenth embodiment.

In the dial 165 for timepiece, both during the emission of the luminescent member 142 and during the non-emission thereof, the decoration effect caused by the colored light selected by the light-transmissive color member 166 and the metallic decoration effect caused by the thin film metallic layer 146 are obtained. As a result, the number of variations of decorative style can increase by both the light-transmissive color member 166 and the thin film metallic layer 146. Therefore, various decoration effects can be obtained. Because the dial 165 for timepiece may have a structure in which only the thin film metallic layer 146 and the protect film 147 are layered on the lower surface of the light-transmissive color member 166, the dial 165 for timepiece is formed more thinly than the dial 140 for timepiece according to the eighteenth embodiment.

Twenty-third Embodiment

Figure 61:
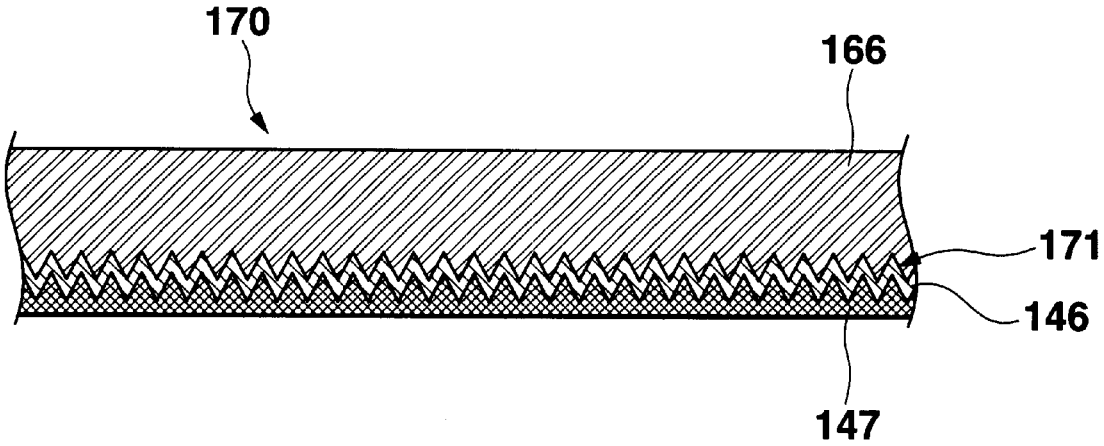
FIG. 61 is an enlarged cross-sectional view showing a principal portion of the twenty-third embodiment of the dial for timepiece according to the present invention.

Next, with reference to FIG. 61, a twenty-third embodiment of the dial for timepiece according to the present invention will be explained. The same reference numerals are attached to the same elements as the twenty-second embodiment shown in FIG. 60 in order to explain the twenty-third embodiment.

The dial 170 for timepiece has a structure in which an irregular portion 171 is formed on the lower surface of the light-transmissive color member 166, and in which the thin film metallic layer 146 and the transparent protect film 147 are provided on the lower surface of the irregular portion 171. The other structures of the dial 170 for timepiece are approximately the same as those of the twenty-second embodiment. That is, the irregular portion 171 is formed by the honing process or by the hairline process in a certain pattern, such as a radial pattern, a concentric circular pattern, a lattice pattern or the like. The thin film metallic layer 146 is formed in the same irregular shape as the irregular portion 171. In the protect film 147 disposed on the lower surface of the thin film metallic layer 146, the upper surface thereof is formed in the irregular shape and the lower surface thereof is formed flat.

In such a dial 170 for timepiece, the same effect as the twenty-second embodiment can be obtained. Further, in particular, because the irregular portion 171 is formed on the lower surface of the light-transmissive color member 166, the light emitted by the luminescent member 142 is diffused according to the pattern of the irregular portion 171, such as a radial pattern, a concentric circular pattern, a lattice pattern or the like. Because the decoration effect can be obtained by the above irregular portion, the dial 170 for timepiece can obtain the decoration effects more variously than that of the twenty-second embodiment.

Although it is described that the irregular portion 171 is formed on the lower surface of the light-transmissive color member 166 in the above twenty-third embodiment, the present invention is not limited to this. For example, the dial for timepiece may have a structure in which the irregular portion 171 is formed as shown in FIGS. 62 to 64.

Figure 62:
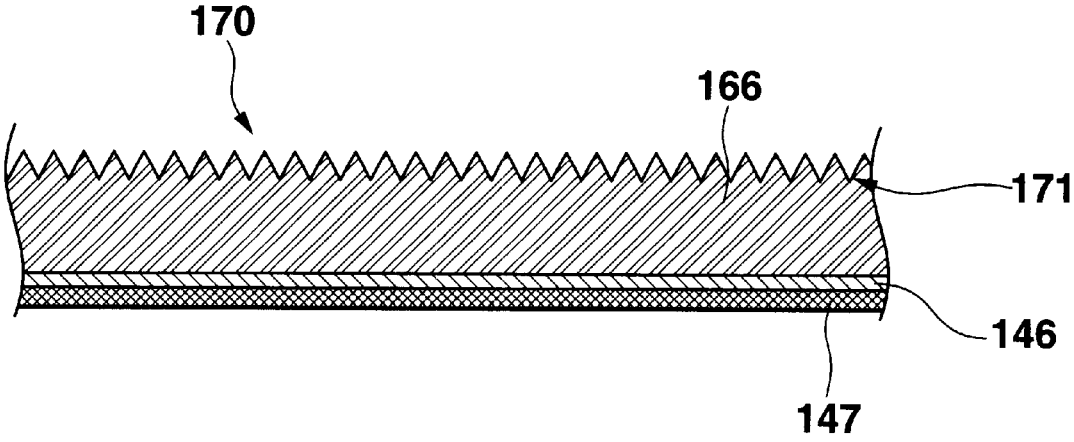
FIG. 62 is an enlarged cross-sectional view showing a principal portion of the first modified example of the twenty-third embodiment.

That is, a first modified example of the dial 170 for timepiece, which is shown in FIG. 62, has a structure in which the irregular portion 171 is formed on the upper entire surface of the light-transmissive color member 166. In such a structure, the same effect as the twenty-third embodiment can be obtained.

Figure 63:
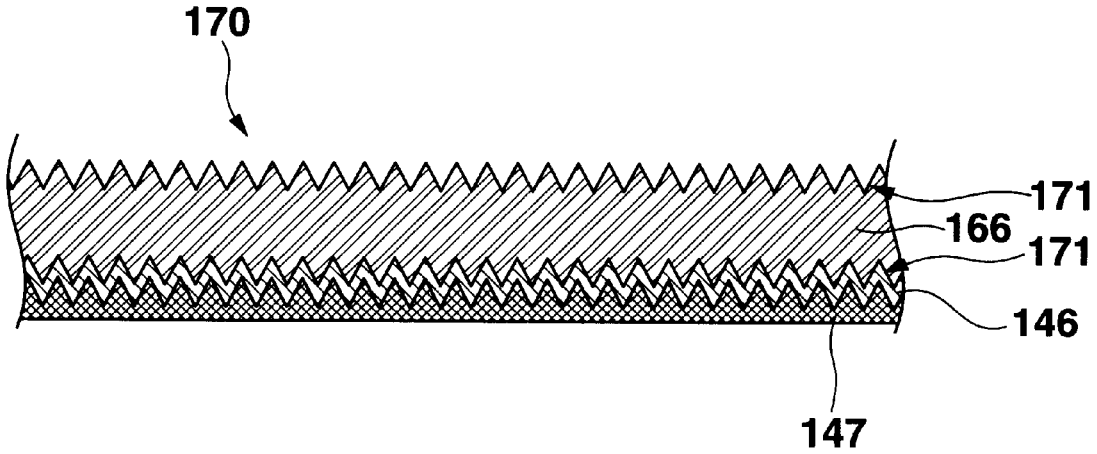
FIG. 63 is an enlarged cross-sectional view showing a principal portion of the second modified example of the twenty-third embodiment.

A second modified example of the dial 170 for timepiece, which is shown in FIG. 63, has a structure in which the irregular portions 171 are formed on both the upper entire surface of the light-transmissive color member 166 and the lower entire surface thereof. In such a structure, because the decoration effect caused by each irregular portion 171 formed on both upper and lower surfaces of the light-transmissive color member 166, can be obtained, the dial for timepiece can obtain the decoration effects more variously than that of the twenty-third embodiment.

Figure 64:
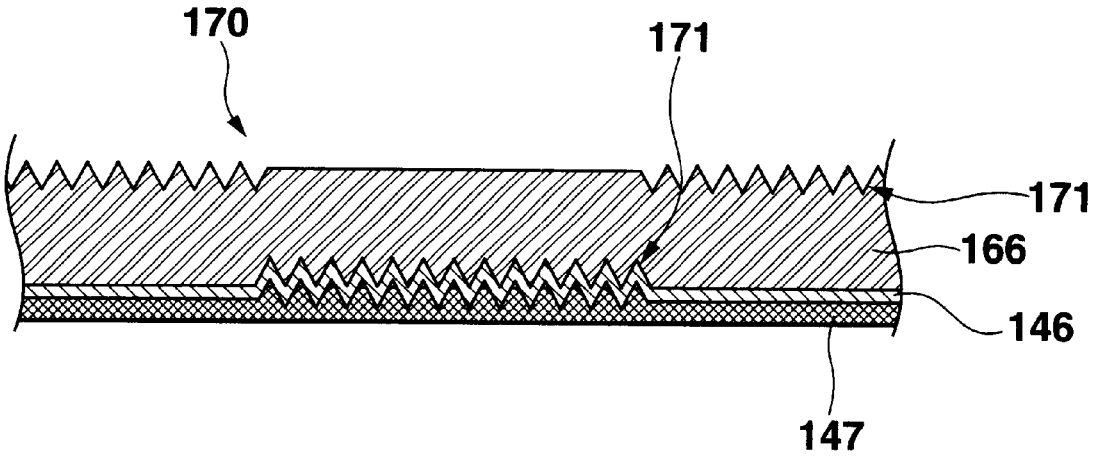
FIG. 64 is an enlarged cross-sectional view showing a principal portion of the third modified example of the twenty-third embodiment.

Further, a third modified example of the dial 170 for timepiece, which is shown in FIG. 64, has a structure in which the irregular portions 171 are formed partially on both the upper surface of the light-transmissive color member 166 and the lower surface thereof. In this case, it is preferable that the irregular portion 171 formed on the upper surface of the light-transmissive color member 166 and the irregular portion 171 formed on the lower surface of the light-transmissive color member 166 are provided so as not to overlap each other and so as to alternate the irregular portion with a flat portion. When the dial for timepiece has such a structure, two decoration effects which are independent of each other, can be obtained by each irregular portion 171 formed on both upper and lower surfaces of the light-transmissive color member 166. Thereby, more various decoration effects can be obtained.

Twenty-fourth Embodiment

Figure 65:
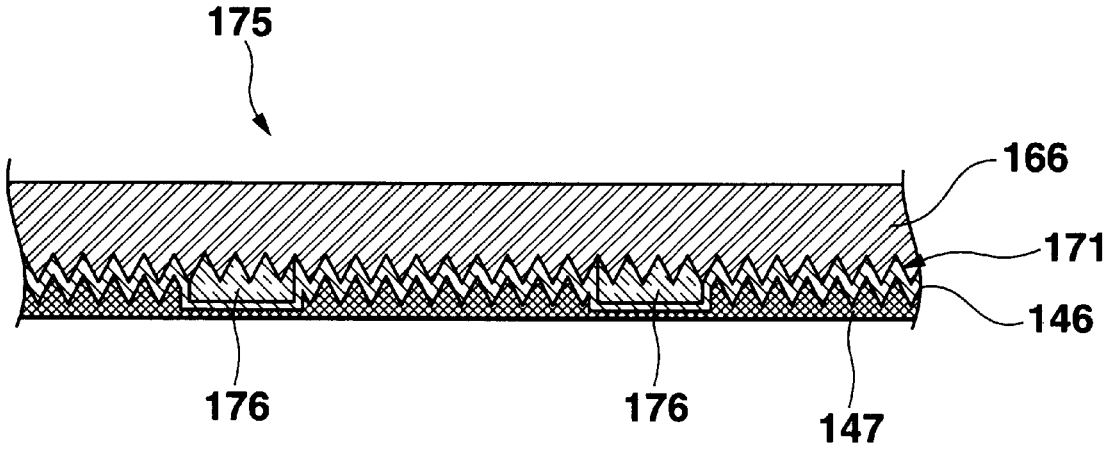
FIG. 65 is an enlarged cross-sectional view showing a principal portion of the twenty-fourth embodiment of the dial for timepiece according to the present invention.

Next, with reference to FIG. 65, a twenty-fourth embodiment of the dial for timepiece according to the present invention will be explained. In this case, the same reference numerals are attached to the same elements as the twenty-third embodiment shown in FIG. 61, in order to explain the twenty-fourth embodiment.

The dial 175 for timepiece has a structure in which decoration portions 176 are provided on the lower surface of the irregular portion 171 formed on the lower surface of the light-transmissive color member 166, and in which the thin film metallic layer 146 covers the decoration portions 176. The other structures of the dial 175 for timepiece are the same as those of the twenty-third embodiment.

That is, the decoration portions 176 are symbols, figures, marks, or the like, such as time induces. The decoration portions 176 are made of material having light-transmissive property or one having no light-transmissive property. Further, the decoration portion 176 is partially provided in a predetermined position of the lower surface of the irregular portion 171 by printing, coating (clear coating) or the like. The lower surface of the decoration portion 176 is formed flat. The thin film metallic layer 146 is formed in an irregular shape in a position corresponding to the irregular portion 171 and is formed flat in a position corresponding to the decoration portion 176.

In such a dial 175 for timepiece, the same effect as the twenty-third embodiment can be obtained. Further, in particular, because the decoration portions 176 are provided on the lower surface of the irregular portion 171, the decoration effect can be caused by the decoration portions 176. Thereby, the number of variations of decorative style can increase more. Further, more various decoration effects can be obtained.

Figure 66:
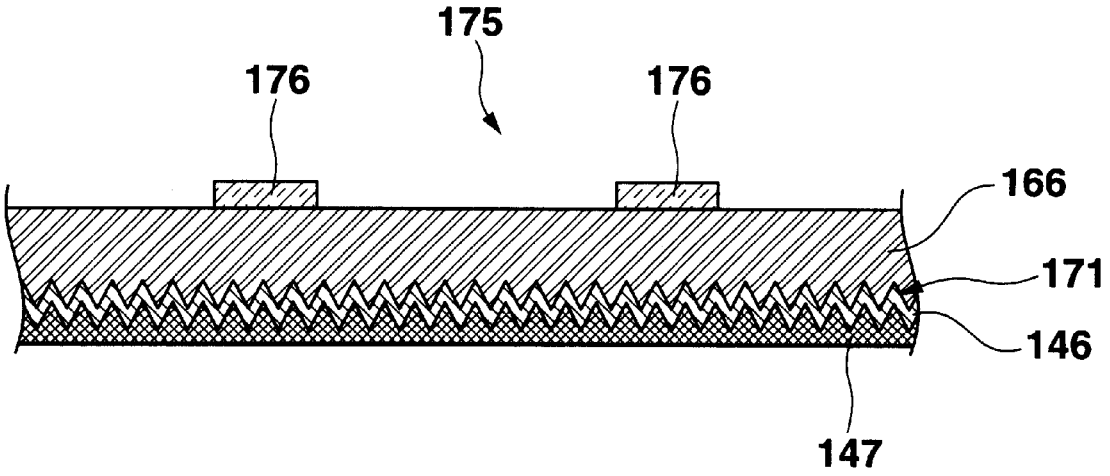
FIG. 66 is an enlarged cross-sectional view showing a principal portion of a modified example of the twenty-fourth embodiment.

Although it is described that the decoration portions 176 are provided on the irregular portion 171 formed on the lower surface of the light-transmissive color member 166 in the twenty-fourth embodiment, the present invention is not limited to this. For example, like a modified example shown in FIG. 66, the dial for timepiece may have a structure in which the decoration portion 176 is partially provided in a predetermined position of the upper surface of the light-transmissive color member 166. In such a structure, the same effect as the twenty-fourth embodiment can be obtained. Further, in particular, because the decoration portions 176 seems to rise to the surface of the dial for timepiece, more decorative dial for timepiece, can be obtained. In this case, the light-transmissive color layer 166 may be formed flat as shown in FIG. 66. As shown in FIGS. 62 to 64, the light-transmissive color member 166 may be formed in an irregular shape corresponding to the irregular portion 171 formed on the upper surface of the light-transmissive color member 166.

Twenty-fifth Embodiment

Figure 67:
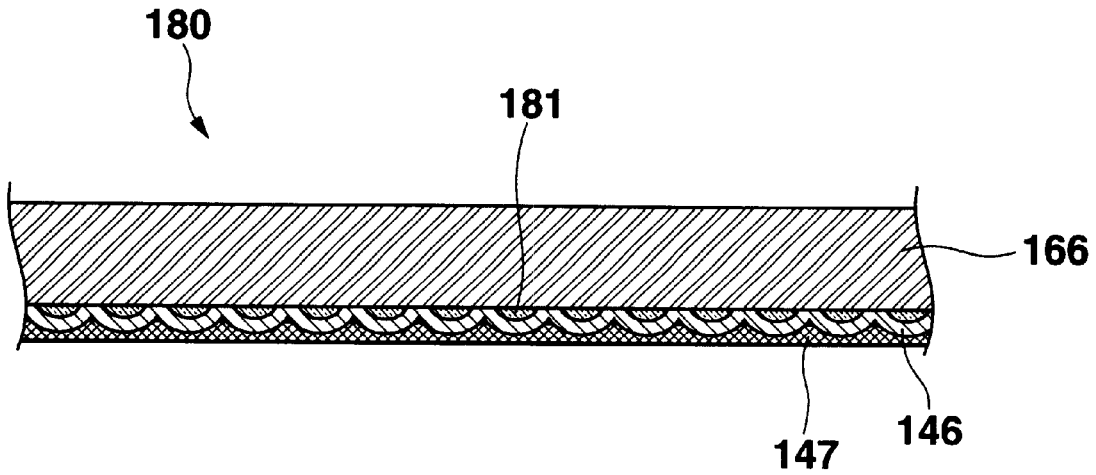
FIG. 67 is an enlarged cross-sectional view showing a principal portion of the twenty-fifth embodiment of the dial for timepiece according to the present invention.

Next, with reference to FIG. 67, a twenty-fifth embodiment of the dial for timepiece according to the present invention will be explained. In this case, the same reference numerals are attached to the same elements as the twenty-second embodiment shown in FIG. 60, in order to explain the twenty-fifth embodiment.

The dial 180 for timepiece has a structure in which a printing layer 181 is provided on the lower surface of the light-transmissive color member 166, and in which the thin film metallic layer 146 and the transparent protect film 147 are provided on the lower surface of the printing layer 181. The other structures of the dial 180 for timepiece are the same as those of the twenty-second embodiment.

That is, the printing layer 181 is wholly formed in an irregular shape and in a certain pattern, such as a radial pattern, a concentric circular pattern, a lattice pattern or the like, on the lower surface of the light-transmissive color member 166 by printing, coating or the like so as to provide a number of projecting portions having a cross section formed in a semicircle. The thin film metallic layer 146 is formed in the same irregular shape as the printing layer 181. In the transparent protect film 147 disposed on the lower surface of the thin film metallic layer 146, the upper surface thereof is formed in an irregular shape and the lower surface thereof is formed flat.

In such a dial 180 for timepiece, the same effect as the twenty-second embodiment can be obtained. Further, in particular, because the printing layer 181 having an irregular shape is provided on the lower surface of the light-transmissive color member 166, the light emitted by the luminescent member 142 is diffused according to the irregular shape of the printing layer 181. Because the decoration effect can be obtained by the above printing layer, the dial 180 for timepiece can obtain the decoration effects more variously than that of the twenty-second embodiment. In this case, the printing layer 181 can be simply and easily provided by printing, coating or the like. Thereby, the dial for timepiece, which is manufactured at a low cost, can be obtained.

Although it is described that the printing layer 181 having an irregular shape is provided on the lower surface of the light-transmissive color member 166 in the above twenty-fifth embodiment, the present invention is not limited to this. For example, the dial for timepiece may have a structure in which the printing layer 181 is provided as shown in FIGS. 68 to 70.

Figure 68:
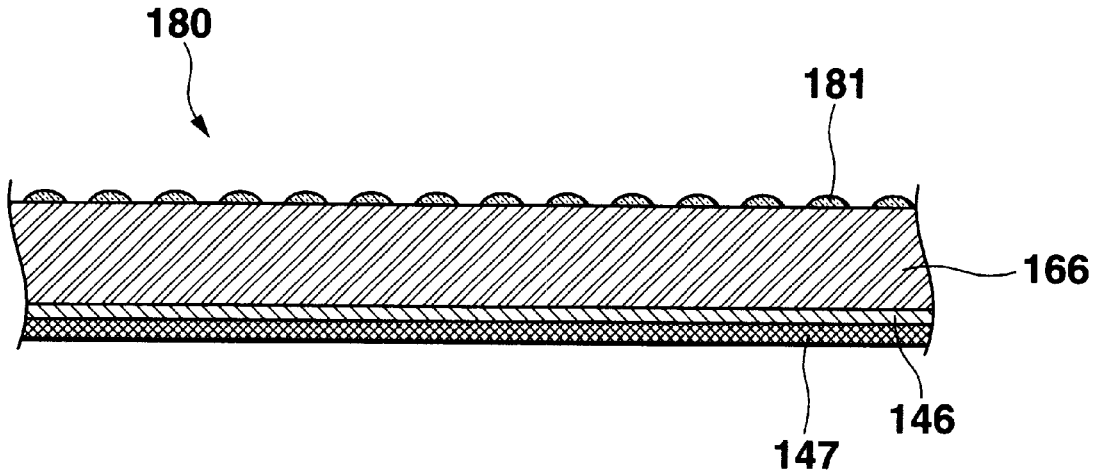
FIG. 68 is an enlarged cross-sectional view showing a principal portion of the first modified example of the twenty-fifth embodiment.

That is, a first modified example of the dial 180 for timepiece, which is shown in FIG. 68, has a structure in which the printing layer 181 having an irregular shape is provided on the upper entire surface of the light-transmissive color member 166. In such a structure, the same effect as the twenty-fifth embodiment can be obtained.

Figure 69:
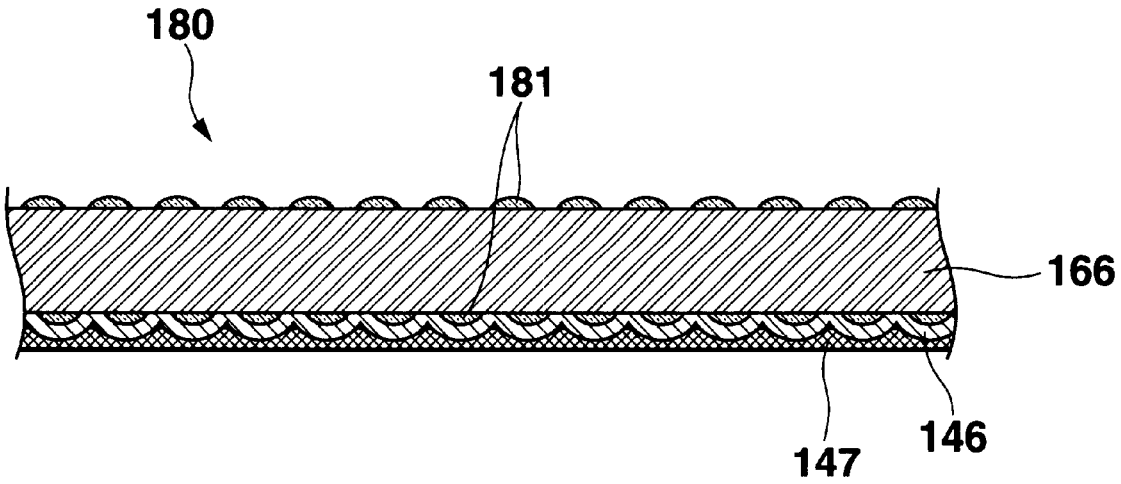
FIG. 69 is an enlarged cross-sectional view showing a principal portion of the second modified example of the twenty-fifth embodiment.

A second modified example of the dial 180 for timepiece, which is shown in FIG. 69, has a structure in which the printing layers 181 are provided on both the upper entire surface of the light-transmissive color member 166 and the lower entire surface thereof. In such a structure, because the decoration effect caused by each irregular shape of the printing layers 181 formed on both upper and lower surfaces of the light-transmissive color member 166, can be obtained, the dial for timepiece can obtain the decoration effects more variously than that of the twenty-fifth embodiment.

Figure 70:
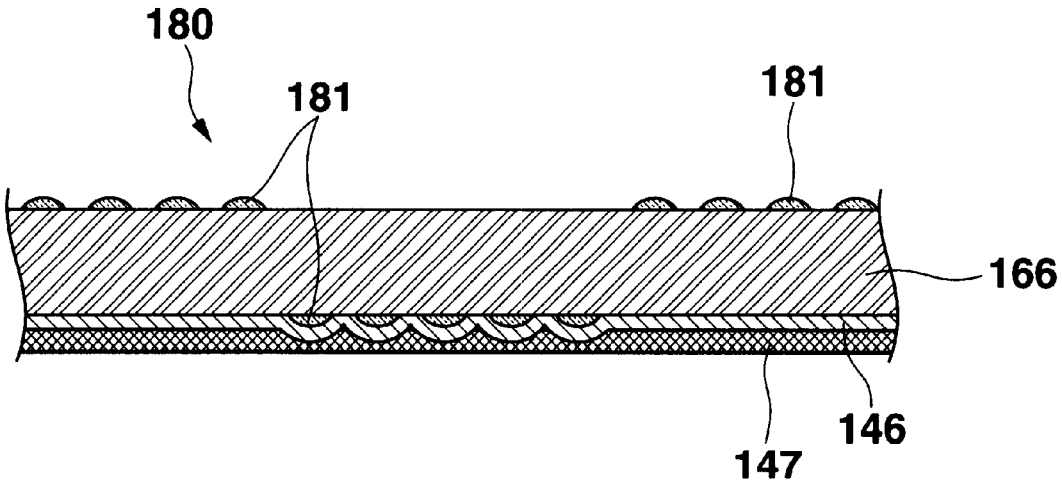
FIG. 70 is an enlarged cross-sectional view showing a principal portion of the third modified example of the twenty-fifth embodiment.

Further, a third modified example of the dial 180 for timepiece, which is shown in FIG. 70, has a structure in which the printing layers 181 are formed partially on both the upper surface of the light-transmissive color member 166 and the lower surface thereof. In this case, it is preferable that the printing layer 181 provided on the upper surface of the light-transmissive color member 166 and the printing layer 181 provided on the lower surface of the light-transmissive color member 166 are provided so as not to overlap each other and so as to alternate the irregular portion with a flat portion. When the dial for timepiece has such a structure, two decoration effects which are independent of each other, can be obtained by each irregular shape of the printing layers 181 provided on both upper and lower surfaces of the light-transmissive color member 166. Thereby, more various decoration effects can be obtained.

Although it is described that the present invention is applied to a wrist watch having an analog function in the first to twenty-fifth embodiments and the modified examples thereof, the present invention is not limited to those. For example, the present invention can be applied to a wrist watch having a digital function or to a wrist watch having a digital function and an analog function. Further, the present invention is not limited to a wrist watch. The present invention can be broadly applied to timepieces, for example, a table clock, an alarm clock, a travel watch, a wall clock or the like.

As described above, according to the present invention, a dial for timepiece, comprises: a decoration member having a through hole for decoration, and a luminescent member disposed under the decoration member; wherein a surface processed layer is provided on an upper surface of the luminescent member. Because a light transmitted through the through hole of the decoration member during the emission of the luminescent member, illuminates the upper surface side of the decoration member partially in accordance with the through hole, it is possible to recognize time even in a dark place. Further, because the decoration effect caused by the decoration member and the decoration effect caused by the surface processed layer of the luminescent member in accordance with the through hole of the decoration member are obtained, various decoration effects can be obtained by both two decoration effects.

According to the dial for timepiece, of the present invention, a dial for timepiece, comprises: a decoration member having a through hole for decoration, a light-transmissive member disposed under the decoration member, and a luminescent member disposed under the light-transmissive member; wherein a surface processed layer is provided on at least one surface of an upper surface of the light-transmissive member, a lower surface of the light-transmissive member and an upper surface of the luminescent member. Because a light transmitted through the through hole of the decoration member during the emission of the luminescent member, illuminates the upper surface side of the decoration member partially in accordance with the through hole, it is possible to recognize time even in a dark place. Further, a three-dimensional decoration effect can be obtained by the decoration effect caused by the decoration member and by the decoration effect caused by the surface processed layer provided on at least one surface of an upper surface of the light-transmissive member, a lower surface of the light-transmissive member and an upper surface of the luminescent member in accordance with the through hole of the decoration member. Therefore, more various decoration effects can be obtained.

In this case, if the surface processed layer is a decoration layer formed by application, printing, deposition or the like, when the color of the surface processed layer is similar to that of the decoration member, the through holes of the decoration member can be blind during the non-emission of the luminescent member. When the surface processed layer is an irregular layer made by forming a surface of the irregular layer into a finely irregular shape, it is possible that a light emitted from the luminescent member is diffused from the through holes of the decoration member to the outside of the dial for timepiece during the emission of the luminescent member. Thereby, the diffused light can brightly illuminate the outer peripheral side of the through holes.

The decoration effect shown during the emission of the luminescent member and the decoration effect shown during the non-emission thereof, which are different from each other can be obtained by providing the surface processed layer which is an irregular layer made by forming a surface of the surface processed layer into a finely irregular shape on the upper surface of the light-transmissive member, by providing the surface processed layer which is an irregular layer made by forming a surface of the surface processed layer into a finely irregular shape, or the surface processed layer formed by application, printing, deposition or the like and having light-transmissive property, on the lower surface of the light-transmissive member, and by the surface processed layer formed by application, printing, deposition or the like and having light-transmissive property on the upper surface of the luminescent member.

The decoration effect shown during the emission of the luminescent member and the decoration effect shown during the non-emission thereof, which are different from each other can be obtained by providing the surface processed layer which is an irregular layer made by forming a surface of the surface processed layer into a finely irregular shape on the upper surface of the light-transmissive member, by providing the surface processed layer which is an irregular layer made by forming a surface of the surface processed layer into a finely irregular shape, or the surface processed layer formed by application, printing, deposition or the like and having no light-transmissive property, on the lower surface of the light-transmissive member, and by providing the surface processed layer formed by application, printing, deposition or the like and having no light-transmissive property on the upper surface of the luminescent member.

Further, when the surface processed layer which is a decoration layer formed by application, printing, deposition or the like, is provided on an upper surface of the decoration member, the decoration effect can be obtained by the surface processed layer. Therefore, more various decoration effects can be obtained.

According to the dial for timepiece, of the present invention, a dial for timepiece, comprises: a decoration member having a through hole for decoration, a light-transmissive member provided in the through hole of the decoration member, and a luminescent member disposed under the light-transmissive member and the decoration member; wherein a surface processed layer which is a decoration layer formed by application, printing, deposition or the like, and having light-transmissive property, is provided on an upper surface of the decoration member and on an upper surface of the light-transmissive member. Because a light emitted from the luminescent member is transmitted through the light-transmissive member provided in the through hole of the surface processed layer and through the surface processed layer disposed on the upper surface of the light-transmissive member and having light-transmissive property during the emission of the luminescent member and the transmitted light illuminates the upper surface side of the decoration member partially in accordance with the through hole, it is possible to recognize time even in a dark place. Further, because of the surface processed layer which is provided on the upper surface of the decoration member and on the upper surface of the light-transmissive member, the decoration effect shown during the emission of the luminescent member and the decoration effect shown during the non-emission thereof, which are different from each other can be obtained. Therefore, various decoration effects can be obtained.

According to the dial for timepiece, of the present invention, a dial for timepiece, comprises: a decoration member having a through hole for decoration, a color light-transmissive member disposed under the decoration member, and a luminescent member disposed under the light-transmissive member. A light emitted from the luminescent member passes through the color light-transmissive member during the emission of the luminescent member. The colored light transmitted through the light-transmissive member is transmitted through the through hole of the decoration member. The transmitted light illuminates the upper surface side of the decoration member partially in accordance with the through hole. Thereby, it is possible to recognize time even in a dark place. Further, the decoration effect caused by the decoration member and the decoration effect caused by the color light-transmissive member in accordance with the through hole of the decoration member can be obtained. Therefore, various decoration effects can be obtained by both the decoration effects.

According to the dial for timepiece, of the present invention, because a surface processed layer having light-transmissive property is provided by an electric casting process on an upper surface of the light-transmissive member disposed on an upper layer of the luminescent member, a light emitted from the luminescent member is transmitted through the light-transmissive member and through the surface processed layer disposed on the upper surface of the light-transmissive member and outgoes upwardly. Thereby, the light can illuminate the upper surface side of the light-transmissive member. Further, it is possible to recognize time even in a dark place. Because the surface processed layer formed by the electric casting process is provided on the upper surface of the light-transmissive member, the representation made by the irregular pattern of the surface processed layer is varied. As a result, various diffusing states for the light or various reflecting states for the light can be obtained in accordance with the irregular pattern thereof. Therefore, the number of variations of decorative style can increase. Further, various decoration effects can be obtained.

In this case, when the light-transmissive layer and a metallic member are disposed on the upper layer of the luminescent member so as to expose both an upper surface of the light-transmissive member and an upper surface of the metallic member, a light emitted from the luminescent member is transmitted through the light-transmissive member and through the surface processed layer disposed on the upper surface of the light-transmissive member and outgoes upwardly. Thereby, it is possible to recognize time even in a dark place. The decorative representation is varied by the surface processed layer disposed on the upper surface of the light-transmissive member. Further, because a feeling of metallic gloss is obtained by the metallic member, a user can be filled with a feeling of high quality. Because the decoration effects caused by both the surface processed layer of the light-transmissive member and the metallic member can be obtained, the number of variations of decorative style can increase. Therefore, various decoration effects can be obtained.

When the light-transmissive layer is made of colorless transparent material, color translucent material or material including powder and having light-transmissive property, the decoration effect can be obtained by the above light-transmissive member. Therefore, the number of variations of decorative style can increase. Further, various decoration effects can be obtained.

When the dial for timepiece has a structure in which a plurality of different electric casting design portions or mirror-surface portions are mixed on the surface processed layer, the representation made by the irregular pattern of the surface processed layer is more varied. Therefore, the number of variations of decorative style can increase. Further, various decoration effects can be obtained.

When a metallic layer having light-transmissive property is at least partially provided on an upper surface of the light-transmissive member or a lower surface of the light-transmissive member, a feeling of metallic gloss can be obtained by the metallic layer. Further, a user can be filled with a feeling of high quality. Therefore, the number of variations of decorative style can increase. Further, various decoration effects can be obtained.

When a decoration layer is at least partially provided above the metallic layer or under the metallic layer, the decoration effect can be obtained by the decoration layer. Therefore, the number of variations of decorative style can increase and various decoration effects can be obtained. In this case, when the decoration layer is provided under the metallic layer, the decoration layer is hidden by the metallic layer during the non-emission of the luminescent member. On the other hand, during the emission of the luminescent member, the decoration layer appears on the dial for timepiece. The decoration effect shown during the emission of the luminescent member and the decoration effect shown during the non-emission thereof, which are different from each other can be obtained. Therefore, the number of variations of decorative style can increase. Further, more various decoration effects can be obtained.

When a metallic layer having light-transmissive property and a decoration layer are partially arranged on an upper surface of the light-transmissive member, the decoration effect caused by both the metallic layer and the decoration layer as well as the decoration effect caused by the surface processed layer can be obtained. Therefore, the number of variations of decorative style can increase. Further, various decoration effects can be obtained.

When the decoration layer has a structure in which one part of the decoration layer has a different light-transmissive property from another, the decoration effect shown during the emission of the luminescent member and the decoration effect shown during the non-emission thereof, which are different from each other can be obtained. Therefore, the number of variations of decorative style can increase. Further, more various decoration effects can be obtained.

In this case, when the luminescent member has a structure in which an intensity of a light emitted from the luminescent member is adjustable, the decorative representation made by the decoration layer can be more varied by adjusting the light intensity during the emission of the luminescent member. Thereby, the number of variations of decorative style can increase more. Further, more various decoration effects can be obtained.

According to the dial for timepiece, of the present invention, a dial for timepiece, comprises: a luminescent member, a light-transmissive member disposed above the luminescent member, a color layer provided on an upper surface of the light-transmissive member and having light-transmissive property, and a thin film metallic layer having light-transmissive property and provided on a lower surface of the light-transmissive member. A light emitted from the luminescent member is transmitted through the thin film metallic layer having light-transmissive property, the light-transmissive member and the color layer. The colored light transmitted through the color layer can illuminate the upper surface side of the color layer. Thereby, it is possible to recognize time even in a dark place. Further, the decoration effect caused by the colored light transmitted through the color layer and the metallic decoration effect caused by the thin film metallic layer can be obtained. Therefore, various decoration effects can be obtained by both the above decoration effects.

In this case, when an irregular portion is wholly or partially formed on at least one surface of an upper surface of the light-transmissive member and a lower surface of the light-transmissive member, the light emitted from the luminescent member can be diffused by the irregular portion. Therefore, various decoration effects can be obtained by the irregular portion. When the irregular portion is a printing layer, the irregular portion can be simply and easily formed. Thereby, the dial for timepiece, which is manufactured at a low cost, can be obtained. When a decoration portion is partially provided on the color layer, the decoration effect can be caused by the above decoration portion. Further, when a decoration portion is partially provided on the lower surface of the light-transmissive member, and the thin film metallic layer is provided so as to cover the decoration portion, the decoration effect can be caused by the decoration portion provided on the thin film metallic layer. When a transparent protect film is provided on a lower surface of the thin film metallic layer, the thin film metallic layer can be protected by the protect film excellently even though the thin film metallic layer is formed thinly.

According to the timepiece of the present invention, a timepiece comprises: a dial for timepiece; wherein the dial for timepiece is disposed in a watch case and a watch glass is mounted in an upper position of the dial for timepiece, which is disposed in the watch case. Because the dial for timepiece can be seen through the watch glass mounted in an upper position of the dial for timepiece even though the dial for timepiece is disposed in the watch case, it is possible to recognize time by the dial for timepiece even in a dark place. Further, various decoration effects can be obtained by the dial for timepiece.

What is claimed is:

1. A luminous dial comprising:

a decoration member having a through hole for decoration, a light-transmissive member disposed under the decoration member, and a luminescent member disposed under the light-transmissive member;

wherein a first surface processed layer having an irregular surface is provided on an upper surface of the light-transmissive member; and wherein a second surface processed layer is provided on one of a part of a lower surface of the light-transmissive member and a part of an upper surface of the luminescent member.

2. The luminous dial as claimed in claim 1, wherein the second surface processed layer has a light-transmissive property.

3. The luminous dial as claimed in claim 1, wherein the second surface processed layer does not have a light-transmissive property.

4. The luminous dial as claimed in claim 1, wherein:

the second surface processed layer is a decoration layer formed by one of application, printing and deposition, and the second surface processed layer has a light-transmissive property and is provided on the lower surface of the light-transmissive member, and a third surface processed layer, which is also a decoration layer formed by one of application, printing and deposition, is provided on the upper surface of the luminescent member, and the third surface processed layer also has a light-transmissive property.

5. The luminous dial as claimed in claim 1, wherein:

the second surface processed layer and deposition, and the second surface processed layer does not have a light-transmissive property and is provided on the lower surface of the light-transmissive member, and a third surface processed layer, which is also a decoration layer formed by one of application, printing and deposition, is provided on the upper surface of the luminescent member, and the third surface processed layer does not have a light-transmissive property.

6. The luminous dial as claimed in claim 1, wherein a fourth surface processed layer, which is also a decoration layer formed by one of application, printing and deposition, is provided on an upper surface of the decoration member.

7. A luminous dial comprising:

a luminescent member, and a light-transmissive member disposed on an upper layer of the luminescent member;

wherein an irregular portion is formed on an upper surface of the light-transmissive member, and a metallic layer is deposited on the irregular portion of the light-transmissive member so as to form a metallic irregular portion having approximately a same shape as the irregular portion, on an upper surface of the metallic layer.

8. The luminous dial as claimed in claim 7, wherein the light-transmissive member and the metallic layer are disposed so as to expose both the upper surface of the light-transmissive member and the upper surface of the metallic layer.

9. The luminous dial as claimed in claim 7, wherein the light-transmissive member comprises at least one of a colorless transparent material, a colored translucent material and a material including powder and having a light-transmissive property.

10. The luminous dial as claimed in claim 7, wherein a plurality of at least one of different electric casting design portions and mirror-surface portions are mixed on the light-transmissive member.

11. The luminous dial as claimed in claim 7, wherein the metallic layer has a light-transmissive property.

12. The luminous dial as claimed in claim 11, wherein a decoration layer is at least partially provided above the metallic layer or under the metallic layer.

13. The luminous dial as claimed in claim 12, wherein the decoration layer comprises at least two portions having a different light-transmissive property from each other.

14. The luminous dial as claimed in claim 13, wherein the luminescent member has an adjustable light emission intensity.

15. The luminous dial as claimed in claim 7, wherein the metallic layer has a light-transmissive property, and the metallic layer and a decoration layer are partially arranged on the upper surface of the light-transmissive member.

16. A luminous dial comprising:

a luminescent member, a light-transmissive member disposed above the luminescent member, a color layer provided on an upper surface of the light-transmissive member and having a light-transmissive property, and a thin film metallic layer, also having a light-transmissive property, provided on a lower surface of the light-transmissive member facing the luminescent member;

wherein an irregular portion is at least partially formed on a lower surface of the light-transmissive member; and wherein the thin film metallic layer is formed so as to transfer the irregular portion to an upper surface of the thin film metallic layer.

17. The luminous dial as claimed in claim 16, wherein the irregular portion is a printing layer.

18. The luminous dial as claimed in claim 16, wherein a decoration portion is partially provided on the color layer.

19. The luminous dial as claimed in claim 16, wherein a decoration portion is partially provided on the lower surface of the light-transmissive member, and the thin film metallic layer is provided to cover the decoration portion.

20. The luminous dial as claimed in claim 16, wherein a transparent protect film is provided on a lower surface of the thin film metallic layer.

21. A timepiece comprising:

a luminous dial including a decoration member having a through hole for decoration, a light-transmissive member disposed under the decoration member, and a luminescent member disposed under the light-transmissive member, a watch case in which the luminous dial is disposed, and a watch glass mounted above the luminous dial;

wherein a first surface processed layer having an irregular surface is provided on an upper surface of the light-transmissive member; and wherein a second surface processed layer is provided on one of a part of a lower surface of the light-transmissive member and a part of an upper surface of the luminescent member.

22. The timepiece as claimed in claim 21, wherein the second surface processed layer has a light-transmissive property.

23. The timepiece as claimed in claim 21, wherein the second surface processed layer does not have a light-transmissive property.

* * * * *